US010933272B2

(12) United States Patent
Polinsky

(10) Patent No.: US 10,933,272 B2
(45) Date of Patent: Mar. 2, 2021

(54) AUTO-ADJUSTABLE WEIGHT DEVICE, SYSTEM, AND METHOD

(71) Applicant: Glenn Polinsky, Vancouver, WA (US)

(72) Inventor: Glenn Polinsky, Vancouver, WA (US)

( * ) Notice: Subject to any disclaimer, the term of this patent is extended or adjusted under 35 U.S.C. 154(b) by 7 days.

(21) Appl. No.: 16/295,748

(22) Filed: Mar. 7, 2019

(65) Prior Publication Data

US 2019/0388724 A1 Dec. 26, 2019

Related U.S. Application Data

(60) Provisional application No. 62/688,638, filed on Jun. 22, 2018.

(51) Int. Cl.

| | |
|---|---|
| ***A63B 21/075*** | (2006.01) |
| ***A63B 24/00*** | (2006.01) |
| ***A63B 21/062*** | (2006.01) |
| ***A63B 21/072*** | (2006.01) |
| ***A63B 71/00*** | (2006.01) |

(52) U.S. Cl.

CPC ..... *A63B 21/075* (2013.01); *A63B 21/0626* (2015.10); *A63B 21/0726* (2013.01); *A63B 24/0087* (2013.01); *A63B 71/0036* (2013.01)

(58) Field of Classification Search

CPC ..... A63B 21/072–0783; A63B 21/06–0632; A63B 43/02; A63B 60/32

See application file for complete search history.

(56) References Cited

U.S. PATENT DOCUMENTS

| | | | | |
|---|---|---|---|---|
| 4,384,714 | A * | 5/1983 | Kimura | A63B 21/065 482/105 |
| 4,529,197 | A | 7/1985 | Gogarty | |
| 4,746,113 | A | 5/1988 | Kissel | |
| 5,242,350 | A | 9/1993 | Chang | |
| 5,250,014 | A | 10/1993 | Chang | |
| 5,350,344 | A | 9/1994 | Kissel | |
| D359,788 | S | 6/1995 | Towley, III | |

(Continued)

FOREIGN PATENT DOCUMENTS

WO WO 2005016457 A2 2/2005

OTHER PUBLICATIONS https://powerblock.com/; PowerBlock; Date Accessed: Jul. 20, 2020.

(Continued)

*Primary Examiner* — Nyca T Nguyen

(74) *Attorney, Agent, or Firm* — Boardman & Clark LLP

(57) ABSTRACT

A physical training system includes a weight device having a weight retainer which receives one or more weight rods. The weight rods are selectively and removably retained within the weight retainer. A platform receives the weight device and carries one or more weight rods not selected and retained within the weight retainer. A software application is provided in communication with the platform or weight device and configured to drive selection and retention of the number of weight rods to be retained within the weight retainer. A database of selectable workout segments is also provided, wherein the software application selects and executes a selectable workout segment from the database of selectable workout segments simultaneously with the selection of one or more weight rods which are retained by the weight device.

10 Claims, 43 Drawing Sheets

(56) References Cited

U.S. PATENT DOCUMENTS 5,464,379 A * 11/1995 Zarecky ..... A63B 21/0728 482/106
5,637,064 A 6/1997 Towley, III
5,779,604 A 7/1998 Towley, III
6,015,367 A 1/2000 Scaramucci
D422,654 S 4/2000 James Chen
D425,950 S 5/2000 Ceppo
6,083,144 A 7/2000 Towley, III
6,149,558 A 11/2000 Chen
6,174,265 B1 1/2001 Alessandri
6,196,952 B1 3/2001 Chen
6,228,003 B1 5/2001 Dalebout
D443,660 S 6/2001 Ceppo
6,261,022 B1 7/2001 Dalebout
6,500,101 B1 12/2002 Chen
6,656,093 B2 12/2003 Chen
D495,383 S 8/2004 Ceppo
D498,272 S 11/2004 Sanford-Schwentke
6,872,173 B2 3/2005 Krull
D508,628 S 8/2005 Crawford
7,001,310 B1 * 2/2006 Brice ..... A63B 21/075 482/106
7,090,625 B2 8/2006 Chermack
D528,173 S 9/2006 Flick
D528,611 S 9/2006 Flick
7,172,536 B2 2/2007 Liu
D540,405 S 4/2007 Crawford
D540,894 S 4/2007 Crawford
7,223,214 B2 5/2007 Chen
7,261,678 B2 8/2007 Crawford
7,264,578 B1 9/2007 Krull
7,285,078 B1 10/2007 Liu
7,413,533 B2 8/2008 Lin
7,452,312 B2 11/2008 Liu
7,491,157 B1 2/2009 Lin
7,497,814 B1 3/2009 Krull
7,533,265 B2 6/2009 Crawford
7,540,832 B2 6/2009 Krull
7,578,771 B1 * 8/2009 Towley, III ..... A63B 1/04 482/106
7,604,577 B2 10/2009 Lin
7,604,578 B2 10/2009 Liu
7,614,982 B2 11/2009 Crawford
7,678,031 B2 3/2010 Ngy
7,731,641 B1 6/2010 Chen
7,762,933 B1 7/2010 Yu
7,794,373 B2 9/2010 Crawford
7,811,213 B2 10/2010 Chen
7,862,487 B2 1/2011 Olson
7,887,469 B1 2/2011 Chen
7,938,762 B2 5/2011 Nishimura
7,963,886 B1 6/2011 Schwinn et al.
8,002,680 B2 8/2011 Crawford
8,007,415 B1 8/2011 Lundquist
8,025,613 B1 9/2011 Wang
8,251,878 B2 8/2012 Liu
8,517,895 B2 * 8/2013 Shalev ..... A61H 7/001 482/1
8,540,607 B2 9/2013 Kissel et al.
8,684,893 B2 4/2014 Tang
8,696,529 B2 4/2014 Krull
8,771,153 B2 * 7/2014 Dalebout ..... A63B 21/0726 482/106
8,790,223 B2 7/2014 Wang
8,986,166 B2 3/2015 Nishimura
8,992,396 B2 3/2015 Wang
9,022,907 B2 5/2015 Wang
9,327,159 B1 * 5/2016 Medina ..... A63B 21/072
9,403,047 B2 8/2016 Olson et al.
9,616,273 B2 3/2017 Chen
9,776,032 B2 10/2017 Moran
9,795,822 B2 10/2017 Smith et al.
9,814,922 B2 11/2017 Moran
9,849,326 B2 12/2017 Smith et al.
9,943,719 B2 4/2018 Smith et al.
9,956,451 B1 * 5/2018 Wang ..... A63B 21/075
1,006,506 A1 9/2018 Smith et al.
10,071,285 B2 * 9/2018 Smith ..... A63B 21/0726
10,099,083 B1 * 10/2018 Owusu ..... A63B 71/0036
2002/0025888 A1 2/2002 Germanton et al.
2003/0144089 A1 * 7/2003 Ryan ..... A63B 60/06 473/457
2004/0067826 A1 * 4/2004 Elledge ..... A63B 21/0728 482/106
2005/0085351 A1 * 4/2005 Kissel ..... A63B 21/075 482/94
2007/0179030 A1 8/2007 Slawinski
2008/0242509 A1 10/2008 Menektchiev et al.
2011/0300999 A1 * 12/2011 Cavaliere ..... A63B 21/0608 482/108
2012/0010055 A1 * 1/2012 Webb ..... A63B 21/0628 482/98
2013/0040788 A1 * 2/2013 Booker ..... A63B 21/4043 482/106
2013/0231225 A1 * 9/2013 Shozda ..... A63B 21/075 482/108
2014/0141944 A1 * 5/2014 Johnson ..... A63B 21/072 482/93
2015/0196792 A1 * 7/2015 Towley ..... A63B 21/00065 482/93
2015/0209609 A1 7/2015 Oteman
2015/0375039 A1 * 12/2015 Park ..... G06K 9/00342 482/8
2016/0059064 A1 * 3/2016 Smith ..... A63B 21/0726 482/5
2016/0089575 A1 * 3/2016 Smith ..... H04M 1/72533 482/5
2016/0101311 A1 4/2016 Workman
2016/0101320 A1 * 4/2016 Tsutsui ..... A63B 21/072 482/8
2016/0144221 A1 * 5/2016 Wallander ..... A63B 21/055 482/106
2016/0184623 A1 * 6/2016 Moran ..... A63B 21/0726 482/8
2016/0310789 A1 * 10/2016 Emerson ..... A63B 24/0062
2017/0001061 A1 * 1/2017 Marjama ..... A63B 71/0619
2017/0274240 A1 * 9/2017 Pong ..... A63B 21/00065
2018/0126244 A1 * 5/2018 Doerr ..... A63B 21/00
2018/0169460 A1 * 6/2018 Chen ..... A63B 21/075
2018/0264308 A1 * 9/2018 Wang ..... A63B 21/0728

OTHER PUBLICATIONS https://www.bowflex.com/; Bowflex; Date Accessed: Jul. 20, 2020.
https://www.lesmills.com/; LesMills; Date Accessed: Jul. 20, 2020.
https://dailyburn.com/; Daily Burn; Date Accessed: Jul. 20, 2020.
https://sworkit.com/; Sworkit; Date Accessed: Jul. 20, 2020.
https://www.nike.com/ntc-app; Nike Training Club; Date Accessed: Jul. 20, 2020.
https://www.tonal.com/; Tonal; Date Accessed: Jul. 20, 2020.

* cited by examiner

AUTO-ADJUSTABLE WEIGHT DEVICE, SYSTEM, AND METHOD

CROSS-REFERENCE TO RELATED APPLICATIONS

This application claims priority to U.S. Provisional Application Ser. No. 62/688,638, filed Jun. 22, 2018, entitled "Auto-Adjustable Dumbbell, System, and Method," the entire contents of which is hereby incorporated by reference in its entirety herein.

FIELD

The present inventions relate to the field of physical fitness equipment. The present inventions more specifically relate to the field of weight lifting equipment and exercise programs.

BACKGROUND

Handheld weights, such as dumbbells are well known. Such weights have been used for fitness dating back to ancient Greece. Functional trainers are also well known. Today these weight devices are some of the most popular strength and fitness tools, and are seen in virtually every gym and weight room. In addition, one or both of these types of weight devices are also used at home.

While both types are weights are versatile, they are significantly underutilized. For example, dumbbells and functional trainers can be used for a number of exercises, but it is an "art" to actually use the weights properly. In addition, during exercise, an individual user must select the weight, thereby requiring the user to select the correct weight and focus on constantly changing weight if the device is used during the during a physical fitness training routine.

Accordingly, a need exists for a weight device, system and method which address the various drawbacks of existing devices. In particular, a need exists for a weight device, system, and method that leverage the functionality or take advantage of the potential and versatility of the weight device during exercise or physical fitness routine and further let the user focus on exercise rather than changing weight.

SUMMARY

Accordingly, an auto-adjustable weight device, system, and method are disclosed which solve one or more drawbacks of existing devices. In particular, a weight device, system, and method are disclosed that leverage the functionality or take advantage of the potential and versatility of the weight device during exercise or physical fitness routine and further let the user focus on exercise rather than changing weight. As disclosed in greater detail below, an auto-adjustable weight device is provided that is combined with a software application executed by a portable electronic device.

More specifically, an auto-adjustable weight device is disclosed that comprises a weight retainer comprising one or more receptors; one or more weight rods sized to be received in the one or more receptors; and a selector mechanism configured to select one or more weight rods and secure the weight rods in the weight retainer receptors in response to an instruction from a software application.

An auto-adjustable weight system is also disclosed. The auto-adjustable weight system includes a weight device having a weight retainer which receives one or more weight rods, the weight rods being selectively and removably retained within the weight retainer. A platform receives the weight device and carries one or more weight rods not selected and retained within the weight retainer. A software application in communication with the platform or weight device is configured to drive selection and retention of the number of weight rods retained within the weight retainer.

A physical training system is also disclosed. The system includes a weight device having a weight retainer which receives one or more weight rods. The weight rods are selectively and removably retained within the weight retainer. A platform receives the weight device and carries one or more weight rods not selected and retained within the weight retainer. A software application is provided in communication with the platform or weight device and configured to drive selection and retention of the number of weight rods retained within the weight retainer. A database of selectable workout segments is also provided, wherein the software application selects and executes a selectable workout segment from the database of selectable workout segments simultaneously with the selection of one or more weight rods which are retained by the weight device.

The weight device disclosed herein provides an improved fitness experience by automatically adjusting the amount of weight throughout the workout, but also allows a user to manually adjust the amount of weight. It does this through the use of an integrated phone app and an engagable platform which holds one or more weight rods. To use the system, the user first enters basic information into the app (age, weight, gender, fitness ability, fitness goals), then prior to a workout the user selects the difficulty, length, and type of workout. Once the workout begins, the app adjusts the amount of weight for each specific exercise based on the user preferences. Or, users can adjust the weights with a touch of a button, such as on the smartphone or tablet.

These and other features and advantages of devices, systems, and methods according to this invention are described in, or are apparent from, the following detailed descriptions of various examples of embodiments.

BRIEF DESCRIPTION OF DRAWINGS

Various examples of embodiments of the systems, devices, and methods according to this invention will be described in detail, with reference to the following figures, wherein.

Figure 1:
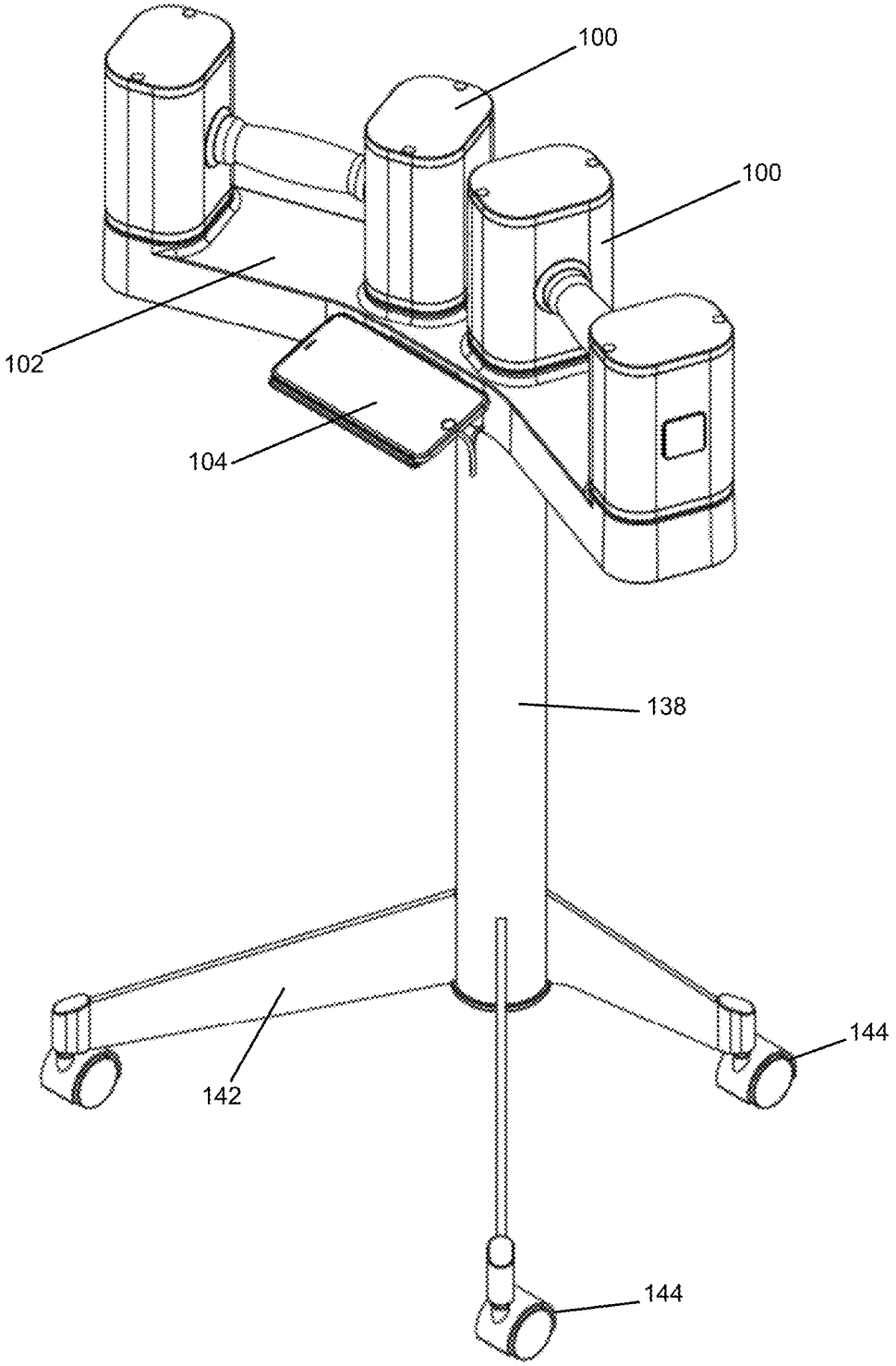
FIG. 1 is a perspective view of one or more examples of embodiments of an assembly having a weight device, platform, and portable electronic device as described herein positioned on a base stand.
Figure 2:
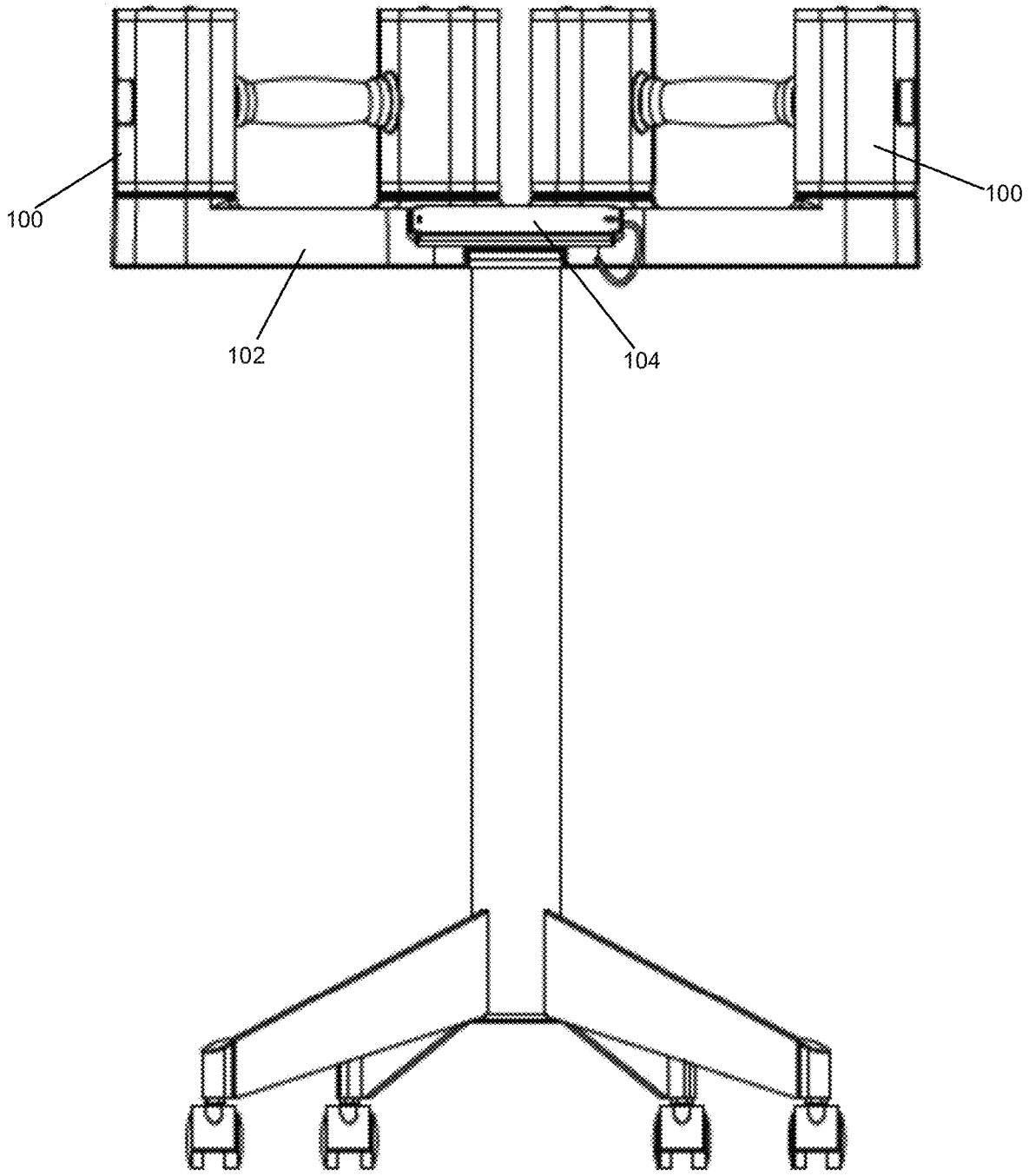
FIG. 2 is a front elevation view of the assembly shown in FIG. 1.
Figure 3:
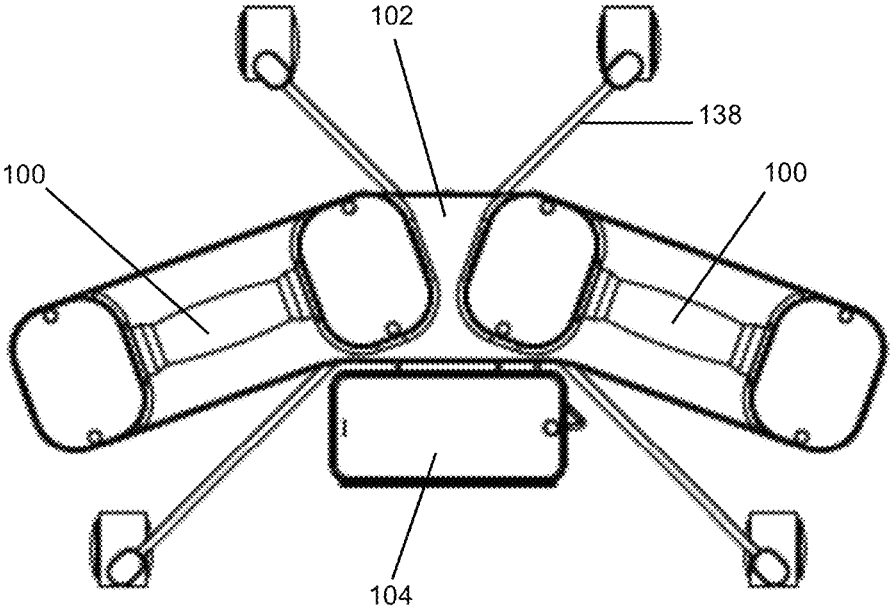
FIG. 3 is a top plan view of the assembly shown in FIG. 1.
Figure 4:
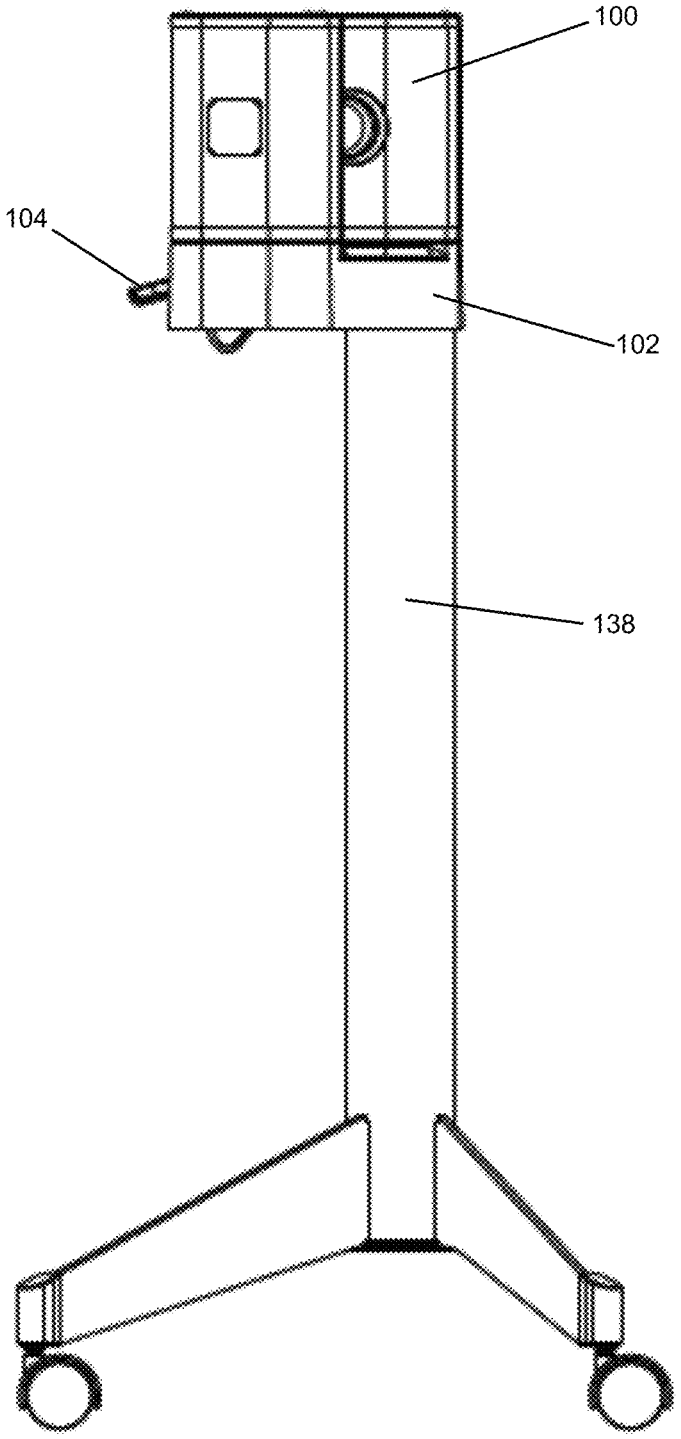
FIG. 4 is a side elevation view of the assembly shown in FIG. 1.
Figure 5:
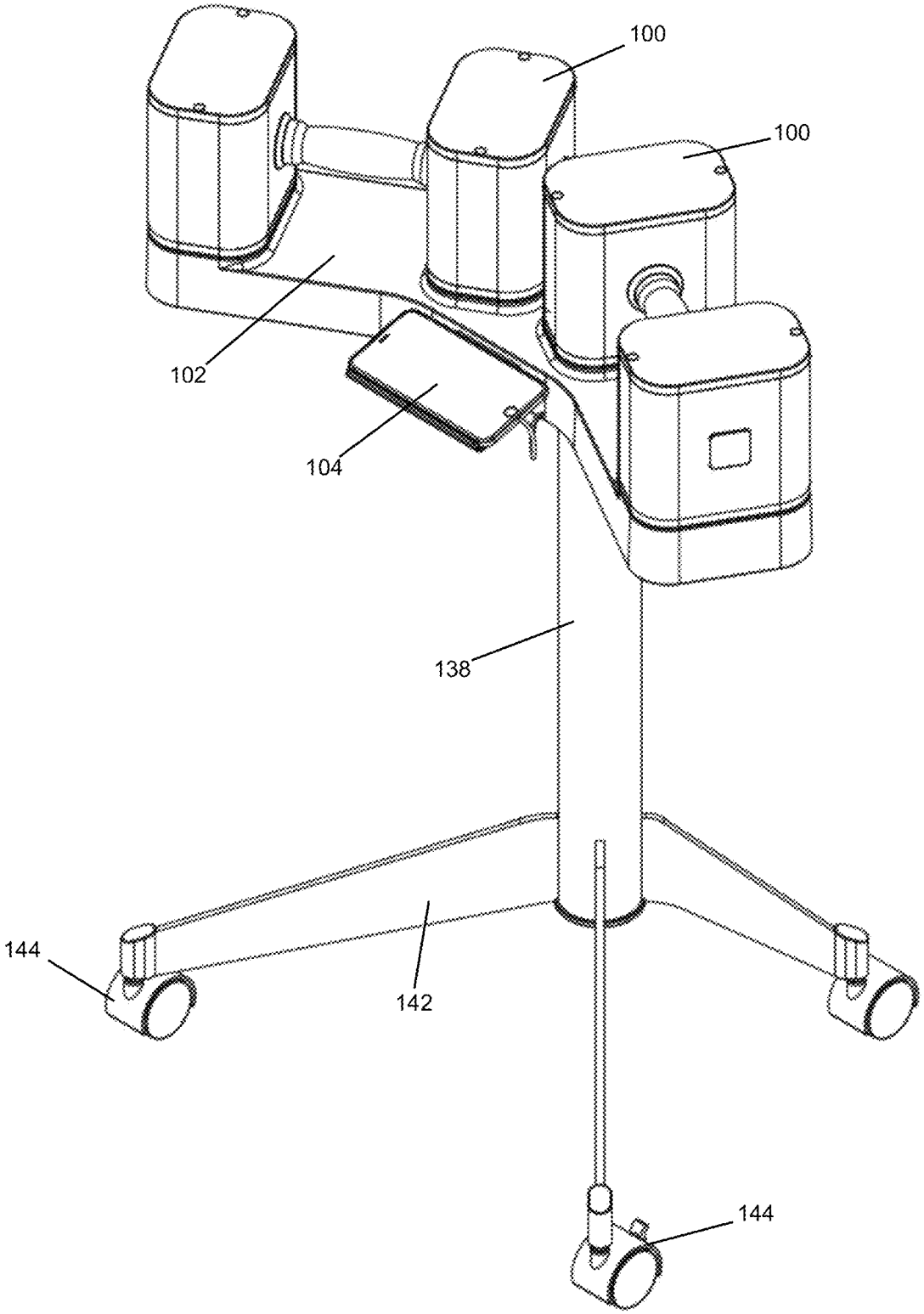
FIG. 5 is a perspective view of one or more examples of embodiments of an assembly having a weight device, platform, and portable electronic device as described herein positioned on a base stand, showing a weight device having an alternative size and/or weight.
Figure 6:
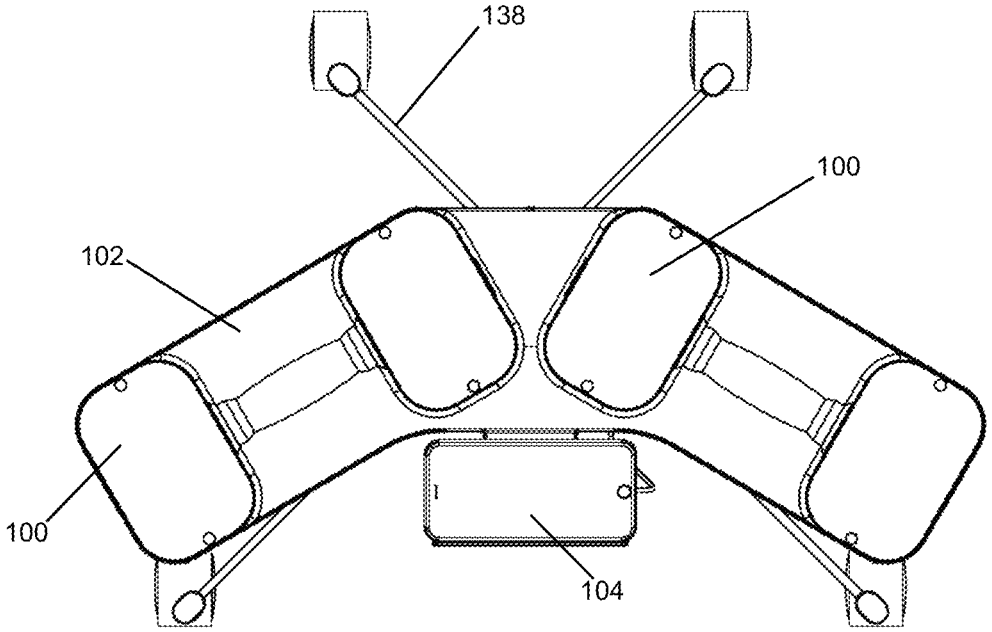
FIG. 6 is a top plan view of the assembly shown in FIG. 5.
Figure 7A:
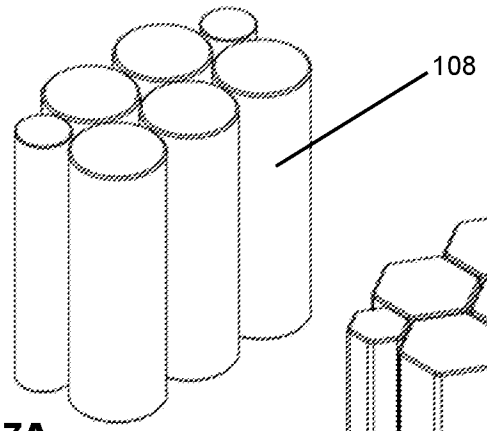
FIG. 7A is a perspective view of weight rods according to one or more examples of embodiments for use with the weight device described herein, showing cylindrical weight rods.
Figure 7B:
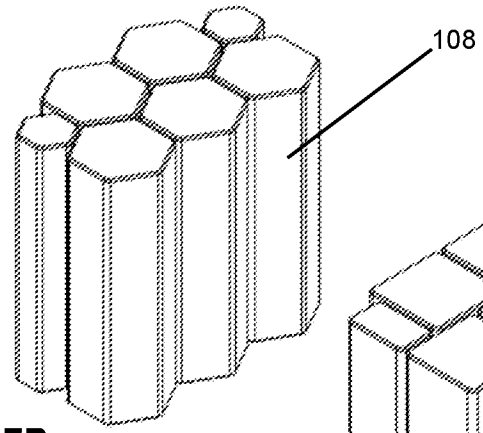
FIG. 7B is a perspective view of weight rods according to one or more examples of embodiments for use with the weight device described herein, showing hexagonal weight rods.
Figure 7C:
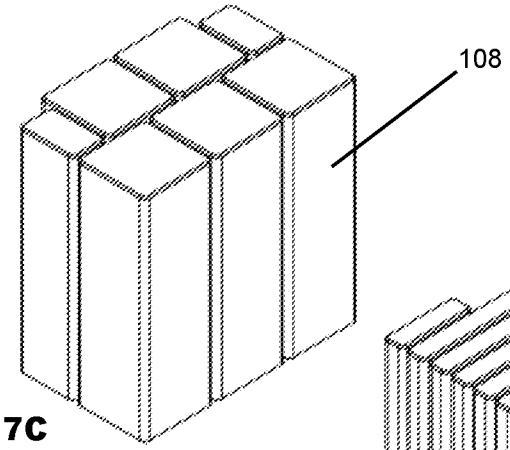
FIG. 7C is a perspective view of weight rods according to one or more examples of embodiments for use with the weight device described herein, showing rectangular weight rods.
Figure 7D:
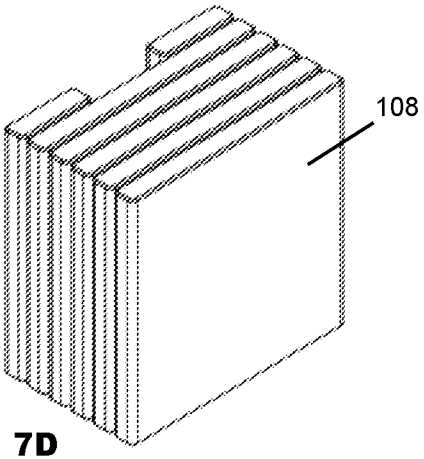
FIG. 7D is a perspective view of weight rods according to one or more examples of embodiments for use with the weight device described herein, showing plate-shaped weight rods.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION

Referring generally to the Figures, an auto-adjustable weight device, system, and method are disclosed. A weight device, system, and method are disclosed that leverage the functionality or take advantage of the potential and versatility of the weight device during exercise or physical fitness routine and further let the user focus on exercise rather than changing weight. As disclosed in greater detail below, an auto-adjustable weight device is provided that is combined with a software application executed by a portable electronic device. In addition unlike existing "selectorized" dumbbells and functional trainers, there are no knobs to turn or pins to adjust on the novel weight device disclosed herein. The weight adjustment may happen through the integrated app, and mechanism discussed below. Strength training of any type requires a higher degree of understanding than cardio workouts. For strength training, many if not most users don't understand which movements are helpful vs. which can lead to injury. Also, knowing how hard to push and how to arrange the different exercises is not clear to many users. In contrast, the weight system disclosed herein can figure everything out for the user: pace, difficulty, weight, length, type of workout. This can make the workout more engaging. The app also allows people to connect from home; either with an instructor at the gym, or a group of users, all connected from their homes, or with a physical trainer or physical therapist. By making the fitness experience easier to figure out, and more connected to a fitness community, the user is more likely to stay engaged. These and other features and advantages of devices, systems, and methods according to this invention may be described in, or are apparent from, the following description.

In particular, an exercise or physical fitness system is disclosed which includes an auto-adjustable weight device with an integrated software application, and customizable video workouts shown in a smartphone or other portable electronic device screen. More specifically, the auto-adjustable weight system includes a weight device as described and a platform carrying one or more weight rods and which interacts with said weight device. In one or more examples of embodiments, the software application automatically adjusts the weights so as to change the amount of weight for each exercise. Alternatively, a user may "manually" adjust the weights via a touch of a button on the smart device screen. Advantageously, there are no buttons or knobs on the weight device(s) itself.

In one or more examples of embodiments, as shown in FIGS. 1-5, the system consists of one or more, and in the illustrated examples two weight devices 100 (illustrated as dumbbells in several of the Figures), a platform 102 for support of and interaction with the weight device(s) 100, and an app or software application driven by an electronic device or portable electronic device 104 to operate the adjustment of the weight device(s) 100. It is noted that dumbbells are disclosed for purposes of illustration and example only, and one of skill in the art will appreciate that the principles of the invention can be adapted to a number of different weight or exercise devices. Furthermore, while two weight devices 100 are described and shown in various embodiments, it is contemplated that less than or more than two weight devices 100 may be used with the system described herein. Likewise, while a software application executed on a portable electronic device 104 is specifically described to operate the adjustment of the weight device(s) 100, the adjustment and operation may be done without a software application or portable electronic device 104.

Referring to FIGS. 8-17, 26, each weight device 100 is provided with a weight retainer 106 that either retains or disengages one or more, or a series of weight rods 108. In one example, the weight rods 108 are composed of metal but one of skill in the art will appreciate that any number of materials or combinations of materials may be used for a weight rod. The weight rods 108 may be made from any suitable weighted material, examples of which include steel or cast iron. For instance, in one example of embodiments steel rods may be used; alternatives, however, could include sheet metal plates or a heavier casing made from cast metal, and the like. One of skill in the art would appreciate that alternative materials or combinations of materials accomplishing the same purposes may be substituted for those noted herein.

Any range of shapes may be used for the weight rods 108; e.g., they could be any geometric configuration, including but not limited to, rectangular steel plates, hexagon rods, or cylindrical rods as shown, and combinations of the foregoing (see, e.g., FIGS. 7(*a*)-(*d*)). In other words, a "rod" is not necessary for achieving the purposes provided, but instead a weight member may be provided having a specific poundage may be used with a correspondingly shaped retainer, and retained by the same or a similar rotating tab. The number of pounds of each weight rod may also vary. For example, a series of 1 pound (lb) weights 108*a* and 3 lb weights 108*b* housed within each weight retainer 106 may be provided. This particular arrangement enables the user to adjust the amount of weight in 2 lb increments. The same overall design could instead support adjusting in 1 lb, 2.5 lb, or other increments if the weight modules or rods 108 were adjusted accordingly. It is understood that any number of pounds per weight rod 108 may be suitable for the purposes provided. Likewise, while weights are described in pounds, metric units and increments are also acceptable. Of course, the weight retainers 106 may also be used without any weight rods.

In one or more examples of embodiments, The weight retainers 106 may be a weight casing and can be made from injection-molded structural plastic (such as glass-filled nylon), cast or extruded aluminum, or cast steel. In the attached illustrations, the weight retainers 106 are made from a combination of structural plastic and extruded aluminum. The weight retainers 106 retain one or more, and in preferred examples of embodiments, a series of weight rods 108 combined in any number of combinations to achieve a desired total weight. In this regard, while a weight casing is illustrated in the Figures, a weight retainer may also be a skeletal structure in which weight rods are retained, but not enclosed, or partially enclosed. Each weight retainer 106 is composed of one or more receptors 110 and in the illustrated examples a plurality of receptors which are configured to mate with the weight rods 108 and receive them within the retainer. In this regard, various shape and/or sized weight receptors 110 (e.g., 110*a*, 110*b*) may be provided with sizes that correspond in size and position to the corresponding weight rod 108*a* or 108*b*. In the examples provided, the receptors 110 have a depth such that the weight rods 108 are retained entirely within the retainer 106, although such a configuration is not required as one of skill in the art could conceive of a configuration which engages and grips only a portion of a weight rod.

As shown in FIGS. 8-17, the weight rods 108 are retained in designated locations on a platform 102. These locations are aligned with corresponding receptor 110 positions in the weight retainer 106. The weight device 100 rests on the platform 102, such that the weight retainers 106 are positioned over the weight rods 108, which are received within the weight retainers 106.

Figure 8A:
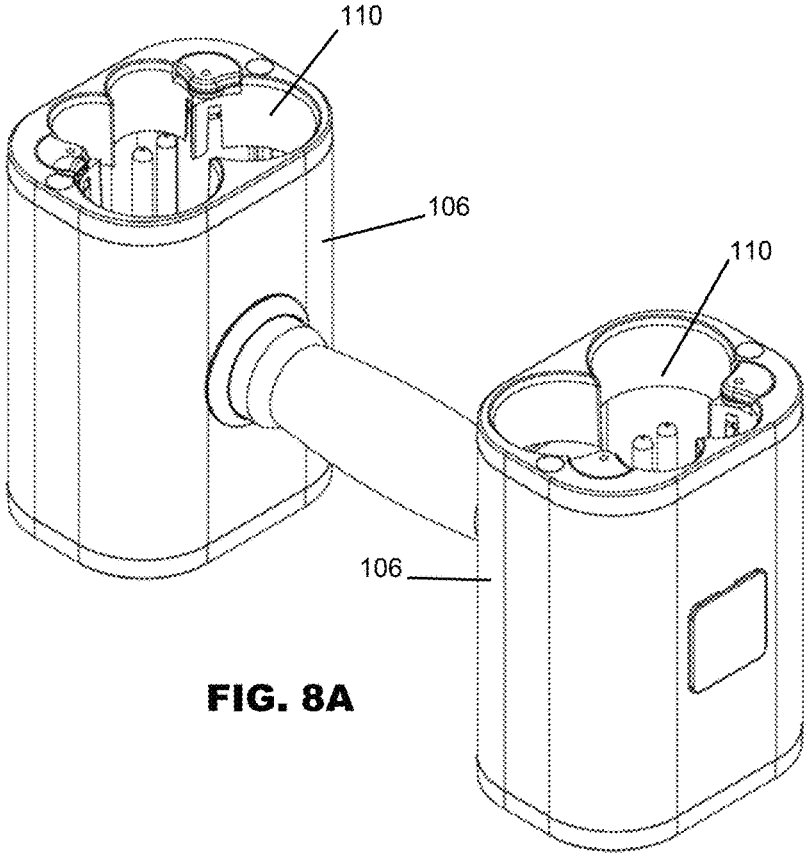
FIG. 8A is a perspective view of a single weight device for use with a platform, showing the weight device inverted, the weight device having a first weight or base weight.
Figure 8B:
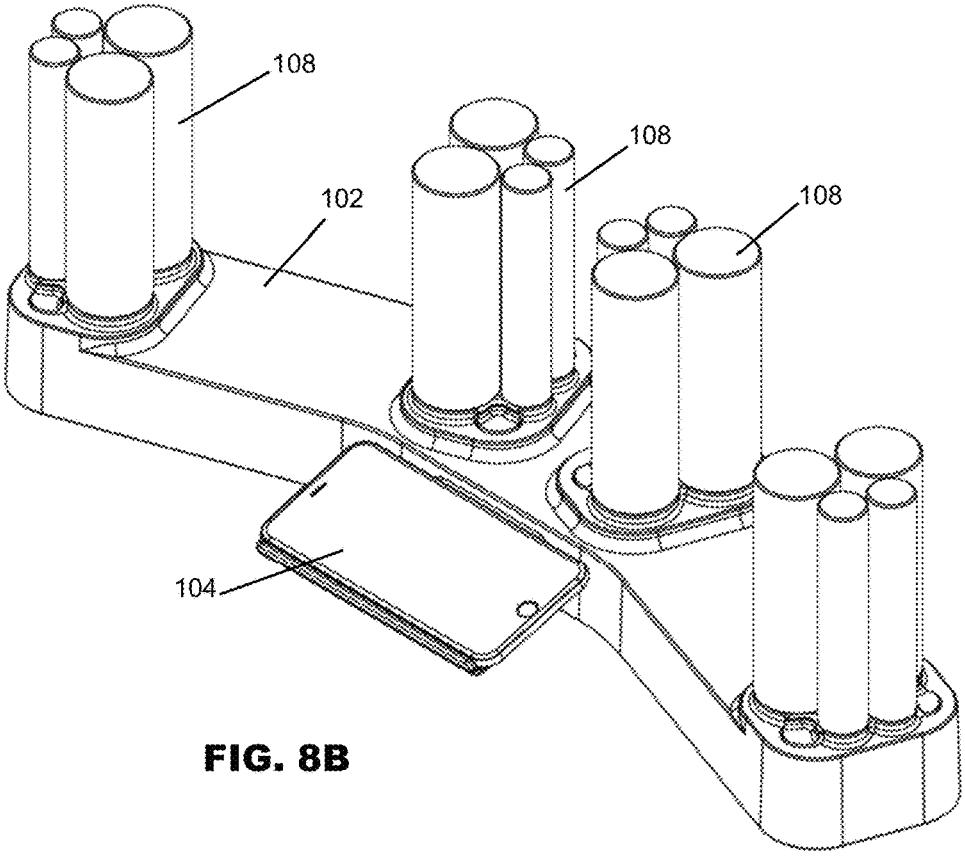
FIG. 8B is a perspective view of a platform and weight rods for use with the weight device of FIG. 8A.
Figure 9A:
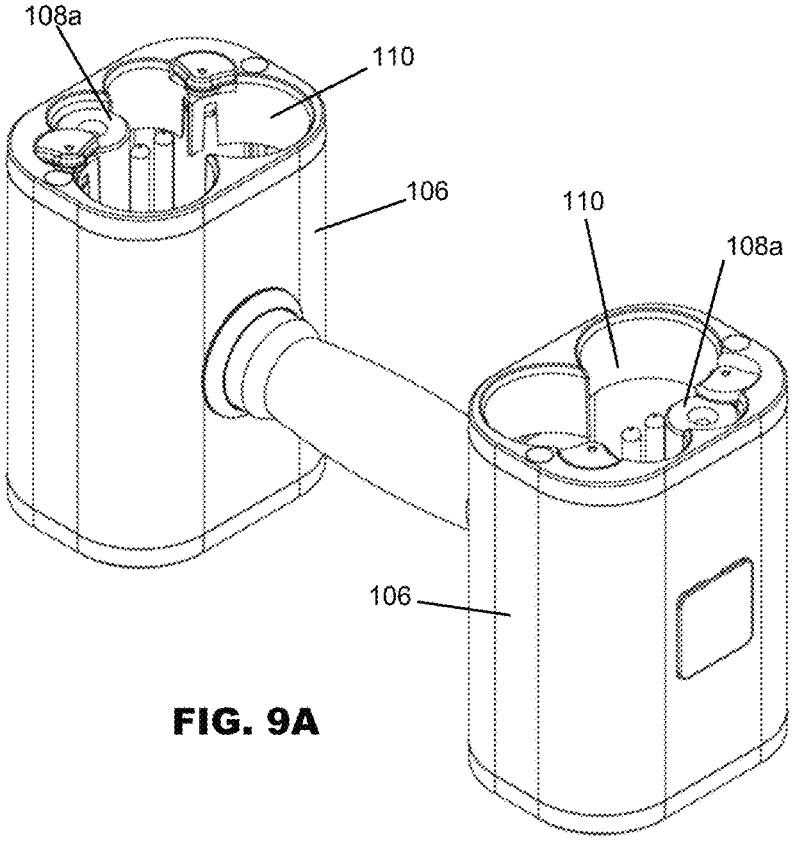
FIG. 9A is an additional perspective view of a single weight device for use with a platform, showing the weight device inverted, the weight device having a second weight.
Figure 9B:
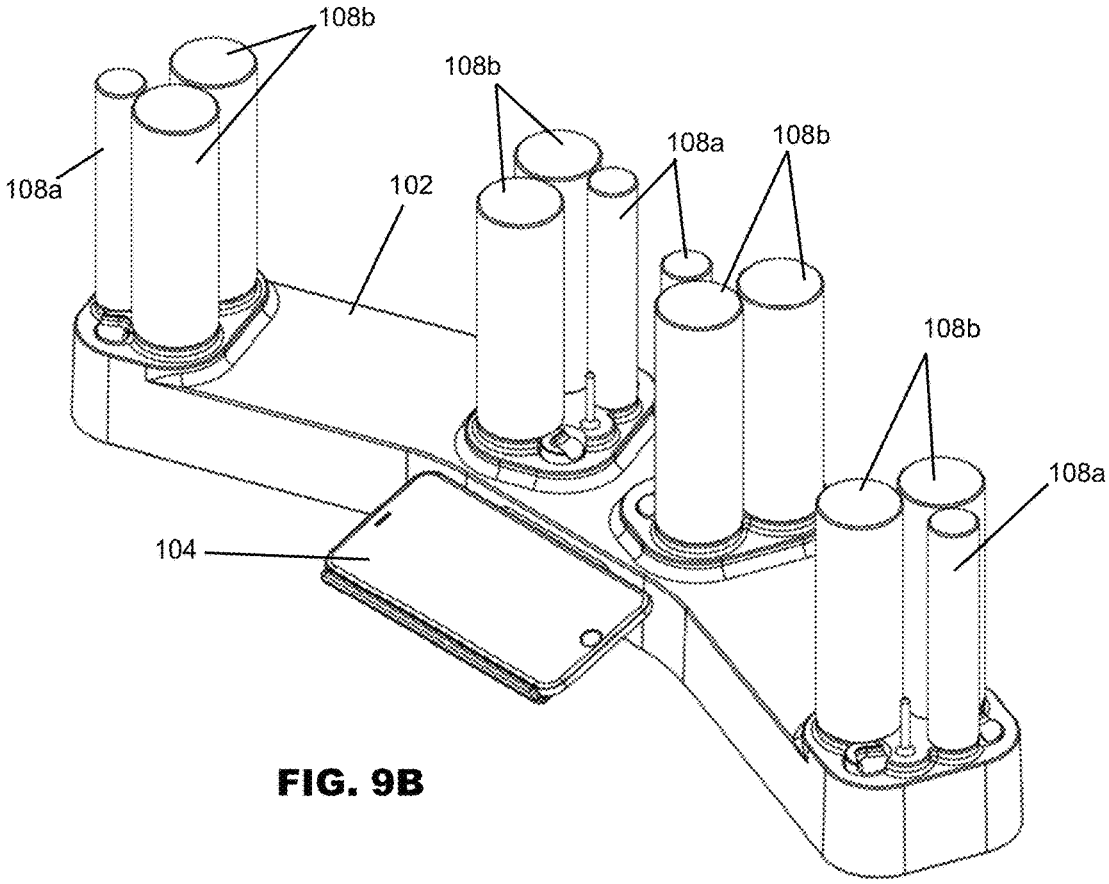
FIG. 9B is a perspective view of a platform and weight rods for use with the weight device of FIG. 9A.
Figure 10A:
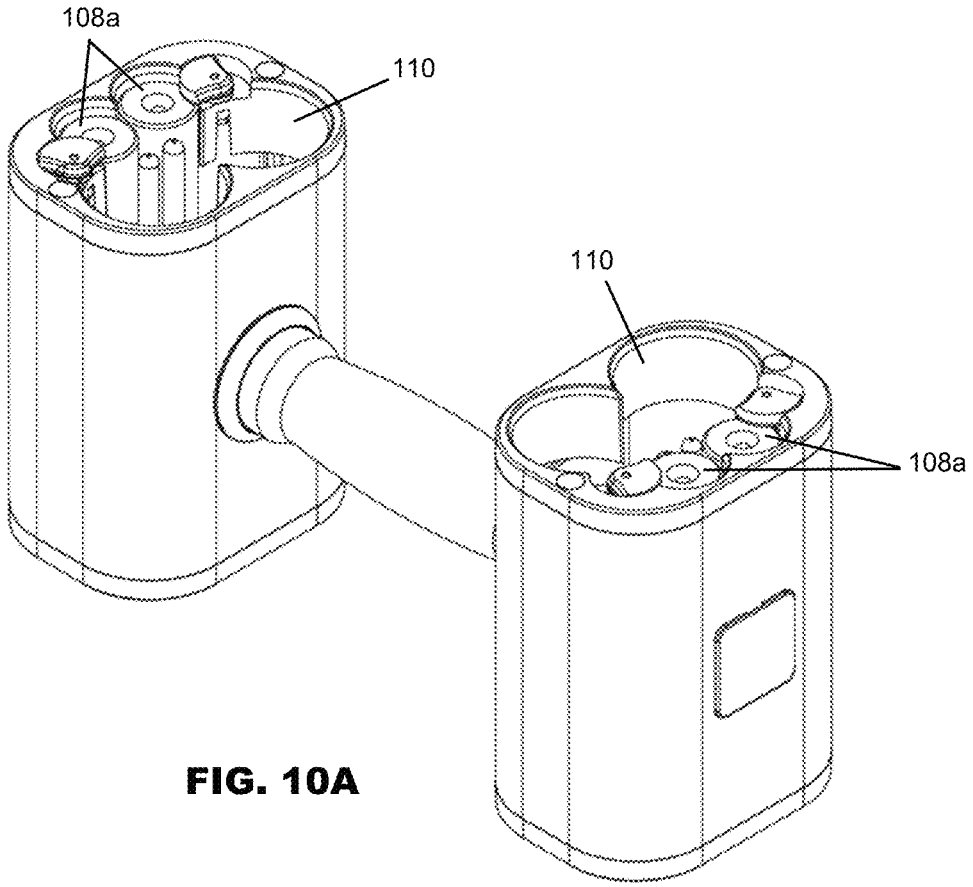
FIG. 10A is an additional perspective view of a single weight device for use with a platform, showing the weight device inverted, the weight device having a third weight.
Figure 10B:
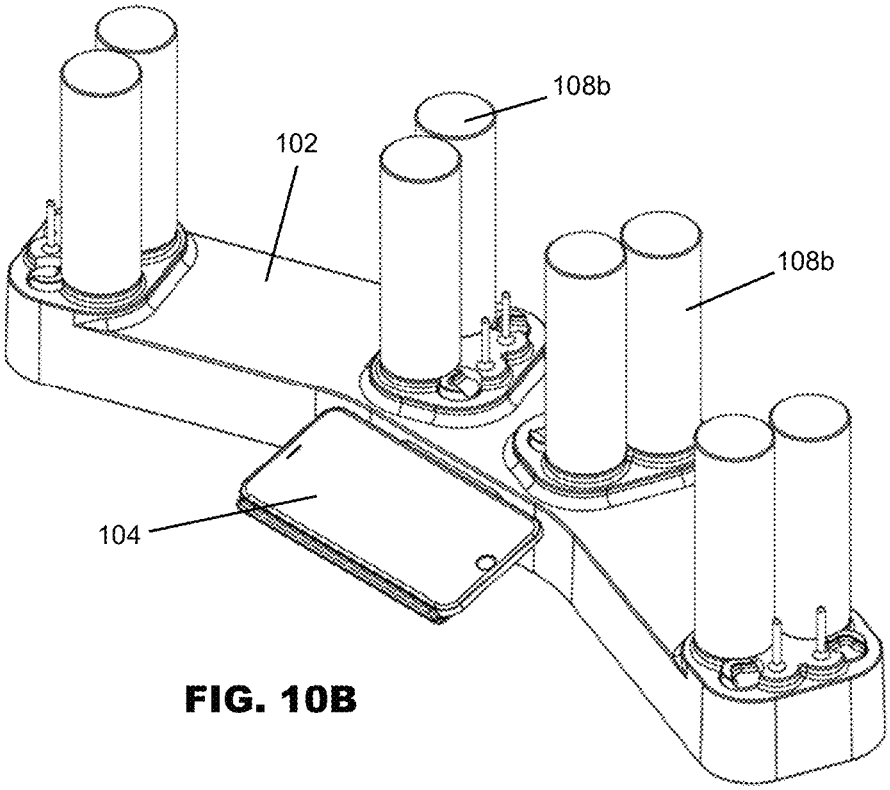
FIG. 10B is a perspective view of a platform and weight rods for use with the weight device of FIG. 10A.
Figure 11A:
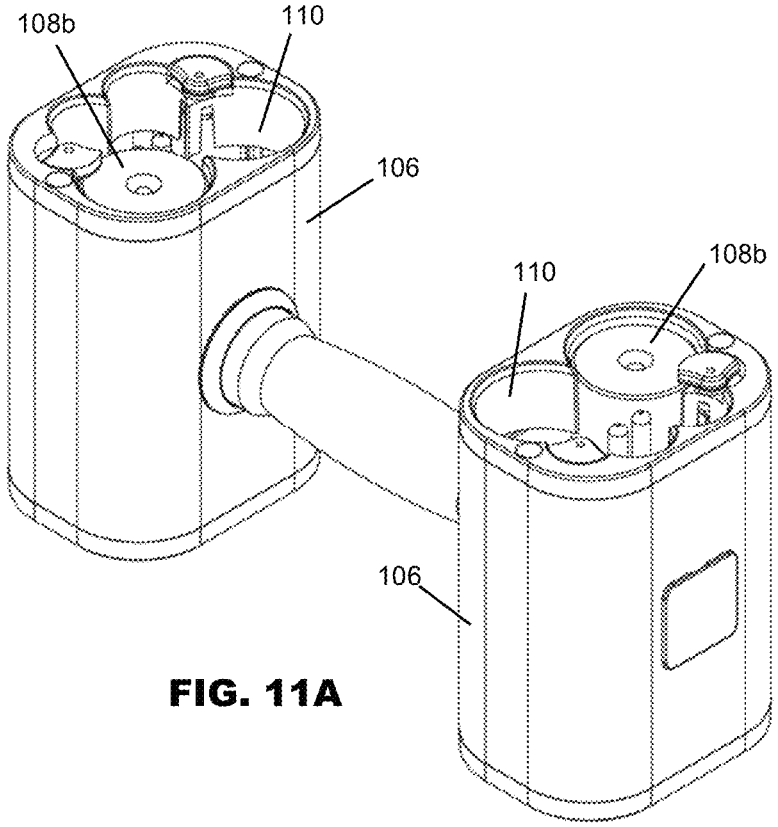
FIG. 11A is an additional perspective view of a single weight device for use with a platform, showing the weight device inverted, the weight device having a fourth weight.
Figure 11B:
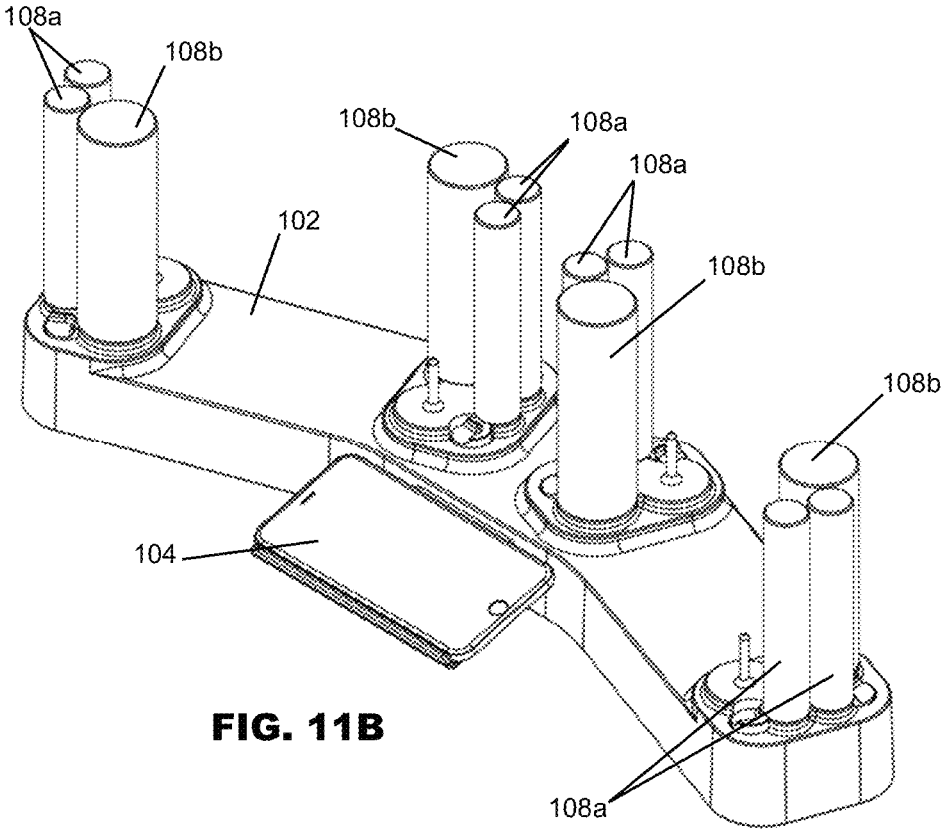
FIG. 11B is a perspective view of a platform and weight rods for use with the weight device of FIG. 11A.
Figure 12A:
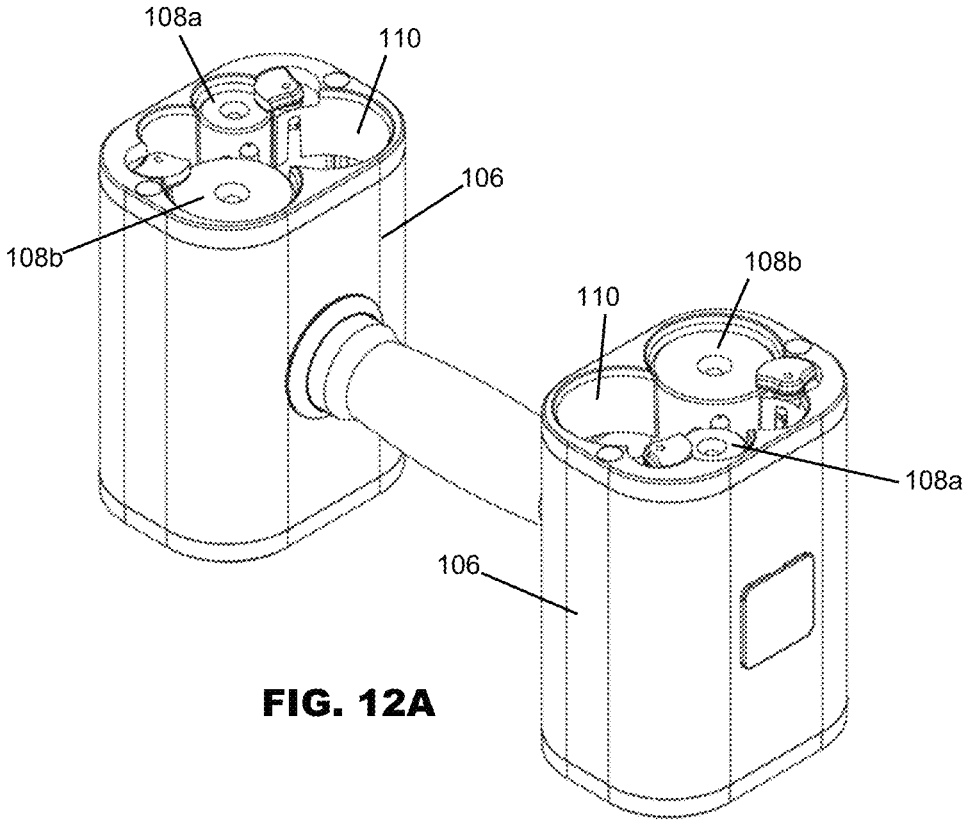
FIG. 12A is an additional perspective view of a single weight device for use with a platform, showing the weight device inverted, the weight device having a fifth weight.
Figure 12B:
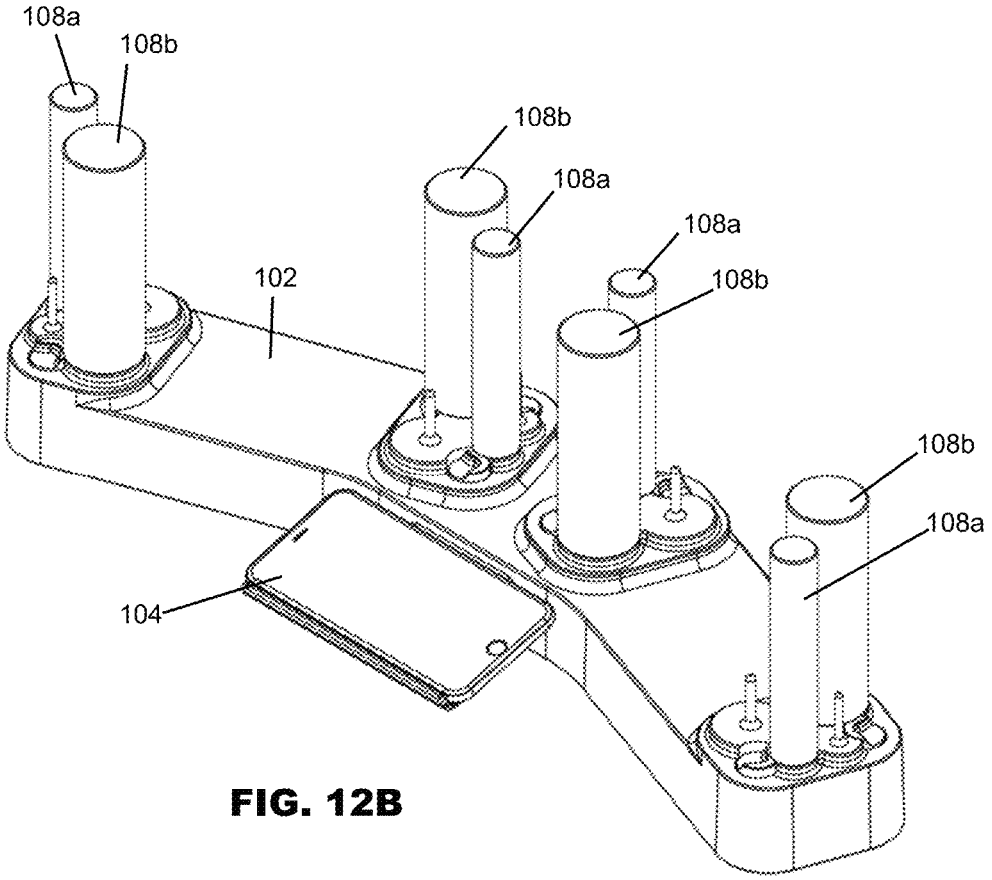
FIG. 12B is a perspective view of a platform and weight rods for use with the weight device of FIG. 12A.
Figure 13A:
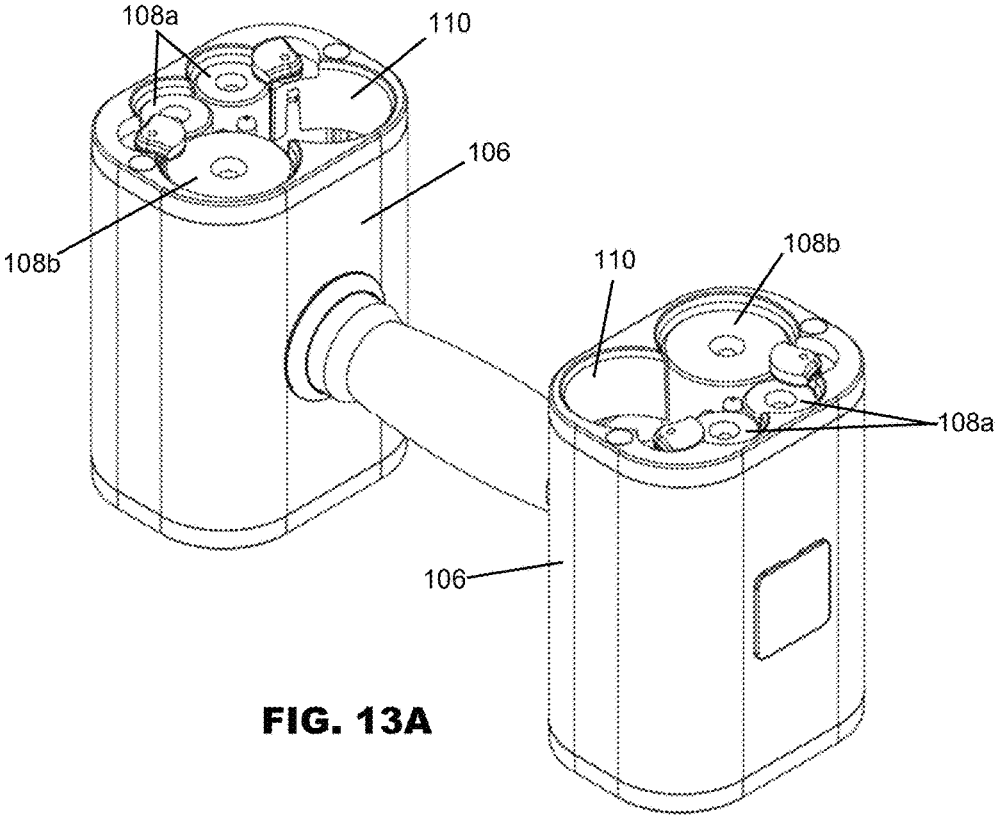
FIG. 13A is an additional perspective view of a single weight device for use with a platform, showing the weight device inverted, the weight device having a sixth weight.
Figure 13B:
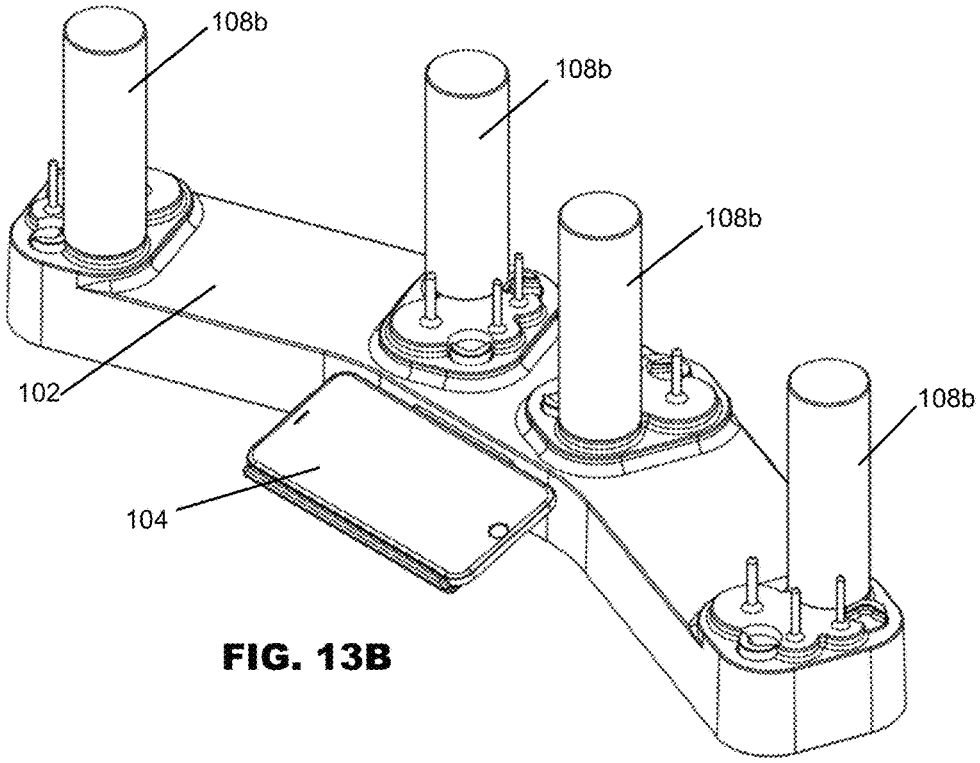
FIG. 13B is a perspective view of a platform and weight rods for use with the weight device of FIG. 13A.
Figure 14A:
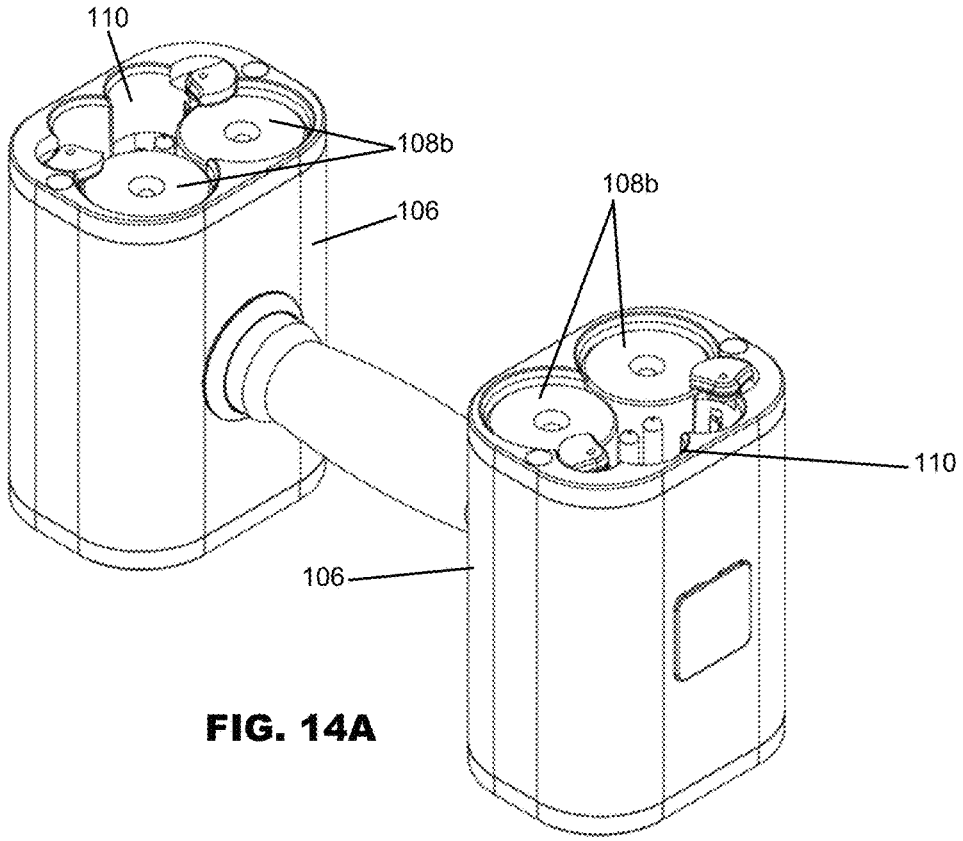
FIG. 14A is an additional perspective view of a single weight device for use with a platform, showing the weight device inverted, the weight device having a seventh weight.
Figure 14B:
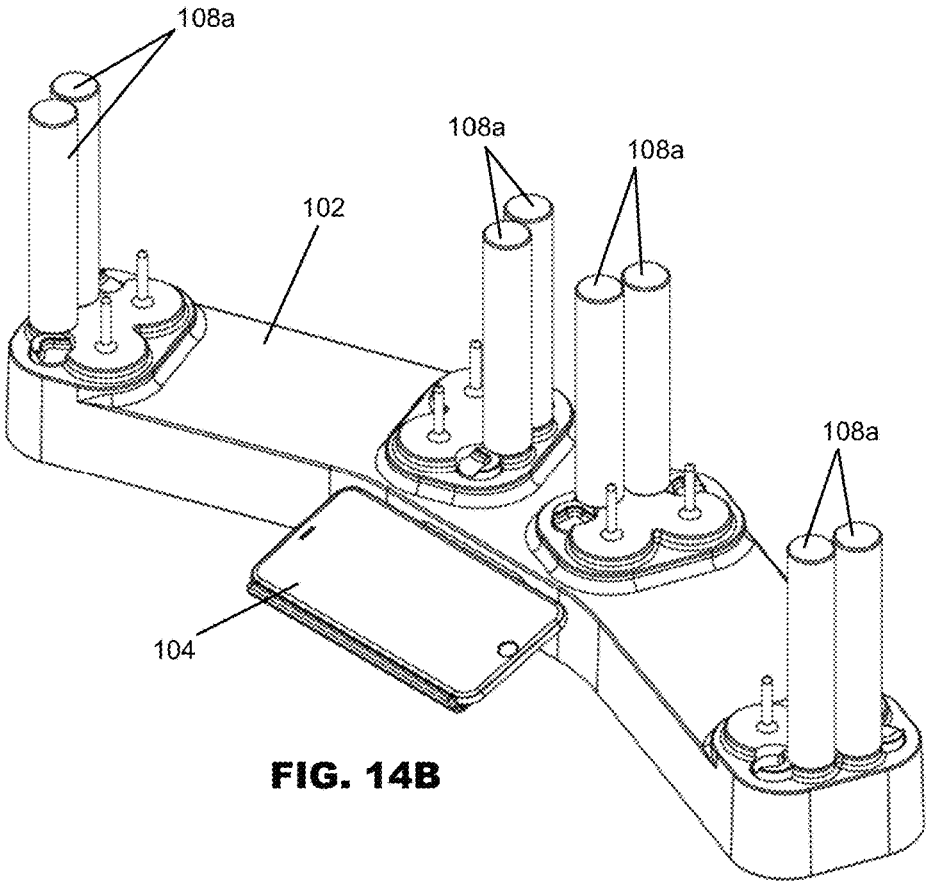
FIG. 14B is a perspective view of a platform and weight rods for use with the weight device of FIG. 14A.
Figure 15A:
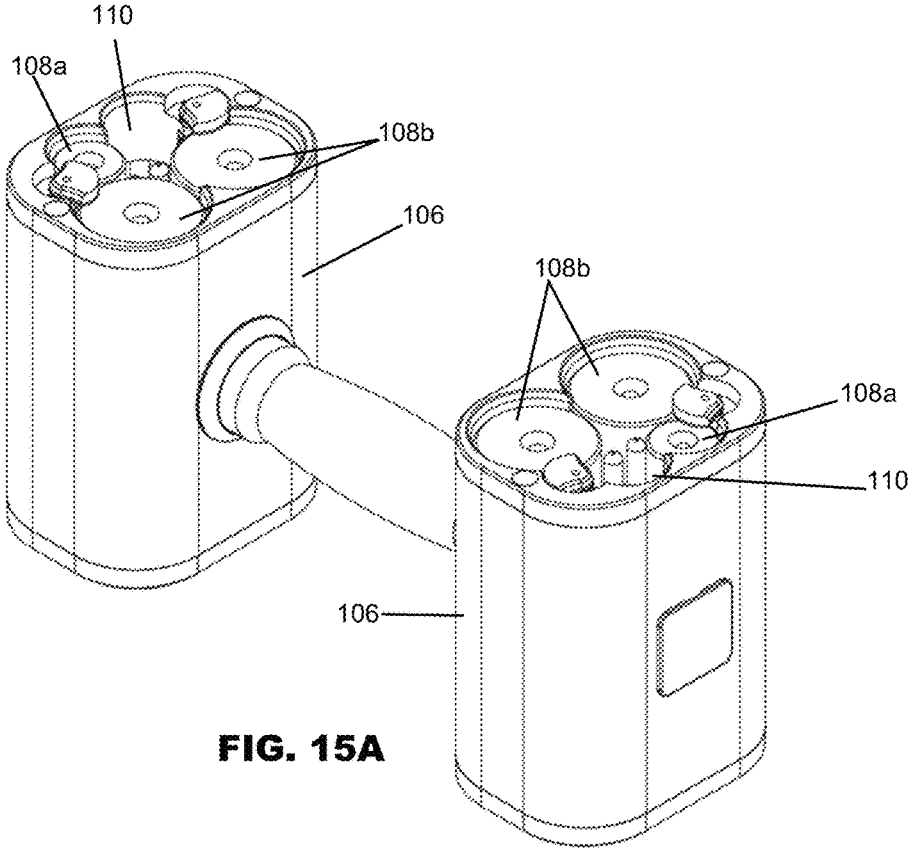
FIG. 15A is an additional perspective view of a single weight device for use with a platform, showing the weight device inverted, the weight device having an eighth weight.
Figure 15B:
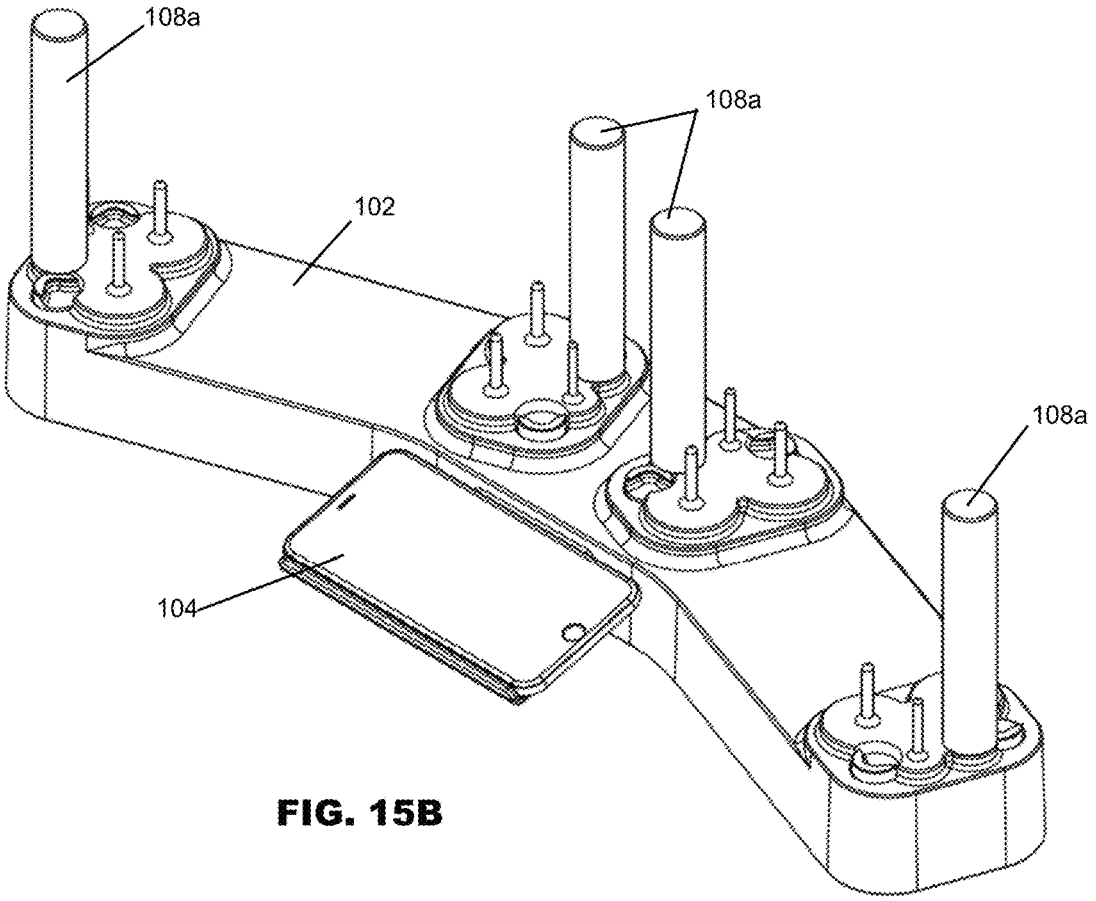
FIG. 15B is a perspective view of a platform and weight rods for use with the weight device of FIG. 15A.
Figure 16A:
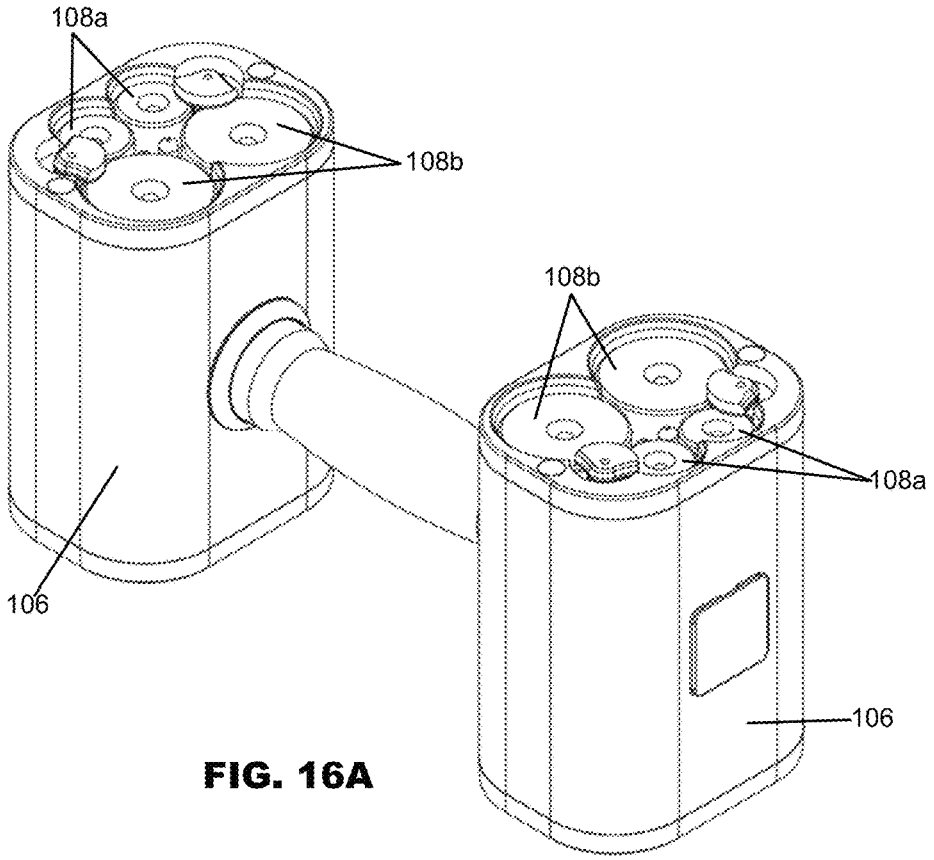
FIG. 16A is an additional perspective view of a single weight device for use with a platform, showing the weight device inverted, the weight device having a ninth weight.
Figure 16B:
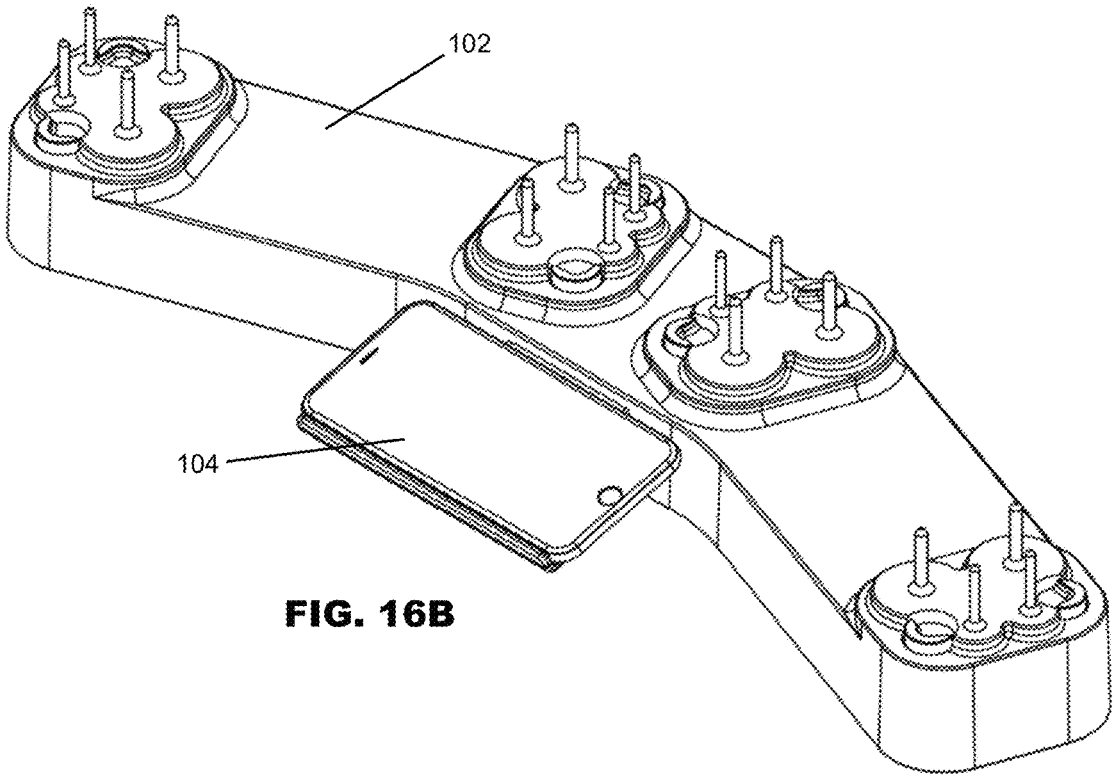
FIG. 16B is a perspective view of a platform and weight rods for use with the weight device of FIG. 16A.
Figure 17A:
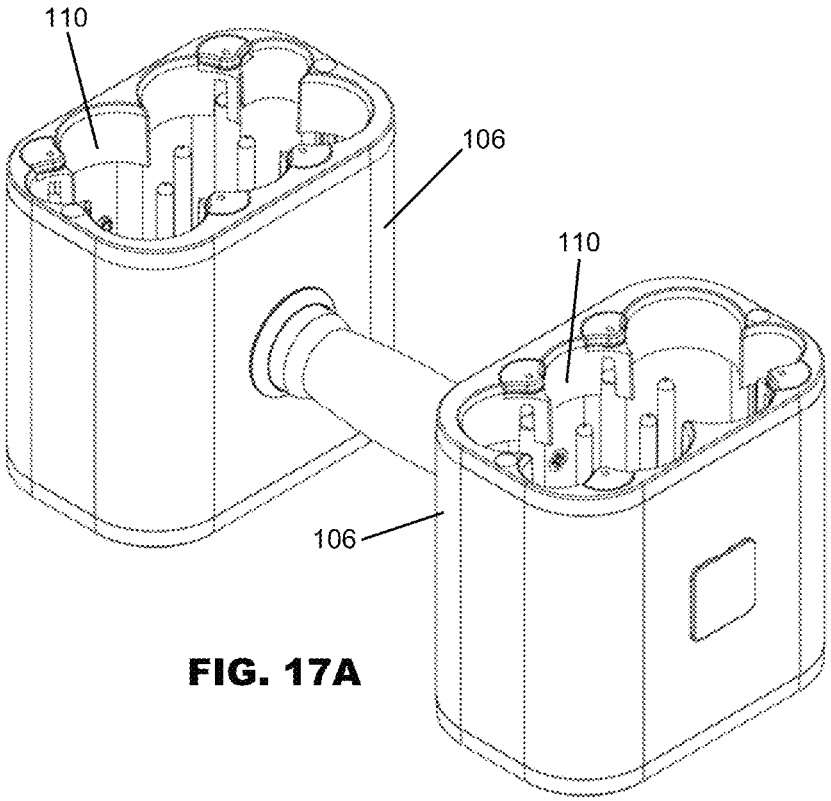
FIG. 17A is an alternative perspective view of a single weight device for use with a platform, showing the weight device inverted and separated from the platform, the weight device having a first weight or base weight.
Figure 17B:
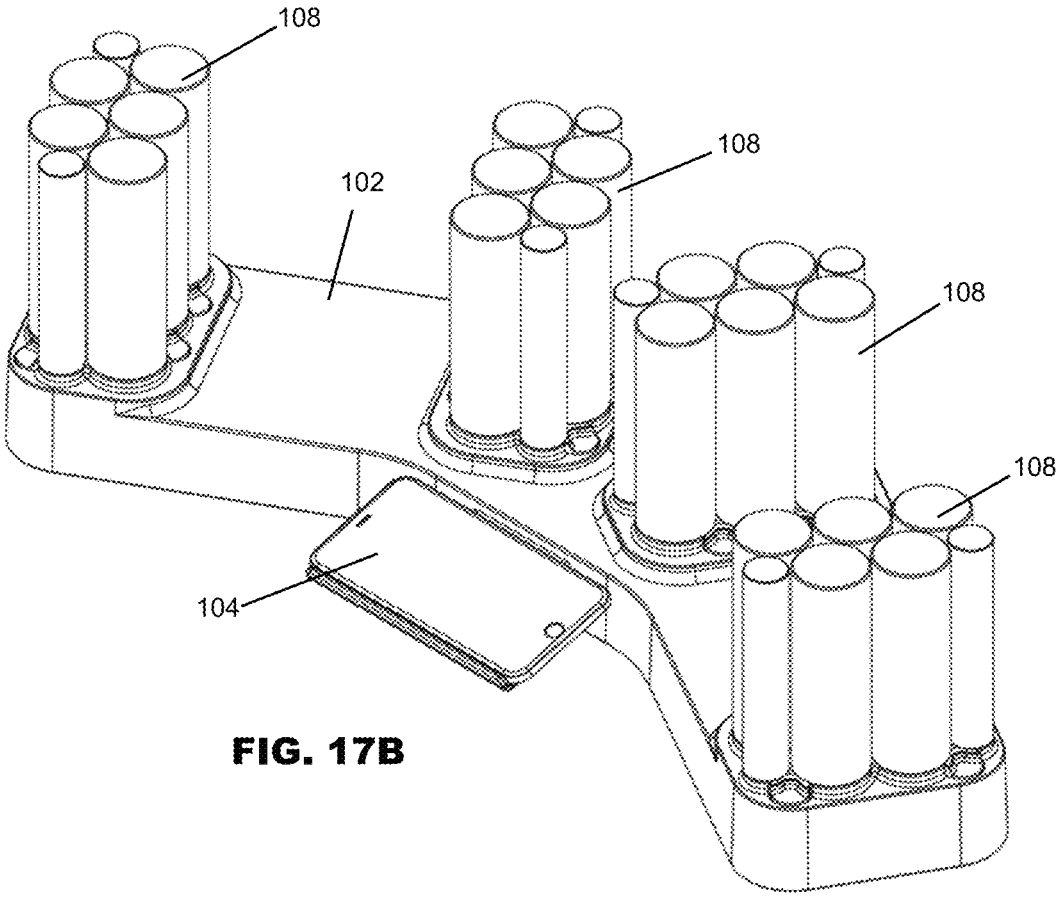
FIG. 17B is a perspective view of a platform and weight rods for use with the weight device of FIG. 17A.

Various weight rod 108 arrangements may be used. In the illustrated embodiments, nine different arrangements, from 4 lb to 20 lb are shown for purposes of example. In FIG. 8, an arrangement is shown in which no weights are provided in the weight retainer 106. This "base weight," in which no weight rods or removable weight rods 108 are provided in the weight device 100 or weight retainer(s) 106, may be calibrated to be the minimum weight of the weight device 100. For example, the minimum weight may be 4 lb. When in this configuration, all of the weight rods 108 remain on the platform 102. In FIG. 9, an arrangement of 2×1 lb weights is shown to achieve a desired total weight (including the weight device 100—base weight) which is different from that shown in FIG. 8. For example, the particular arrangement may be 6 lb. When in this configuration, one or more weight rods 108—in this case 2, 1 lb weight rods 108*a*—are retained in the weight device 100, and a remainder of the weight rods 108 remains on the platform 102. In FIG. 10, an arrangement of 4×1 lb weights is shown to achieve a desired total weight (including the weight device 100—base weight) which is different from that shown in FIGS. 8-9. For example, the particular arrangement may be 8 lb. When in this configuration, one or more weight rods 108—in this case 4, 1 lb. weight rods 108*a*—are retained in the weight device 100, and a remainder of the weight rods 108 remains on the platform 102. In FIG. 11, an arrangement of 2×3 lb weights is shown to achieve a desired total weight (including the weight device 100—base weight) which is different from that shown in FIGS. 8-10. For example, the particular arrangement may be 10 lb. When in this configuration, one or more weight rods 108—in this case 2, 3 lb weight rods 108*b*—are retained in the weight device 100, and a remainder of the weight rods 108 remains on the platform 102. In FIG. 12, an arrangement of 2×3 lb+2×1 lb weights is shown to achieve a desired total weight (including the weight device 100—base weight) which is different from that shown in FIGS. 8-11. For example, the particular arrangement may be 12 lb. When in this configuration, one or more weight rods 108—in this case 2, 3 lb weight rods 108*b*, plus 2, 1 lb weight rods 108*a*—are retained in the weight device 100, and a remainder of the weight rods 108 remains on the platform 102. In FIG. 13, an arrangement of 2×3 lb+4×1 lb weights is shown to achieve a desired total weight (including the weight device 100—base weight) which is different from that shown in FIGS. 8-12. For example, the particular arrangement may be 14 lb. When in this configuration, one or more weight rods 108—in this case 2, 3 lb weight rods 108*b*, plus 4, 1 lb weight rods 108*a*—are retained in the weight device 100, and a remainder of the weight rods 108 remains on the platform 102. In FIG. 14, an arrangement of 4×3 lb weights is shown to achieve a desired total weight (including the weight device 100—base weight) which is different from that shown in FIGS. 8-13. For example, the particular arrangement may be 16 lb. When in this configuration, one or more weight rods 108—in this case 4, 3 lb weight rods 108*b*—are retained in the weight device 100, and a remainder of the weight rods 108 remains on the platform 102. In FIG. 15, an arrangement of 4×3 lb+2×1 lb weights is shown to achieve a desired total weight (including the weight device 100—base weight) which is different from that shown in FIGS. 8-14. For example, the particular arrangement may be 18 lb. When in this configuration, one or more weight rods 108—in this case 4, 3 lb weight rods 108*b*, plus 2, 1 lb weight rods 108*a*—are retained in the weight device 100, and a remainder of the weight rods 108 remains on the platform 102. In FIG. 16, an arrangement of 4×3 lb+4×1 lb weights is shown to achieve a desired total weight (including the weight device 100—base weight) which is different from that shown in FIGS. 8-15. For example, the particular arrangement may be 20 lb. When in this configuration, one or more weight rods 108—in this case 4, 3 lb weight rods 108*b*, plus 4, 1 lb weight rods 108*a*—are retained in the weight device 100, and no weight rods remain on the platform 102.

Similar arrangements and configurations can be combined in a similar manner to achieve different base and ending weights, by varying the base weight (e.g., the weight of the device 100 or retainer 106 without any weight rods may be 6 lb vs. 4 lb), and varying the number of available weight rods 108 which may be engaged by the weight device 100. Compare examples of such varying arrangements and configurations shown in FIGS. 8, 17, 26 for purposes of illustration.

The same overall design could support a different range of minimum and maximum weights. For example, there could be a 3 lb to 15 lb weight device, a 5 lb to 50 lb weight device, an 8 lb to 80 lb weight device, and so forth. The minimum weight or base weight is determined by the weight of the of the weight device 100 unit (i.e., handle 118 plus weight retainers 106) without any weight rods retained in the retainers. In some examples of embodiments, to round out the weight of the "empty" weight devices 100, extra inner rod weights (not shown) may be permanently attached inside the weight retainers 106.

Weight rods 108 can be retained on a platform 102 in a variety of ways. In one example of embodiments shown in FIGS. 8-17, and specifically in reference to FIG. 18, the weight rods 108 are retained by a pin 112—which may extend vertically from the upper surface of the platform 102—protruding into the center of a weight rod. Consequently, a weight rod may have a pin receptor 113 in a bottom surface thereof for receipt of the pin 112 (see FIGS. 22-25). In an alternative embodiment, weight rods 108 may be supported by one or more spaced apart upwardly extending tabs 114, shown as vertical tabs in FIG. 19, positioned around the perimeter of the weight rod, or a plurality of weight rods 108.

Figure 20:
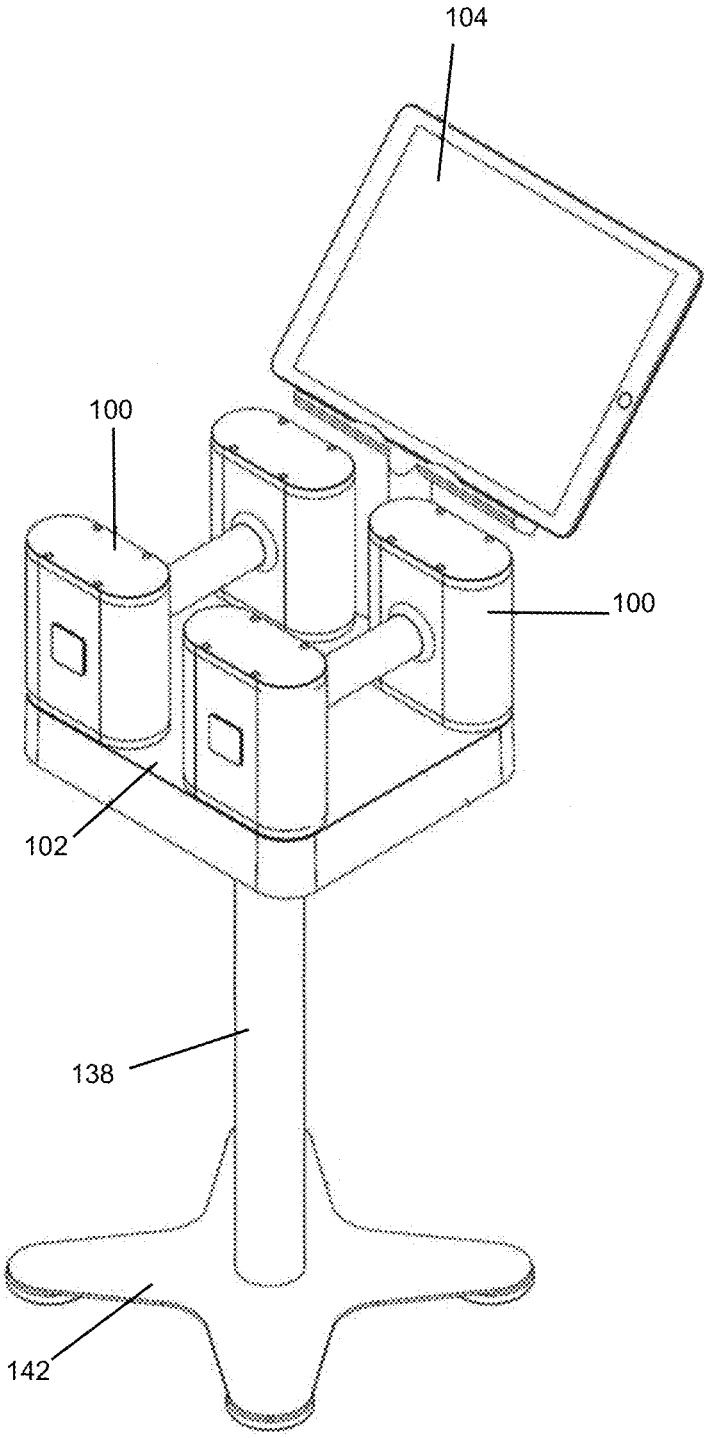
FIG. 20 is an alternative perspective view of an assembly having a weight device, platform, and portable electronic device on a base, showing the portable electronic device positioned above and behind the platform and weight devices.

In some examples of embodiments, the platform 102 may be oriented as shown in FIG. 1, in which a plurality of weight devices 100 are positioned at an angle from one another. In another example, the platform 102 may be positioned such that a plurality of weight devices 100 are positioned so as to be oriented side-by-side (FIG. 20).

In certain embodiments comprising a dumbbell or like device, each dumbbell consists of a generally cylindrical handle 118 with weight retainers 106 attached to each end. The handle 118 can be made from a variety of durable materials, such as for example steel rod.

Figure 21:
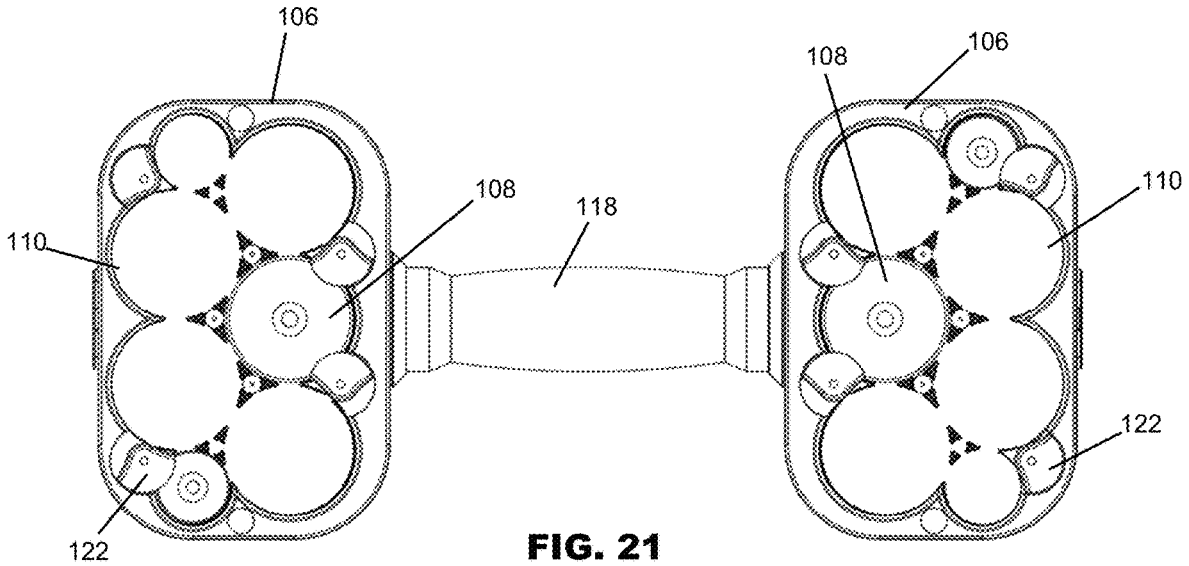
FIG. 21 is a bottom plan view of a weight device according to one or more examples of embodiments, showing the weight load balance of the weight device.
Figure 22:
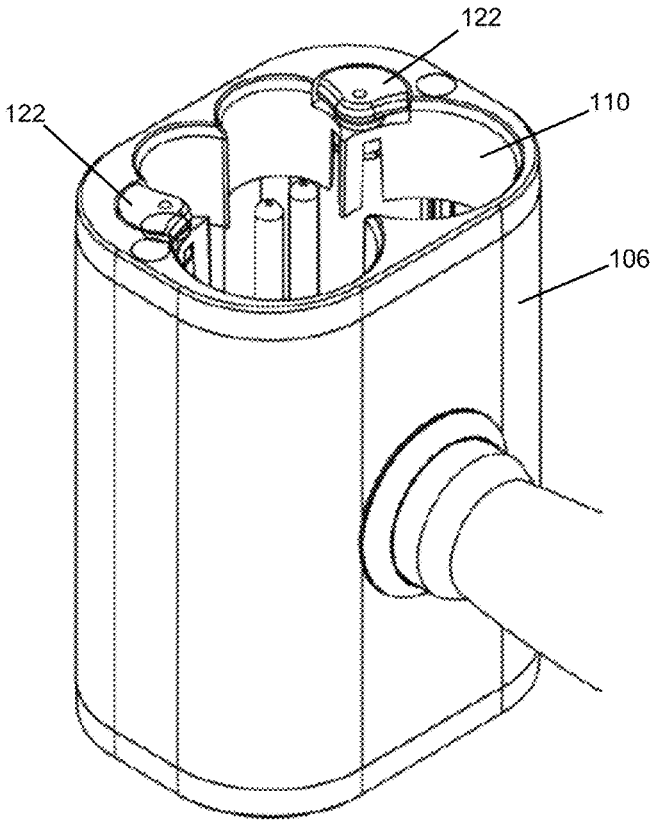
FIG. 22 is a partial perspective view of a weight device according to one or more examples of embodiments, showing one or more rotating tabs in a first, open position.

In one or more examples of embodiments, the weight configuration may be asymmetrical relative to the centerline "a" (see FIG. 21). However, due to the specific configuration of weight rods 108 in the retainer, the center of gravity of the weight device 100 remains in the center of the handle 118. As a result, if the user is holding the handle 118 in the middle, the weight device 100 will remain balanced. Likewise, even if the user were to hold the handle 118 off-centered, the asymmetry of the load would be so small that any torqueing of the handle 118 would be imperceptible.

In use, a desired weight is selected (either by the user or the software application) which, as will be further discussed herein, then either releases or engages one or more weight rods 108 which, in total, equal the selected weight. The weight rods 108 may be retained and released from the weight retainer 106 in a number of different ways. In various examples of embodiments, selection of a desired weight causes the rotation of one or more of the rotating disks 116, the rotation of which either releases or engages one or more weight rods 108 which, in total, equal the selected weight. In some examples, small electric motors 120 within the weight device platform 102 drive engagement with the weight rods 108. More specifically, in some examples of embodiments, a tab 122 which rotates about a vertical axis is shown. In this example, the tab 122 has four positions: Position 1 (open, holding no weight rods), Position 2 (holding one weight rod 108), Position 3 (holding two weight rods 108), and Position 4 (holding one weight rod 108) as shown in FIGS. 22-25. With each position, the tab 122 is rotated by 90 degrees. However, variations thereon may be acceptable for accomplishing the purposes provided. While specific examples are described hereinabove, alternatives may also be acceptable. For example, the retention system of rotating tabs 122 described herein can accommodate a variety of ways to cluster the weight rods 108. For instance, two 1 lb weights 108*a* can be positioned between two 3 lb weights 108*b*, retained by two rotating tabs 122—also achieving a flatter enclosure (see FIG. 26).

Figure 23:
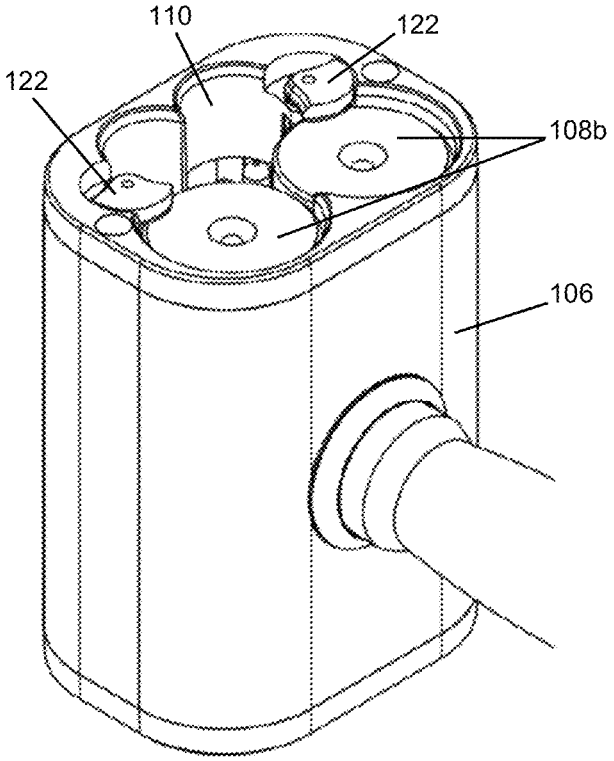
FIG. 23 is a partial perspective view of a weight device according to one or more examples of embodiments, showing one or more rotating tabs in a second position.
Figure 24:
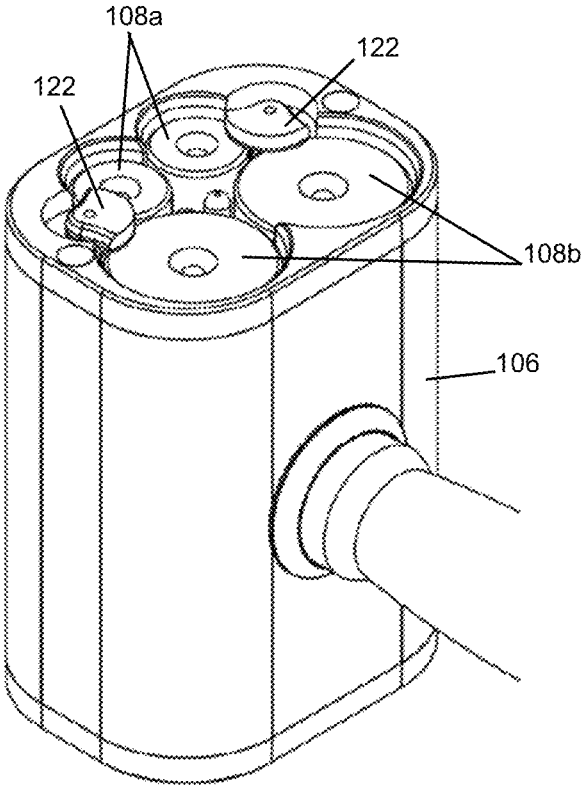
FIG. 24 is a partial perspective view of a weight device according to one or more examples of embodiments, showing one or more rotating tabs in a third position.
Figure 25:
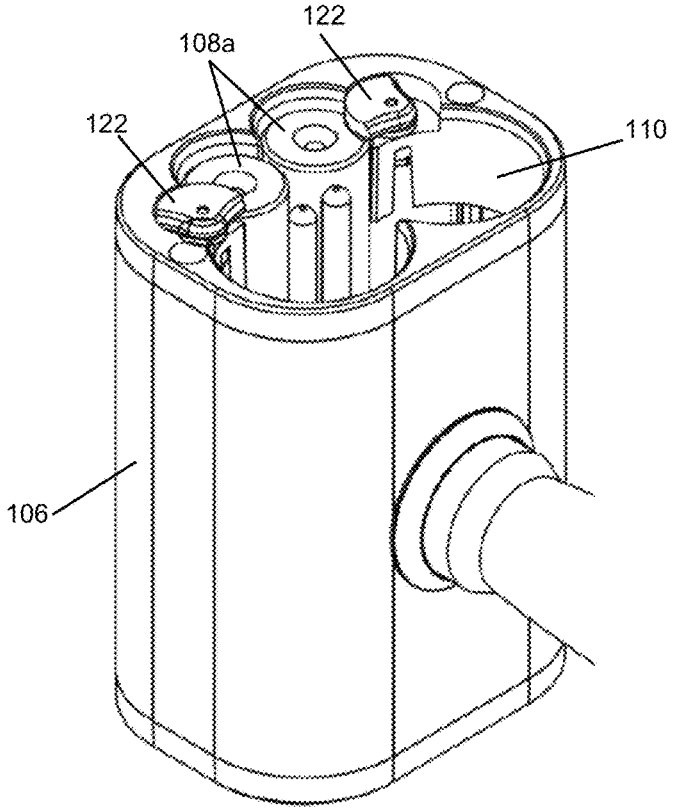
FIG. 25 is a partial perspective view of a weight device according to one or more examples of embodiments, showing one or more rotating tabs in a fourth position.
Figure 26:
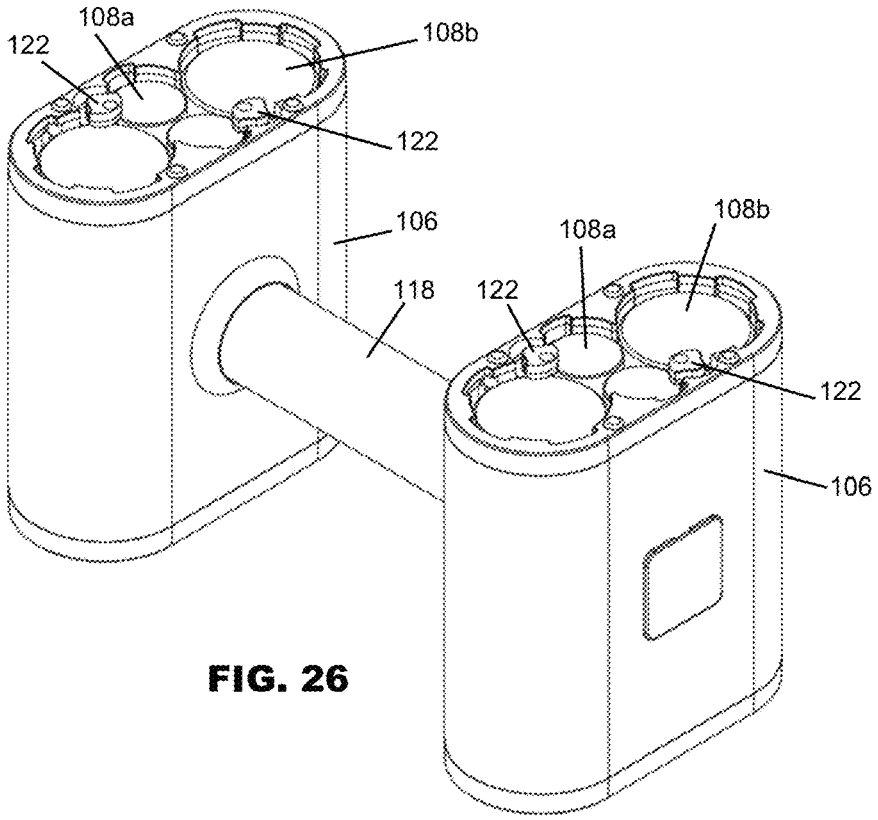
FIG. 26 is a perspective view of an alternative embodiment of a weight device, showing a different cluster of weight rods from that shown in FIGS. 8-17.
Figure 27:
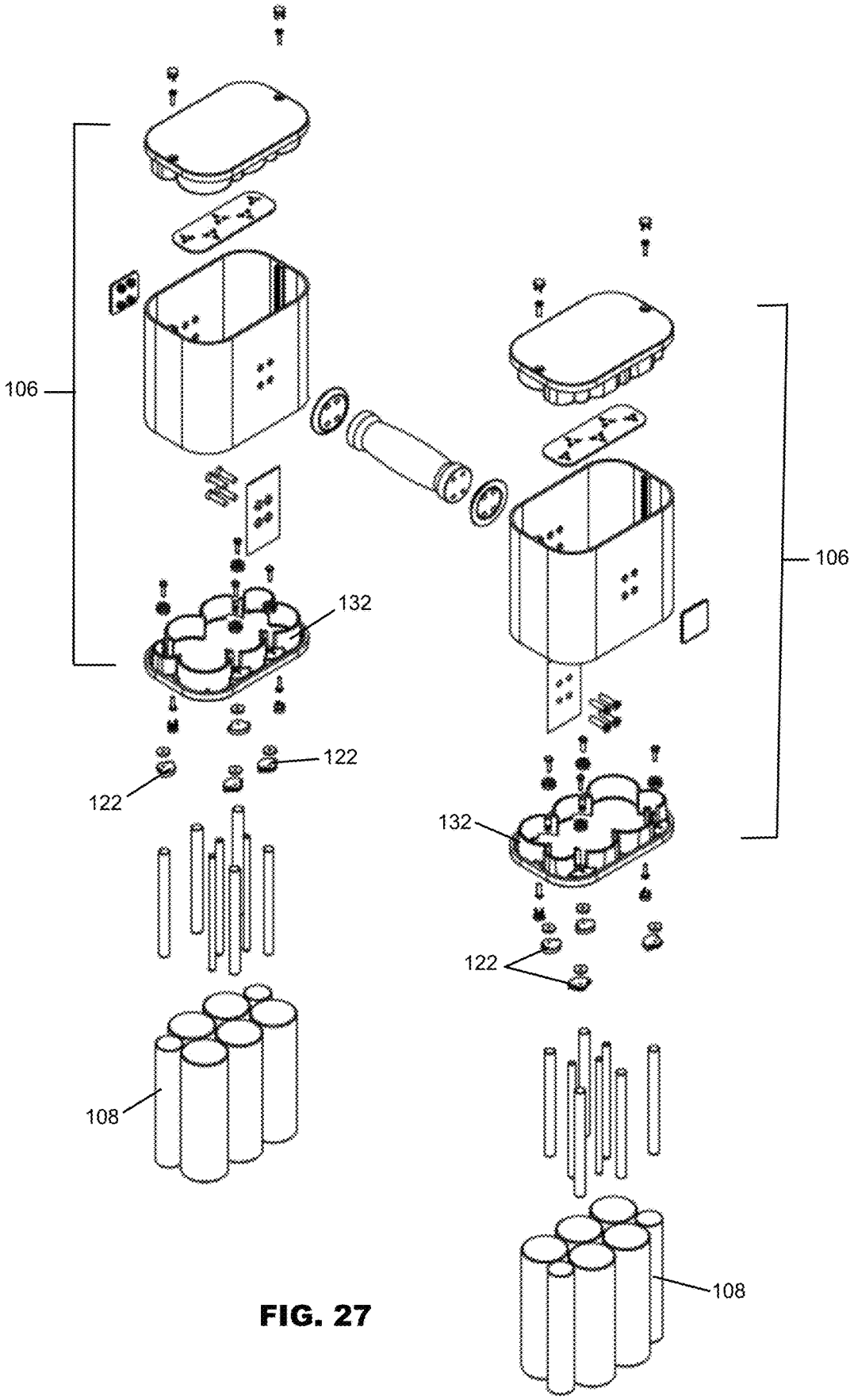
FIG. 27 is an exploded view of a weight device according to one or more examples of embodiments.

As shown in FIGS. 22-25 and referenced above, a series of rotating tabs 122 are provided for retention of weight rods 108 in the weight device retainer. The rotating tabs 122 may be attached to the bottom of the weight retainer 106 and are configured to either retain or disengage the weight rods 108. The rotating tabs 122 in the illustrated embodiments are sized to engage at least one, and preferably two weight rods 108. In one or more specific examples of embodiments, the rotating tabs 122 may move through the four described positions, each rotated in 90 degree increments. As can be seen, in FIG. 22, the rotating tab 122 is provided in the "open" position, or a first position, wherein the tab 122 is rotated to a position which does not contact or engage any weight rod(s). In FIG. 23, the rotating tab 122 is shown in a second position, which may be 90 degrees from the first position. In the second position, the rotating tab 122 engages one weight rod to retain the weight rod in the retainer. In FIG. 24, the rotating tab 122 is shown in a third position, which may be 90 degrees from the second position (and 180 degrees from the first position). In the third position, the rotating tab 122 engages two weight rods 108 to retain said rods in position in the weight retainer 106. In FIG. 25, the rotating tab 122 is shown in a fourth position, which may be 90 degrees from the third position. In the fourth position, the rotating tab 122 engages one weight rod (which weight rod is different from that engaged in the second position) to retain the weight rod in position in the weight retainer 106. While a rotating tab 122 and rotation degree is described, it is understood that variations may be made to retain the weights in other manners without departing from the overall scope of the present invention.

One or more rotating tabs 122 may be provided on each weight device 100, and may have in some examples, at least two spaced apart rotating tabs 122 on each retainer portion of the weight device 100.

Figure 18:
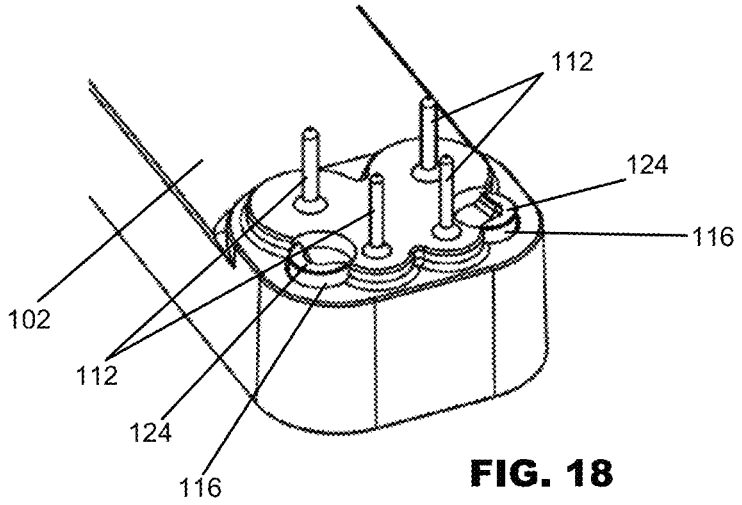
FIG. 18 is a partial perspective view of a platform for use with the weight device described herein.
Figure 19:
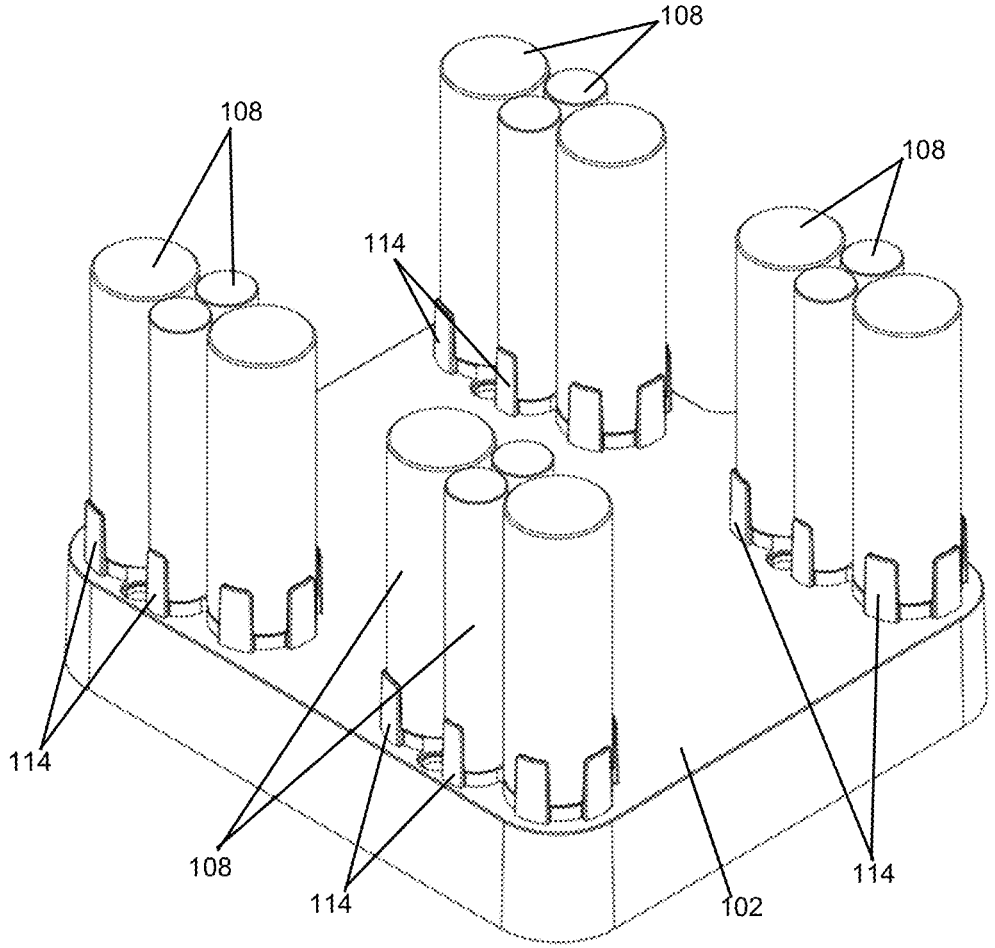
FIG. 19 is an alternative perspective view of a platform for use with the weight device described herein, showing a plurality of weight rods retained on the platform.

The orientation or position of the rotating tabs 122 may be set by a mating rotating disk 116 attached to the weight platform 102 (see FIG. 18). Accordingly, on the top face of the platform 102 may be several rotating disks 116, aligned under each of the rotating tabs 122 on the weight device 100. In one or more examples of embodiments, the rotating disk 116 is coupled to and driven by a motor 120, such as an electric motor (see FIG. 28). A small electric motor 120 coupled to the rotating disk 116 and driven by electronics is provided within the weight platform 102. Activation of the motor 120 causes rotation of the rotating disk 116. Each electric motor 120 may drive one, two, or more rotating disks 116 via a gear or belt-drive linkage. In this regard, electronics rotate the tabs 122 via mechanisms located in the platform 102. While the mechanism to rotate the tab 122 may reside in the platform 102, it is contemplated that the mechanism for rotation of tabs 122 may be located in the weight device 100 or weight retainer 106.

The rotating disk 116 has a shape that mates with the rotating tab 122 so as to engage and drive rotation of the rotating tab 122 upon activation by the motor 120 and rotation of the disk. In one example, each rotating disk 116 may have a small protrusion 124 on the top face, which aligns with a similarly, matingly shaped depression 126 in the rotating tab 122 when the weight device 100 rests on the platform 102, providing alignment and the ability to drive the rotation of the rotating tab 122.

Figure 29:
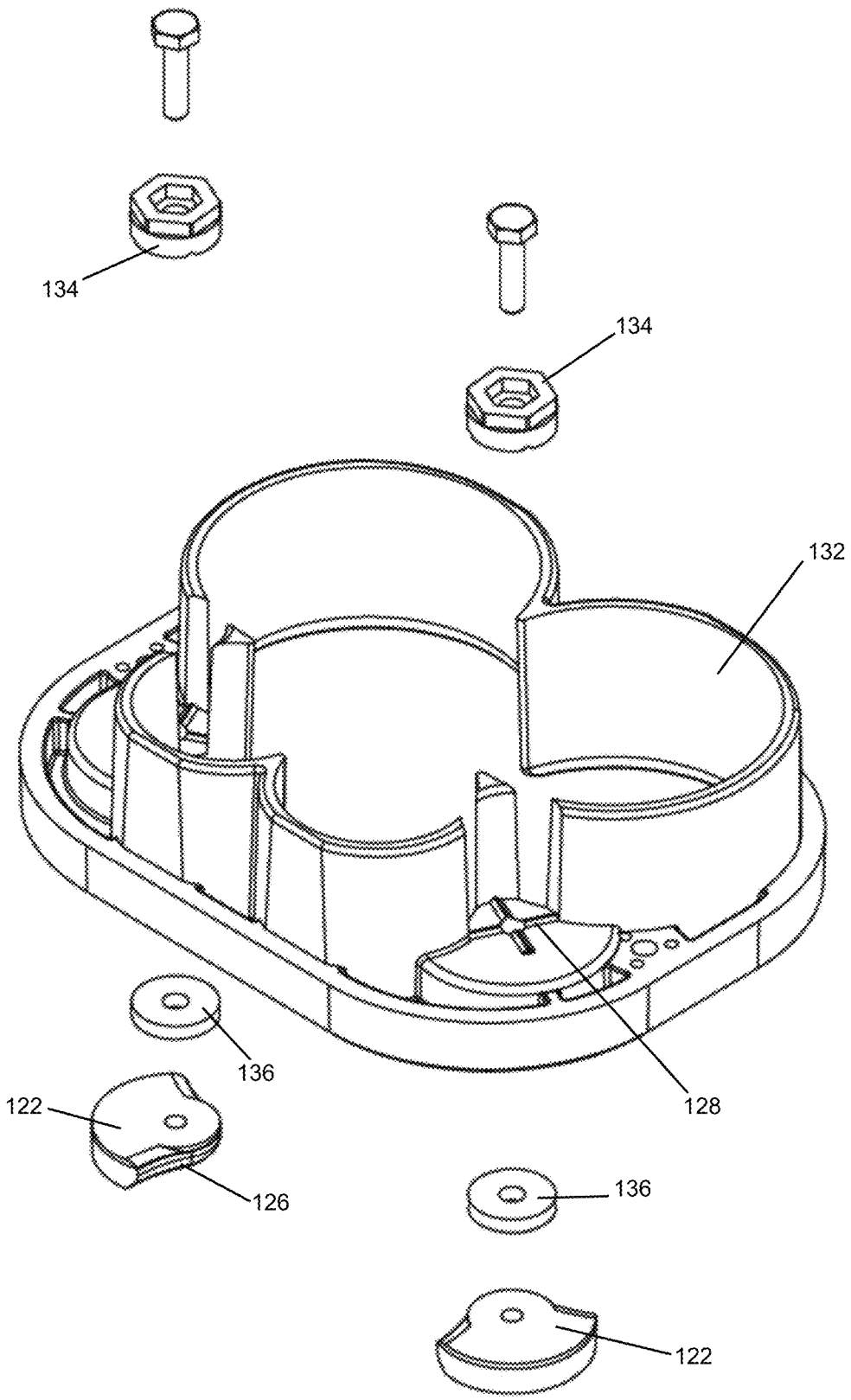
FIG. 29 is a partial, exploded view of a weight retainer bottom.
Figure 30:
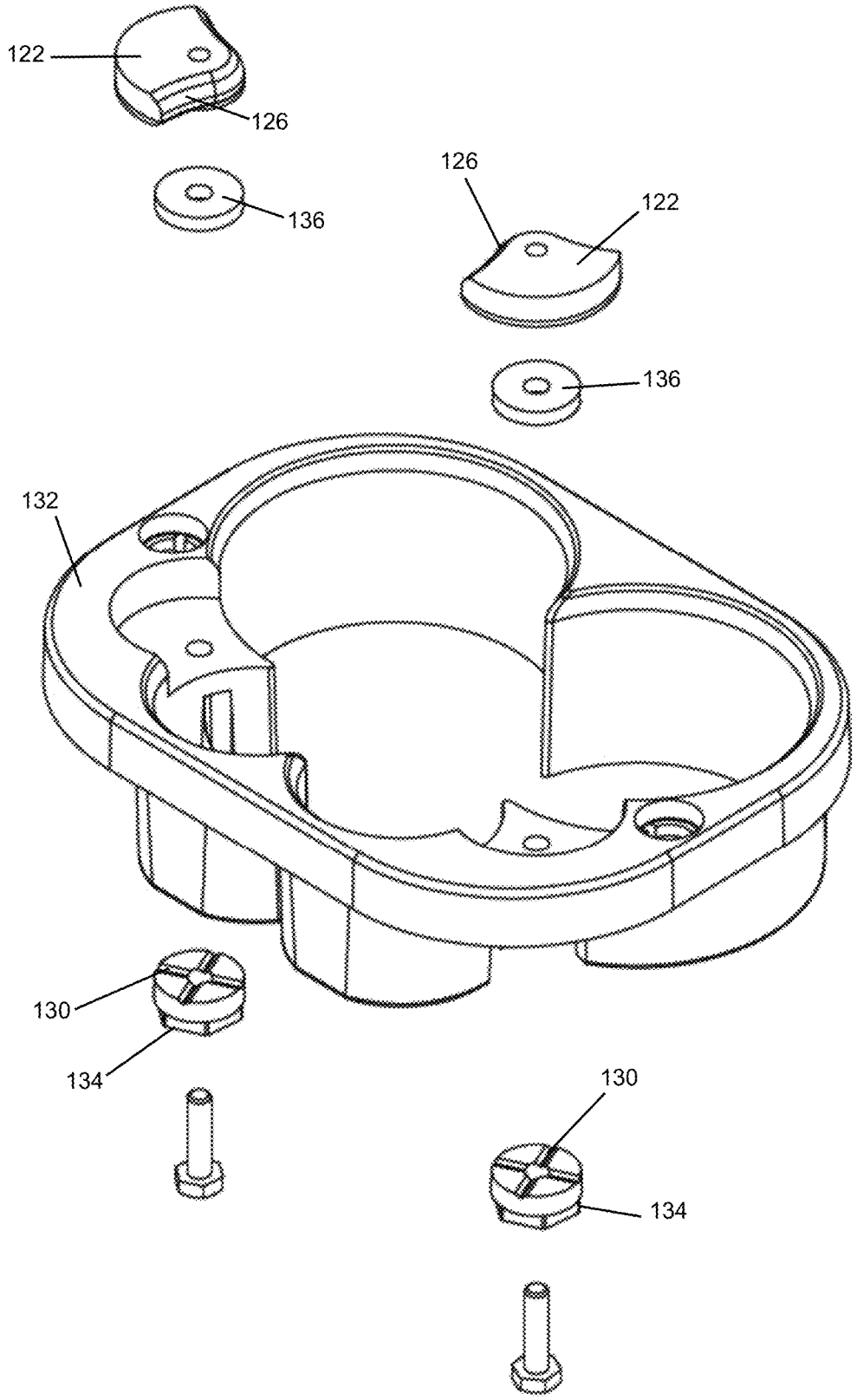
FIG. 30 is an additional, partial, exploded view of a weight retainer bottom, inverted from that shown in FIG. 29.

Preferably, the adjustment or interchange of weight rods 108 within the retainer 106 can only take place when the weight device(s) 100 are resting on the platform 102. And more specifically, adjustment or interchange of weight rods 108 preferably occurs upon activation of the motor 120 or rotating disk 116, which is activated by a control, such as a software application driven by a computing device 104. In one or more examples of embodiments, to prevent the rotating tab 122 from inadvertently rotating during the use (e.g., the workout or movement of the weight device 100), one or more mating ridges 128 and grooves 130 may be provided on the weight retainer bottom 132 and screw head collar 134, respectively (see FIG. 29-30). In one example, the ridges 128 and grooves 130 are oriented in 90 degree quadrants. A compression washer 136 may be provided to assist in pressing the screw head collar 134 against the ridges 128 on the weight retainer bottom 132. Orientation of the ridges 128 and grooves 130 is such that the harder the weight rod(s) 108 press against the rotating tabs 122 (e.g., downward), the less the tabs 122 are able to rotate because the ridge 128 and groove 130 are pressed together with greater force. In this example of embodiments, when the weight device 100 is returned to the platform 102 and the motor 120 activates the rotation of the rotating tab 122, it must lift up the weight rods 108 slightly to overcome the height of the ridge 128. Varying degrees of "ridge" 128 may be provided. For example a higher ridge 128 and/or a steeper ramp angle may be used to make it more difficult to turn the rotating tab 122, also requiring the motor 120 to have more torque.

While specific examples are described above, there are many alternative options to accomplish the securement of the weight rod(s) 108 in the retainer 106. In one example, a compression washer may be used in the attachment of the rotating tab 122 to the weight retainer 106, which creates enough friction resistance to keep it from rotating when the weight device 100 is in use. Another alternative is to add detents to the interface between the rotating tab 122 and the weight retainer 106, which would register the tab 122 into the four orientations. Alternative mechanical solutions for retaining the weight rods 108 include orienting a tab 122 in the weight device 100 such that the rotating axis is horizontal instead of vertical, and the tab 122 flips inward towards the center of the weight rod. In some examples the tab 122 could be spring-loaded in the closed position, and the platform 102 enclosure could have a vertical plunger under each tab 122 to push it open. An additional alternative option is to have the weight rods 108 retained via leaf springs, situated vertically in the weight retainer 106, pressing inward toward the center of the weight rod, and having a catch on the end to engage with the edge of the weight rod. When placed back on the platform 102, the leaf spring may be released by pressing it away from the weight and held by a "catch" within the weight retainer 106. Another option is to use magnetically attractive material (e.g., steel) for the weight rods 108 and corresponding magnets, such as electrically activated magnets, located in the weight retainer 106 to retain the weight rods 108 in the weight retainer 106. As indicated, there are a broad range of options for retaining the weight rods 108 in the retainer. The examples provided herein are non-limiting illustrations of possible variations and one of skill in the art may arrive at additional and different mechanisms for accomplishing the same result.

Accordingly, once the rotating tab 122 is set to position by the rotating disk 116, it preferably stays in place (does not rotate any further) after the weight device 100 is picked up so as to retain the weight rod 108.

There are a broad range of options for engaging the rotating tabs 122 or motors 120 to adjust or change the weight of the weight devices 100. In one example, a handheld device or other computing device 104 communicates with the electronics inside the platform 102, either wirelessly (via, for example, Bluetooth or Wi-Fi), or via a hard-wired or tethered connection (see FIG. 1).

Figure 31:
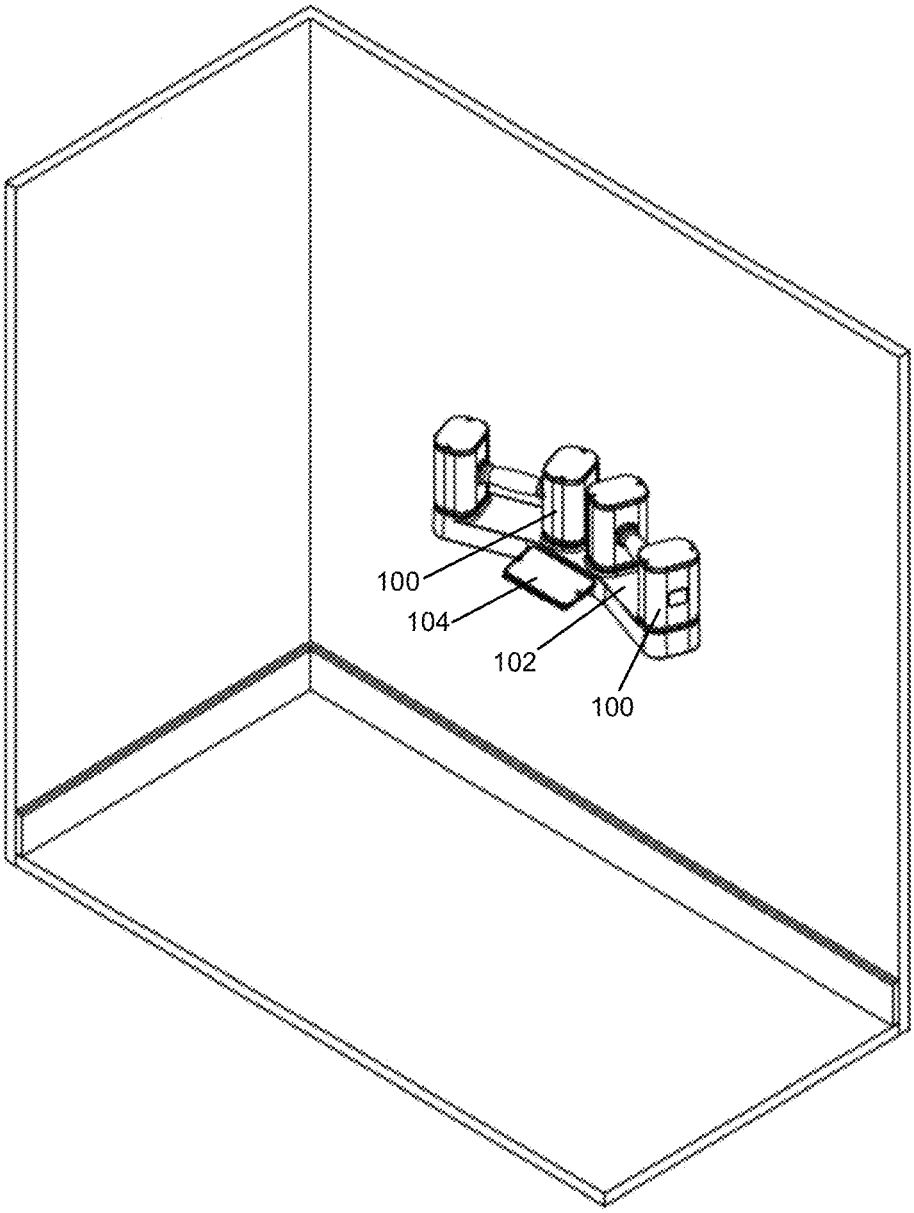
FIG. 31 is a perspective view of one or more examples of embodiments of an assembly having a weight device, platform, and portable electronic device as described herein positioned on a wall.
Figure 32:
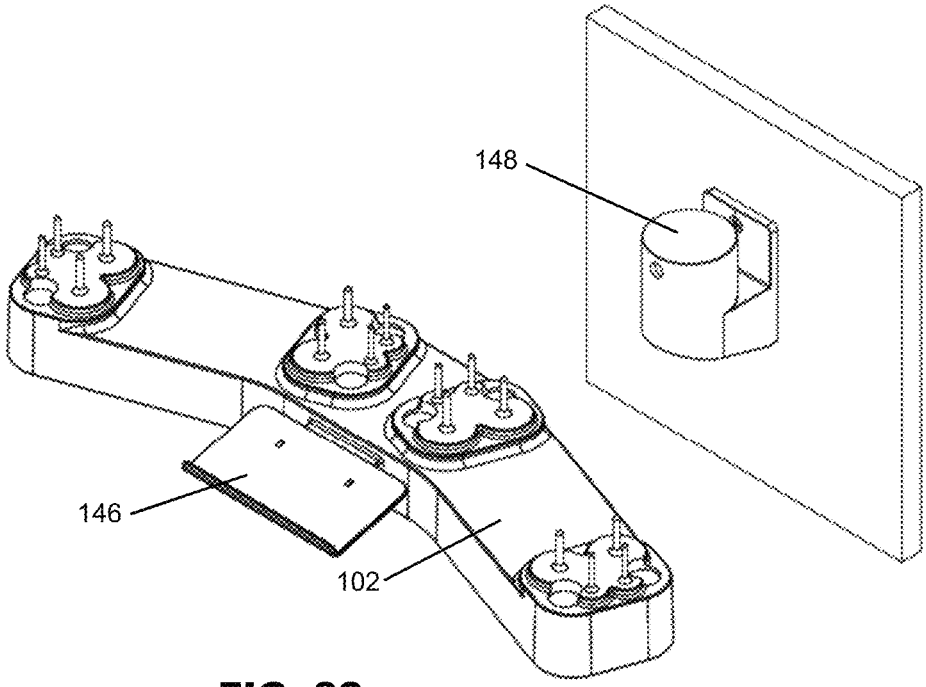
FIG. 32 is a partial, close up, exploded view of the platform and wall support for positioning on a wall as shown in FIG. 31.
Figure 33:
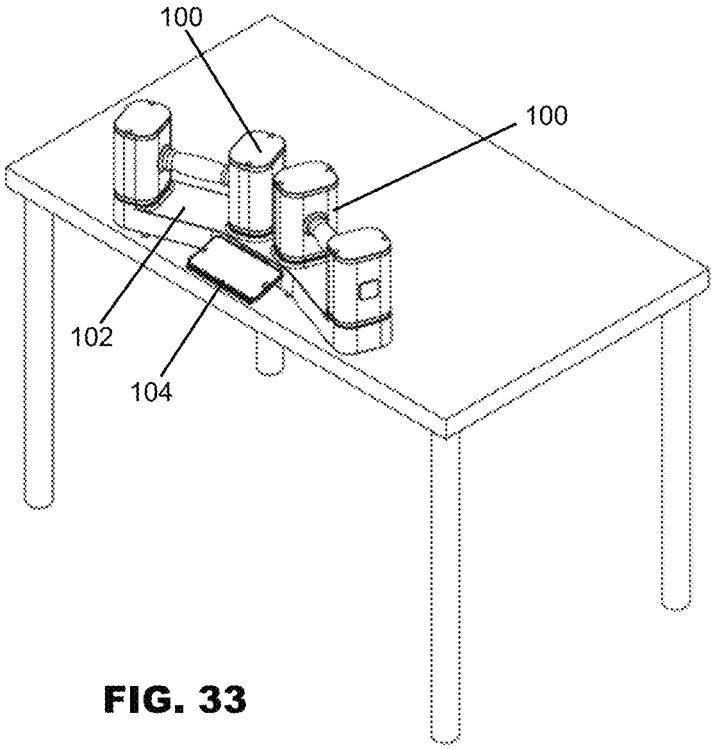
FIG. 33 is a perspective view of one or more examples of embodiments of an assembly having a weight device, platform, and portable electronic device as described herein positioned on a table.
Figure 34:
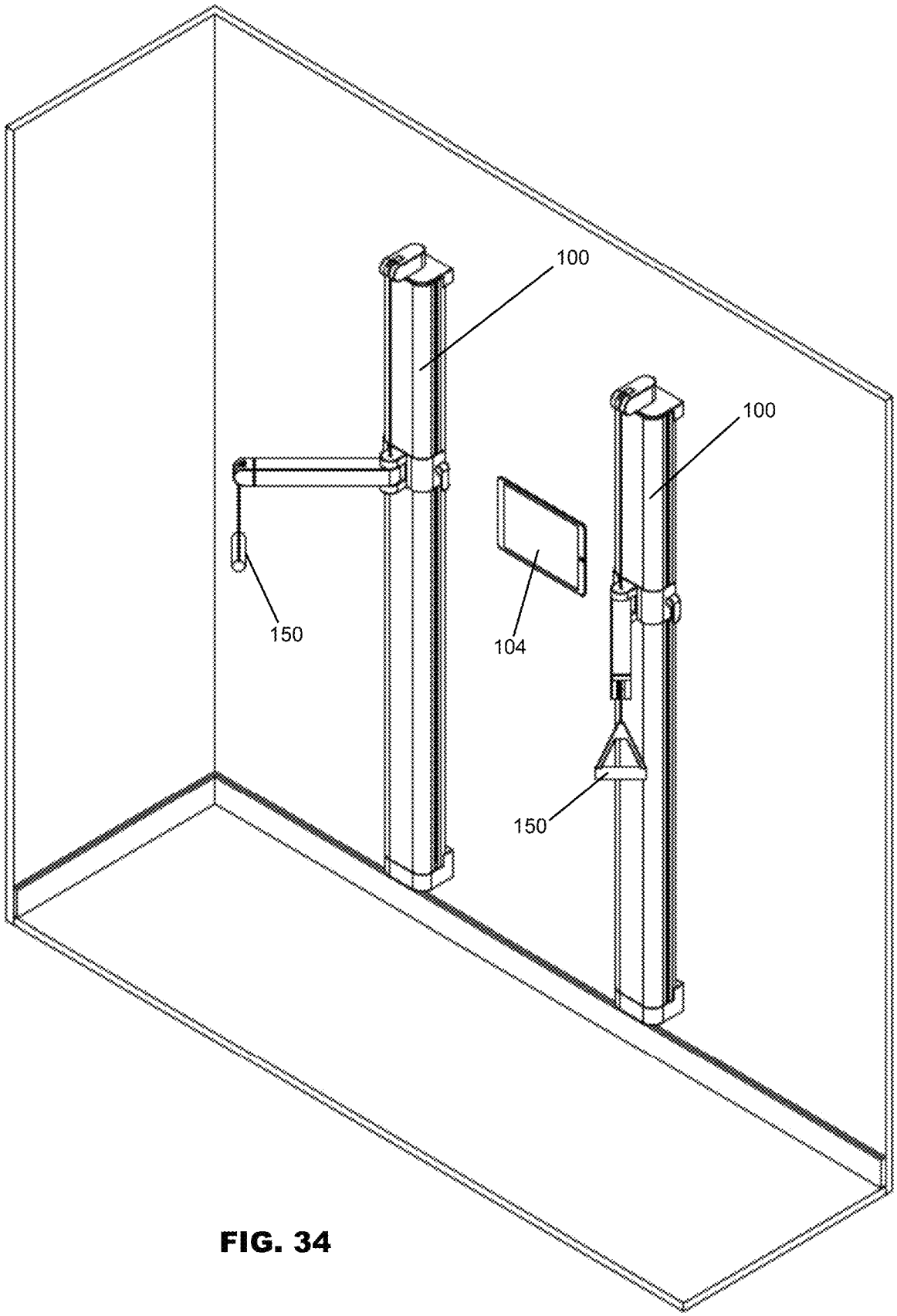
FIG. 34 is a perspective view of one or more examples of embodiments of an alternative assembly having a weight device, platform, and portable electronic device as described herein.
Figure 35:
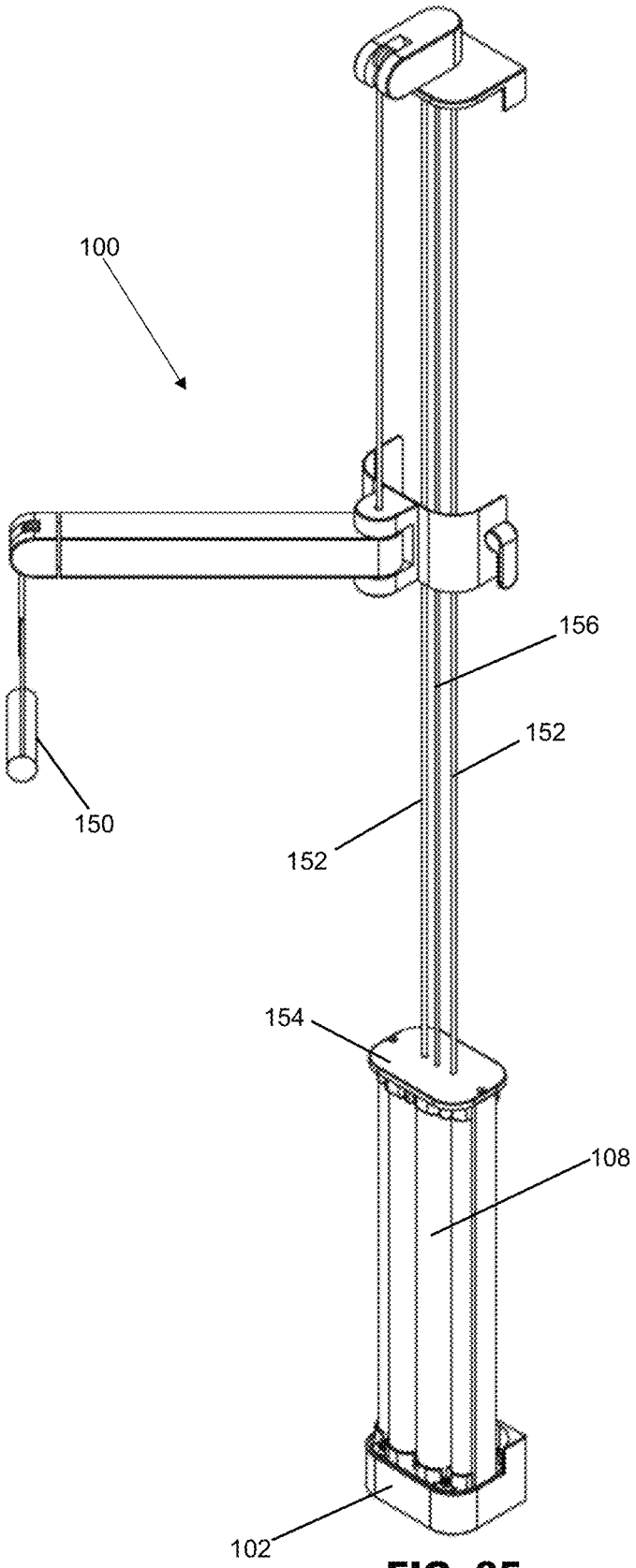
FIG. 35 is a partial perspective view of the alternative assembly shown in FIG. 34.
Figure 36:
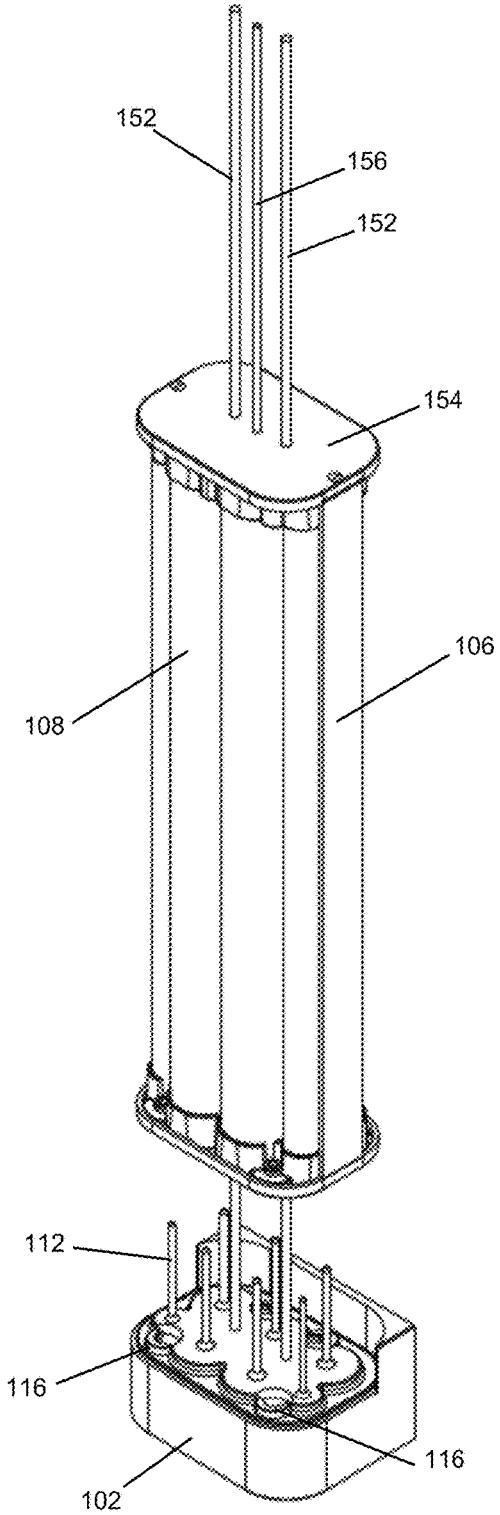
FIG. 36 is a partial perspective view of the alternative assembly shown in FIG. 34, showing the weight retainer carrying weight rods and partially raised away from the platform.
Figure 37:
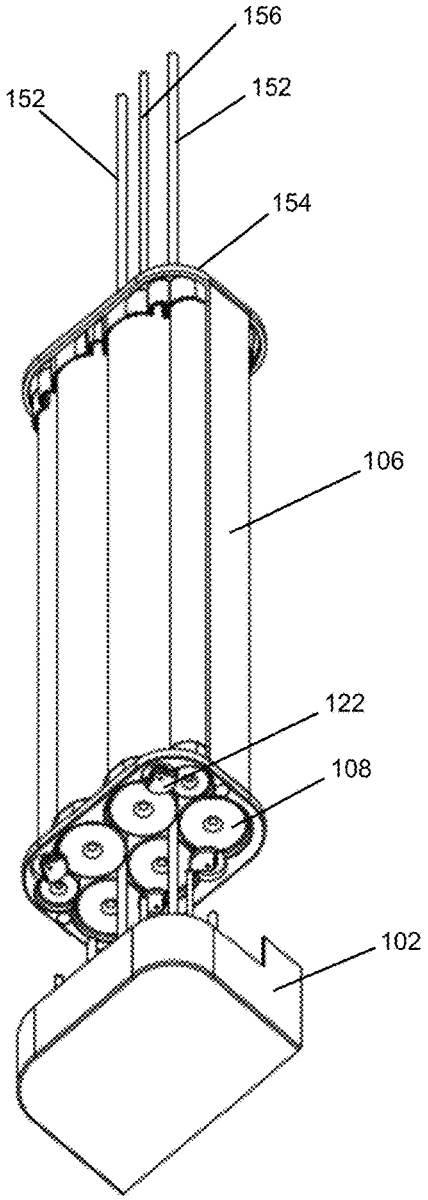
FIG. 37 is an additional partial perspective view of the alternative assembly shown in FIG. 36.
Figure 38:
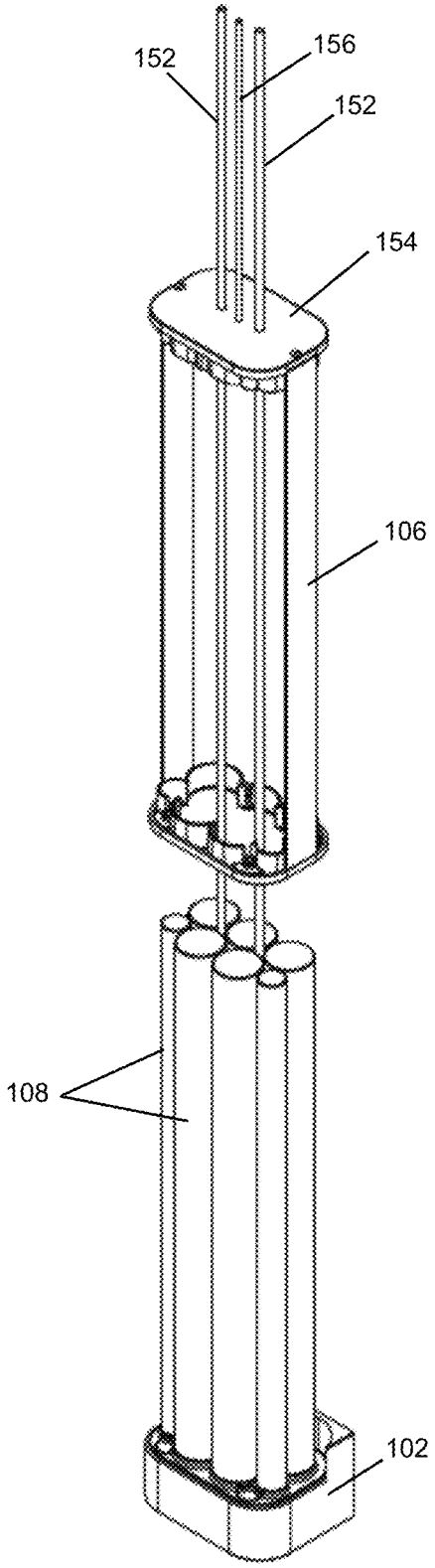
FIG. 38 is a partial perspective view of the alternative assembly shown in FIG. 34, showing the weight retainer partially raised away from the platform, showing the weight rods remaining on the platform.
Figure 39:
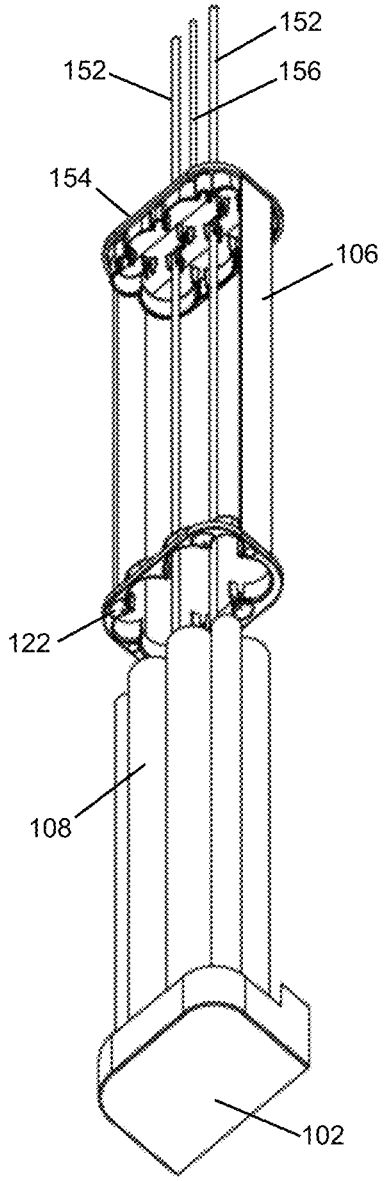
FIG. 39 is an additional partial perspective view of the alternative assembly shown in FIG. 38.

Optionally, the weight device 100 and system may include a base stand 138, which supports the platform 102, positioning it at an elevated height for easy access. Referring to FIGS. 1-5, one or more systems are shown including a base stand 138. The base stand 138 includes a base tube 140, which can be made from extruded aluminum, or steel tube, and a ground engagement 142 which may comprise, for example, one or more base legs or a base plate which could be made from thick steel plate, cast aluminum, iron or steel, or injection-molded structural plastic. The base stand 138 may accommodate casters or wheels 144, which, among other benefits, allow the system to be rolled into position in a room for a workout, and rolled back away when not in use. In certain examples, the base stand 138 may be fixed in height. The base stand 138 may also include a mechanism making it height adjustable, by for example including a gas cylinder, or a telescoping tube and locking pin. A variety of platform base configurations are also contemplated, including but not limited to a flat plate with feet or bumpers or alternatively a plastic molded structure having casters or wheels. A portable electronic device support 146 is provided on or near the platform 102 may be positioned in a variety of locations. As shown in FIGS. 1-5, the device support 146 is provided in front of the weight devices 100. In FIG. 20, the support 146 is positioned behind and/or above the weight devices 100. In some example of embodiments, such as shown in FIGS. 31-32, the platform 102 may be mounted to a wall (e.g., without base stand 138) and to this end, the platform 102 may include a wall support 148 which is attached to the wall. The platform 102 may then be attached and secured to the wall support 148. The platform 102 may also be arranged to be supported on a flat surface, such as a desk or table (FIG. 33).

The portable electronic device stand or support 146 is shown in a fixed position, however this also could be height-adjustable, as well as angle-adjustable. In some examples, a portable electronic device support 146 may also be provided on the base stand 138, positioning it for easy viewing and access (such as pressing buttons). In this regard, in some examples of embodiments, an integrated stand and portable electronic device support may be used to improve the user experience by positioning the weight device 100 at an easy to reach height, and the display at an easy to view angle.

In one or more examples of embodiments, wherein the weight device 100 comprises a dumbbell, the dumbbell may uniquely have a constrained small size. In this regard, the size of the dumbbell is determined by the length of the handle and the width of each weight retainer 106. As the weight retainers 106 uniquely stack or arrange the various weight rods 108 of different sizes (see Figures) to maximize the available space, the weight retainers 106 are narrow in width, yet can accommodate various weights. In comparison, traditional adjustable weight dumbbells have weights attached laterally, increasing in length with successive weights. Advantageously, the dumbbells described herein are compact for storage. Moreover, a user does not inadvertently injure him or herself by scraping a lengthy dumbbell across a leg. As is known, rods on many existing dumbbells, especially selectorized dumbbells, are so long that a user cannot hold the dumbbell naturally for exercises such as curls. The dumbbells are not ergonomic and a user cannot let the weights hang by the user's side. In comparison, the weight devices disclosed herein can rest more naturally at the user's sides at the beginning and end of each rep.

Various weight devices 100 and fitness devices are contemplated by the system described herein. Many of the figures illustrate a "dumbbell" by way of example; however, a number of weight devices or fitness devices may be substituted in place of such a device. The auto-adjustable weight system could be applied to a variety weight-based fitness products, including but not limited to, dumbbells, kettlebells, barbells, weight vests, functional trainers, "Universal"-style weight stacks, and the like.

Figure 28:
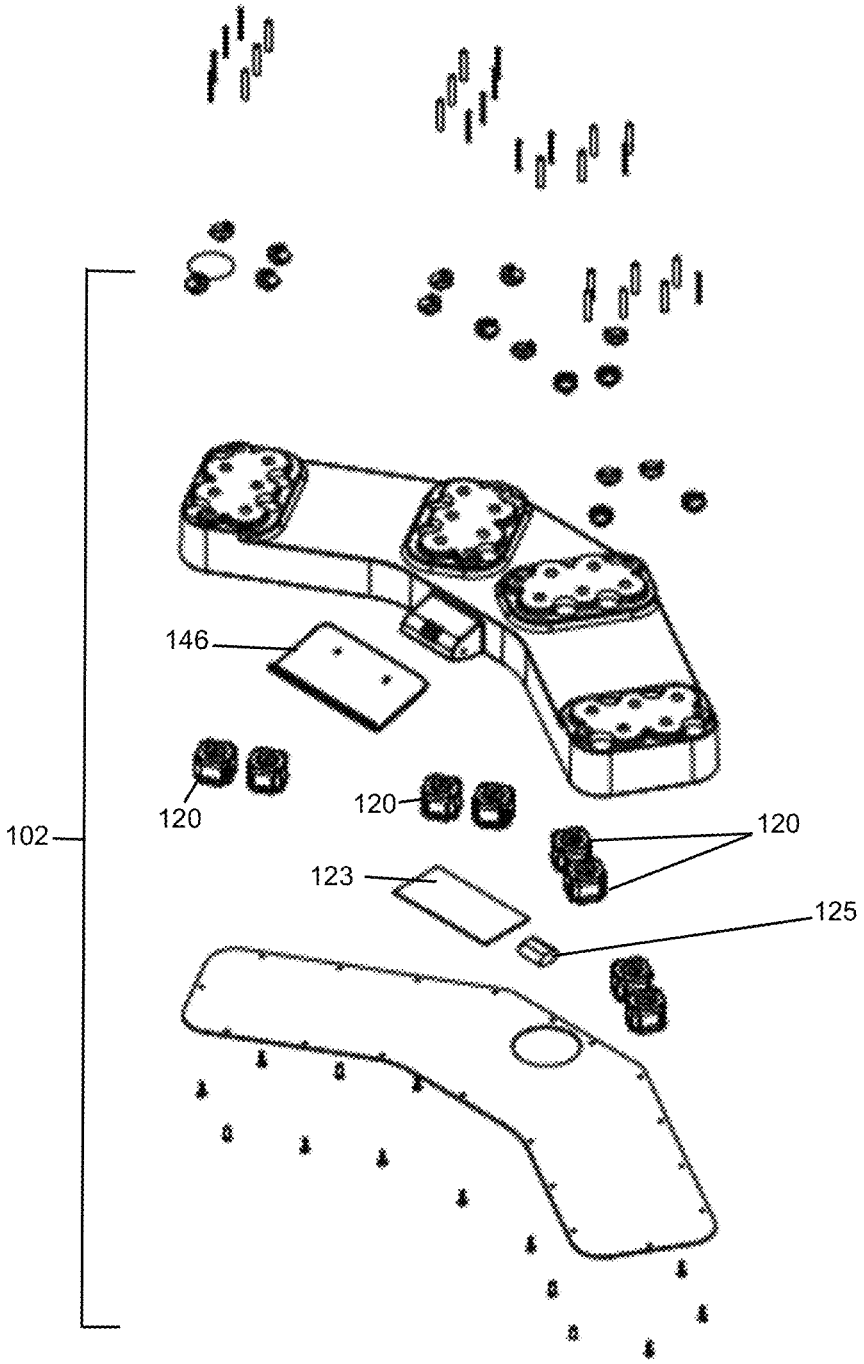
FIG. 28 is an exploded view of a platform according to one or more examples of embodiments.

For example, a functional trainer is shown in FIGS. 34-39 as a weight device 100. The functional trainer may use the same weight retention mechanism as the weight device(s) 100 described herein, using weight rods 108, rotating tabs 122, electric motors 120, platform 102 or base, and the like, wherein the electric motors 120 may be driven by a software application executed on a portable electronic device 104. In this regard, pulling on a handle 150 of the functional trainer would cause the weight cartridge or retainer 106 with selected and retained weight rods 108 to travel vertically upwards in the functional trainer. As shown, the weight rods 108 are contained in the weight cartridge or retainer 106 which is pulled upwards from the base platform 102 as the functional trainer is used. The weight cartridge or retainer 106 passes through two fixed rods 152, which extend from the top cap 154, down to the base enclosure or platform 102. The weight cartridge or retainer 106 is pulled upwards by a central cable 156 in the illustrated example. As can be seen, the rotating tabs 122 are rotated so as to retain one or more weight rods 108. Vertical pins 112 are also mounted to the base platform 102 to help align the rods 108 when they are lowered, and hold them in place when resting upon the base platform 102. Inside the base platform may be the motors 120, printed circuit board 123, and power supply (such as a battery) 125 (FIG. 28). It is also contemplated that one or more position sensors (not shown) may be used to detect the placement or removal of the weight device 100 and/or a weight rod 108.

As indicated, there are a broad range of options for engaging the rotating tabs 122 or motors 120 for adjusting the weight of the weight devices 100. In one example, a handheld device or other computing device communicates with the electronics, e.g., the printed circuit board 123, inside the platform 102, either wirelessly (via, for example, Bluetooth or Wi-Fi), or via a hard-wired or tethered connection. Unlike existing "selectorized" dumbbells, there are no knobs to turn or pins to adjust on the weight device disclosed herein. The weight adjustment may happen through an integrated software application ("app"), in combination with the mechanism discussed above. A user may use the app to select the amount of weight for each dumbbell. The app then communicates with the electronics in the platform 102 to execute the instructions and make the adjustment of weight in the weight device 100, via the mechanism described above. Alternatively, after setting up the app (entering basic data such as age, weight, fitness level and fitness goals), the user may rely on the app to decide what is the best amount of weight for each exercise.

In one or more examples of embodiments, a seamless integration of the application software driven by a portable electronic device 104, and the weight device 100/platform 102 is provided. In some examples of embodiments, the app and its various functions may be provided locally on the portable electronic device 104. However, in one particular example, the app may be optionally cloud-based or in communication with the cloud so as to deliver feedback data to a third party. For example, the app may deliver feedback data regarding use to a trainer or physical therapist. However, it is also contemplated a workout may stream to a portable electronic device, such as a smartphone or tablet or other screen, which guides the user through use of the weight devices 100 for the workout.

Figure 40:
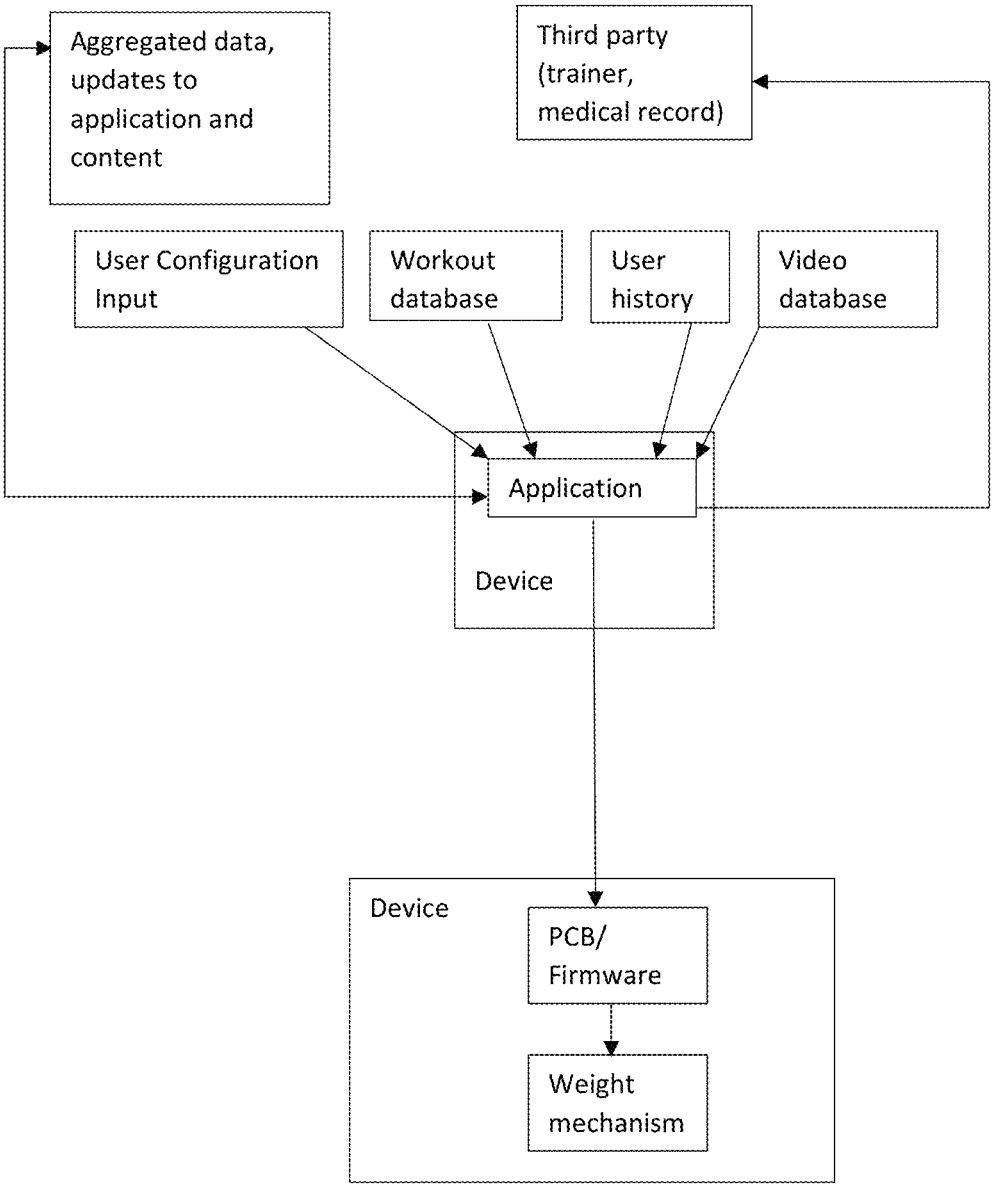
FIG. 40 is a flow chart showing the operation of the software application according to one or more examples of embodiments.

A flow chart showing operation of one or more examples of embodiments of the system described herein is shown in FIG. 40. As can be seen the software application which is operating on a portable electronic device may receive a variety of data and information and from one or more of a variety of sources, including, but not limited to: user configuration input, a workout database, user history, and a video database, as well as aggregated data from other users, updates to the software application, and other content. The portable electronic device with software application may also communicate data, such as usage data, to a third party, such as a trainer or a physical therapist or medical provider. The device and software application may also communicate with a third party social network, providing the user with a social media engagement. Data regarding the weight device and its use may also be delivered to a database for aggregation with other data, or to the software provider. The device and software application may also communication with a weight device, and in particular with the weight device's PCB and firmware. The PCB and firmware may then communicate to the weight device, namely the one or more motors in the platform, to select the amount of weight to be retained by the weight device. While specific examples are described, variations thereon may be acceptable for the purposes provided.

Figure 41:
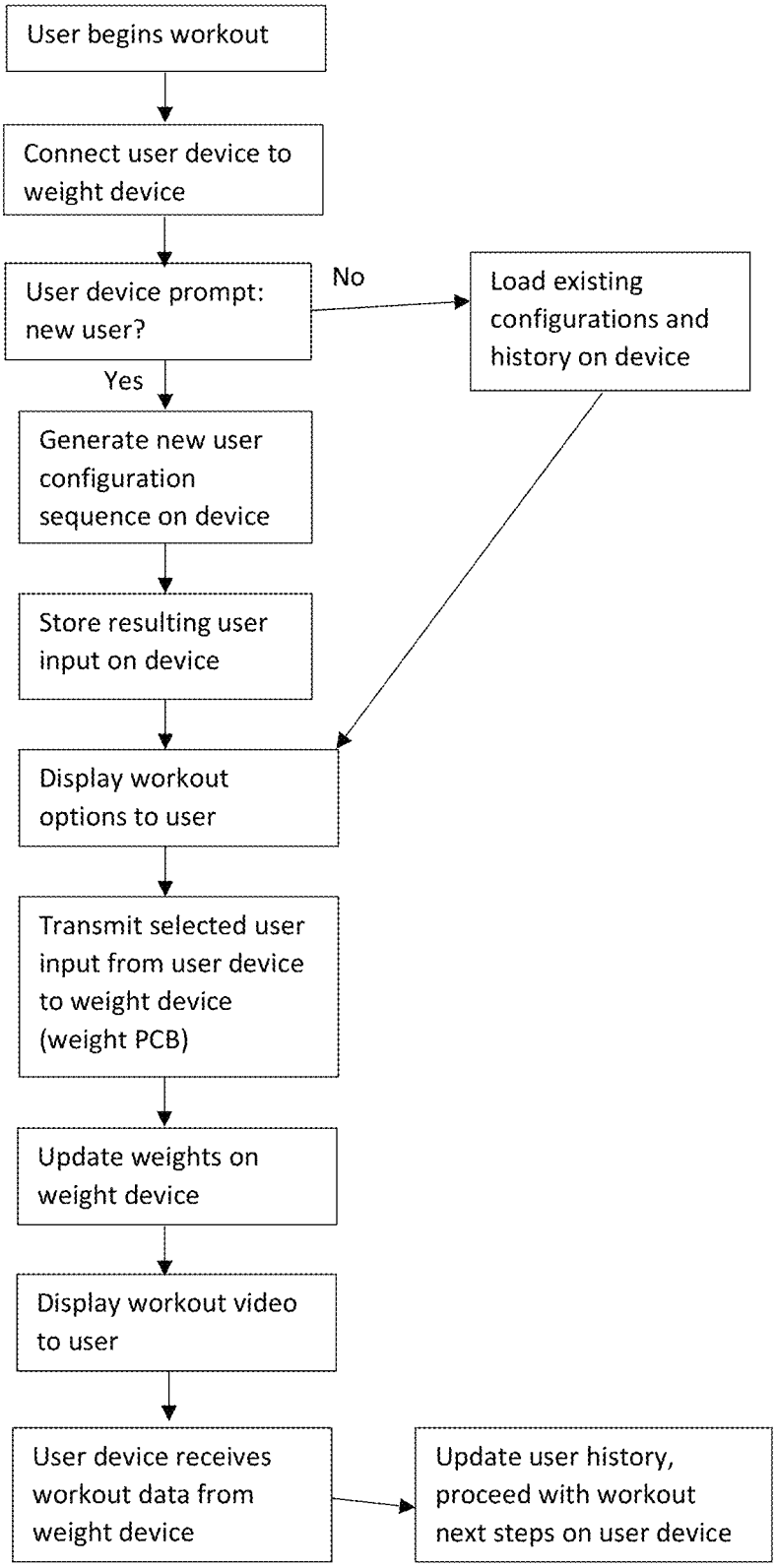
FIG. 41 is a logic diagram showing the function of the software application in use with the weight device in one or more examples of embodiments.

FIG. 41 provides one or more examples of embodiments of a logic diagram showing the operation of the software application described herein. A user first begins a workout. The user connects his or her portable electronic device to the system, such as connecting the device to a tethered connection cable or other means described herein. The portable electronic device may then prompt to ask if the user is a new user. If the user is a new user, then a new user configuration sequence is generated on the device. The user input in response to this configuration sequence is stored. Then workout options are displayed to a user. If the user is not a new user, then following the new user prompt existing configurations and history are loaded on the portable electronic device. The workout options are then displayed for the user. The user may then select options, i.e., user input, and the input selected options are transmitted from the user device to the weight device, and in particular to the weight device PCB. The PCB then updates or adjusts the weight rods to achieve the corresponding weight on the weight device. The workout video is then displayed to the user on the portable electronic device. The user's portable electronic device receives workout data from the weight device, updates the user history and data, and proceeds with the workout next steps or next workout segment on the user device.

Figure 42:
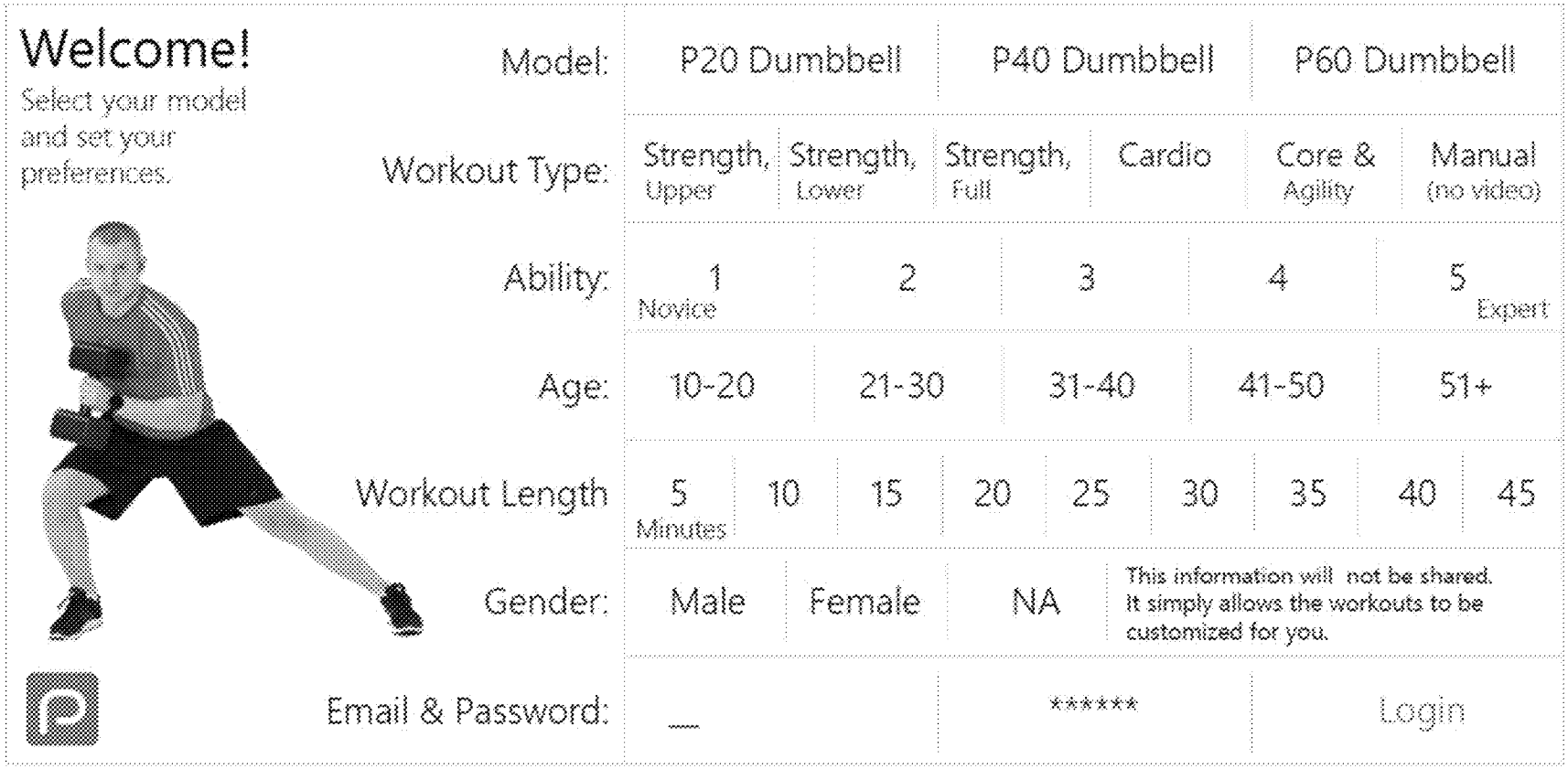
FIG. 42 is a graphic representation of a software application for use with a portable electronic device used with the assembly or system described herein according to one or more examples of embodiments.
Figure 43:
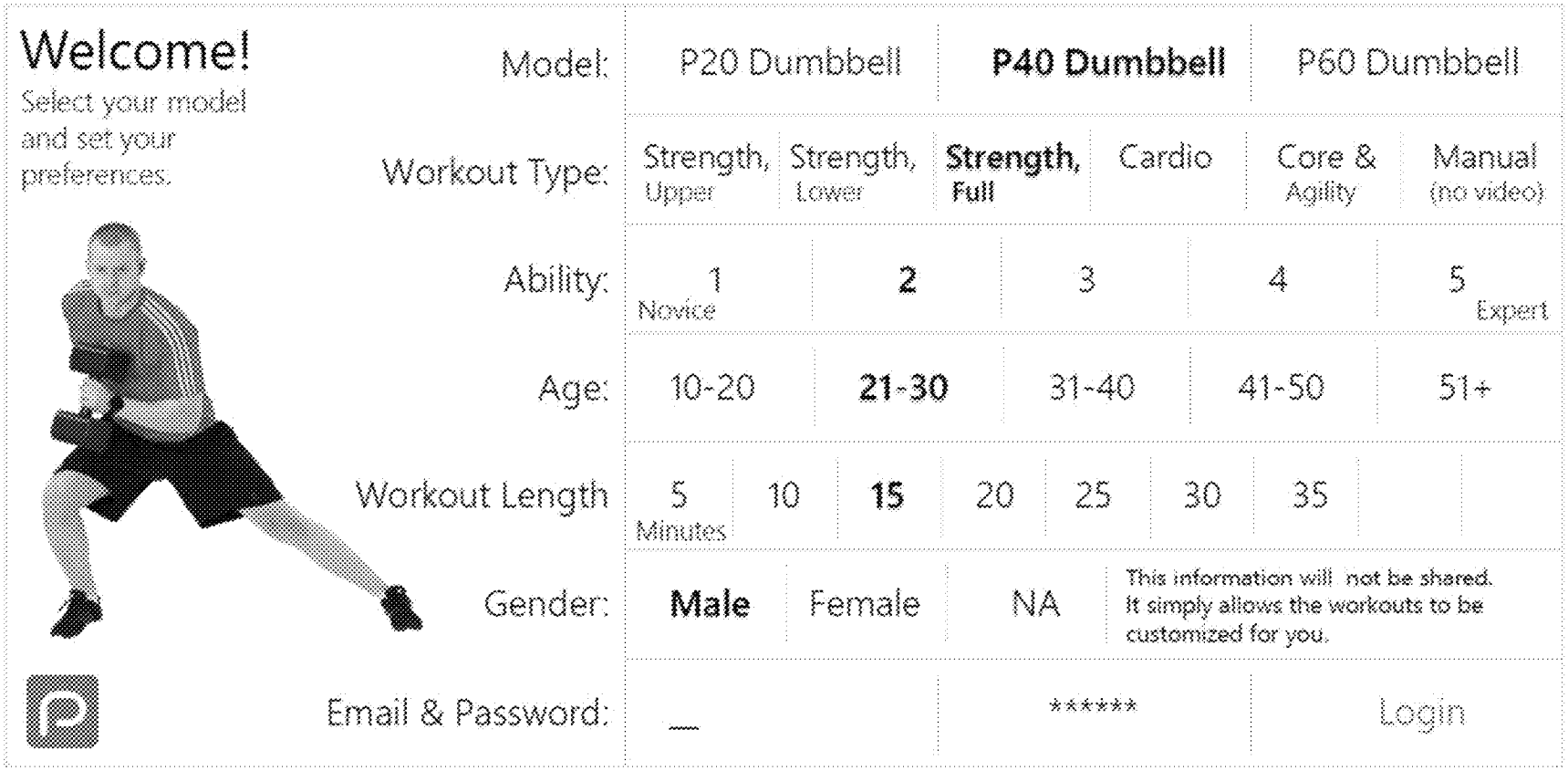
FIG. 43 is an additional graphic representation of a software application for use with a portable electronic device used with the assembly or system described herein according to one or more examples of embodiments.
Figure 44:
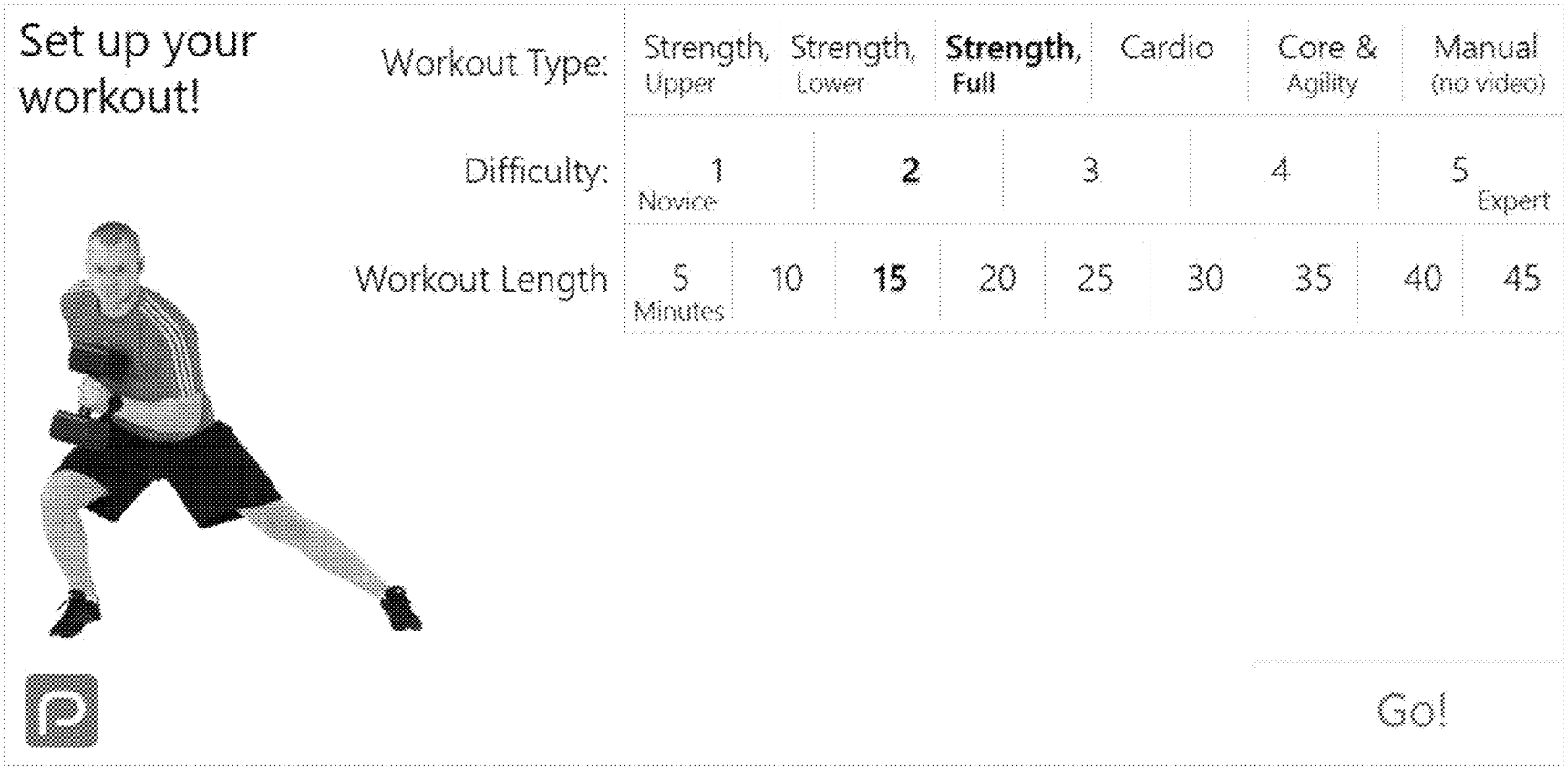
FIG. 44 is an additional graphic representation of a software application for use with a portable electronic device used with the assembly or system described herein according to one or more examples of embodiments.

As can be seen in FIGS. 42-44, a variety of different types of workouts may be built using the system described herein, including: core and agility; cardio; strength upper body; strength lower body; strength full body; manual control of the workout, and the like. These different workout options may be further adjusted by selection of one of a plurality of levels of difficulty, and workout length (e.g. ranging from 5 minutes to 45 minutes), etc. In some examples, the workout level gradually increase as it is used.

The workouts may be "filtered" or built based upon other factors, such as, but not limited to, age, gender, ability, etc., in order to customize a workout to fit the particular user. In one or more further examples of embodiments, the system may be dynamic in that it learns from its user, namely adjusting to the user's input(s) and/or previous workouts to put together a workout which achieves certain goals. Moreover, the system can also receive and respond to input from the user. The system may also collect and analyze data from all users to build a workout or for other reasons.

The app may be comprised of or provide access to and selection from a database of a matrix of different workouts. Each workout may be built from small video segments spliced together, or alternatively from instructions to be communicated via a screen or connected speaker. Each workout may also be tied to a particular weight to be assigned to the weight device (which auto-adjust to the selected weight). In certain examples, instead of streaming a single 30-minute video, several exercise segments are provided which are interchangeable with other segments and "spliced together" for the workout, creating a unique and customized workout that achieves certain predefined parameters, e.g., particular number of reps and sets at a particular weight or multiple weights, with specific rest periods, and different activities. In other words, workout bites or segments are provided. An entire workout may be built by adding and removing workout segments, in much the same way as someone could add and remove weights from a dumbbell or move the pin in a functional trainer to a different weight level. A system with workout segments which may be interchanged is more granular and allows for virtually a limitless range of workouts, which has several benefits. For example, not only can it keep the workouts fresh and varied, but because it is so granular it can allow each successive workout to have very small adjustments to the difficulty, as the user becomes more fit. Also, storing video data in small 5 second bits, and then adding them together requires much less data than a full 30 minute workout video, so the streaming of the workout is much more efficient.

Figure 45:
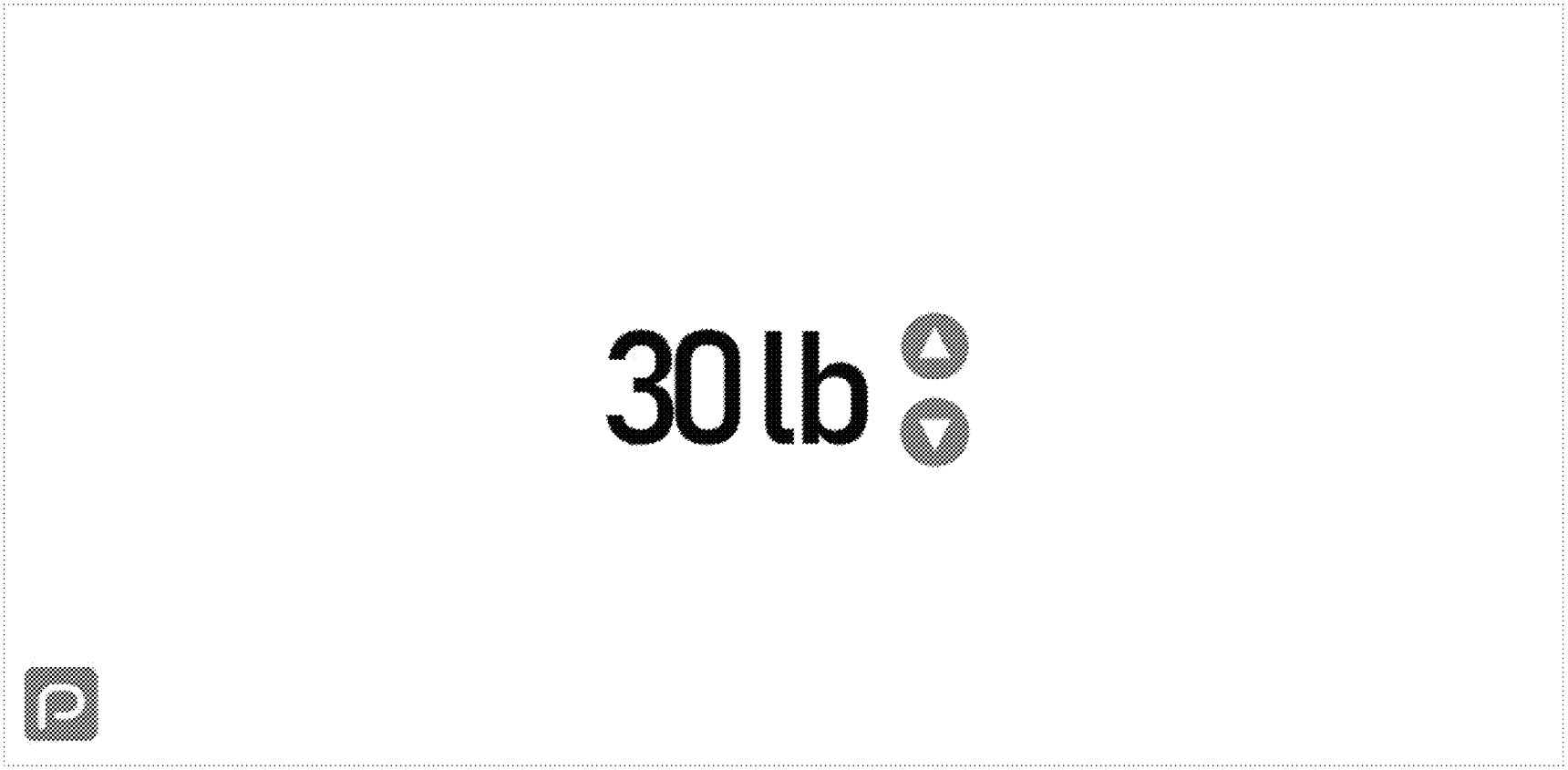
FIG. 45 is a graphic representation of a screen of a software application for use with the portable electronic device used with the assembly or system described herein, showing a weight selection screen, according to one or more examples of embodiments.
Figure 46:
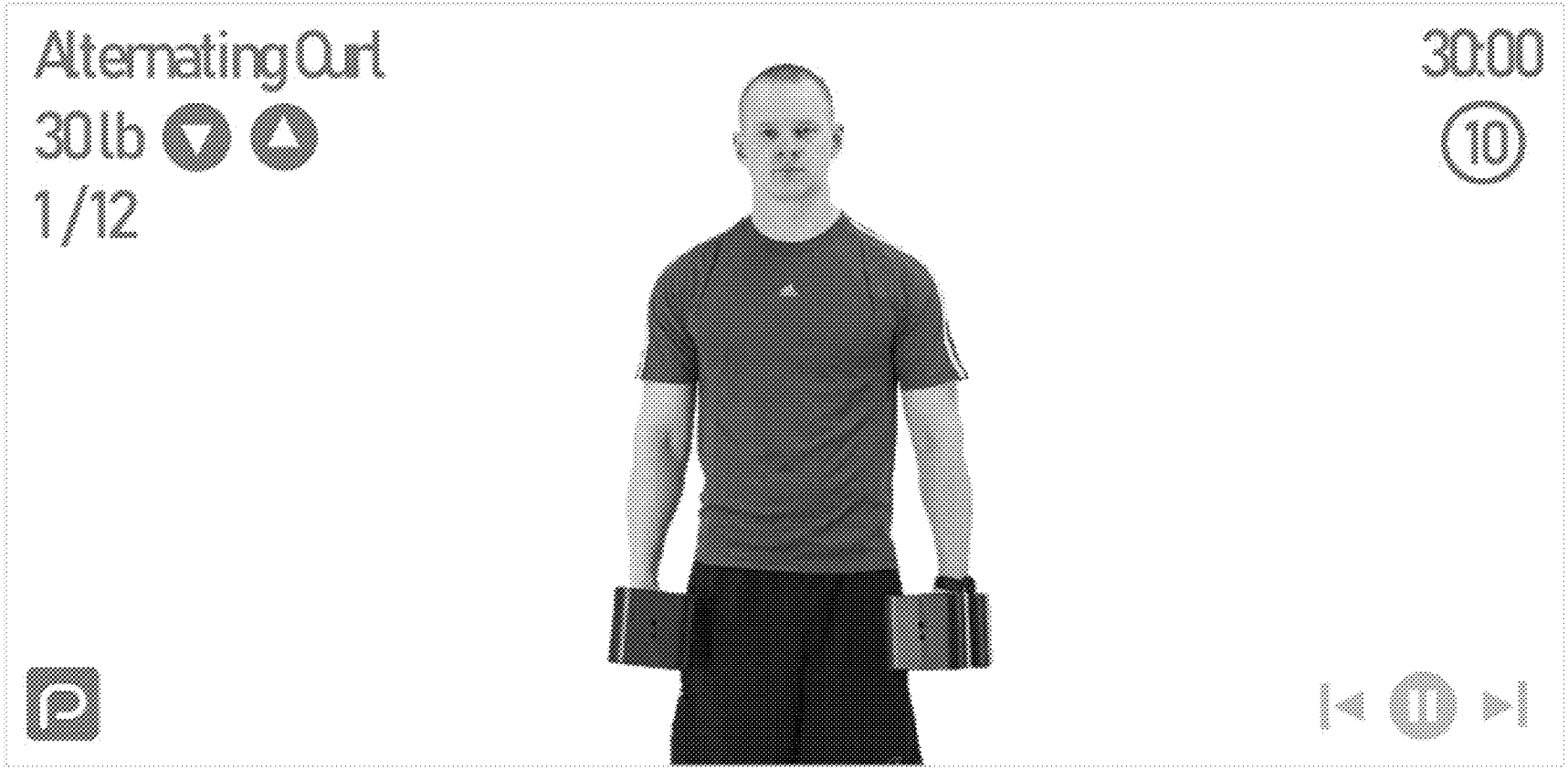
FIG. 46 is a graphic representation of a screen of a software application for use with the portable electronic device used with the assembly or system described herein, showing a video segment and "workout buddy" according to one or more examples of embodiments.
Figure 47:
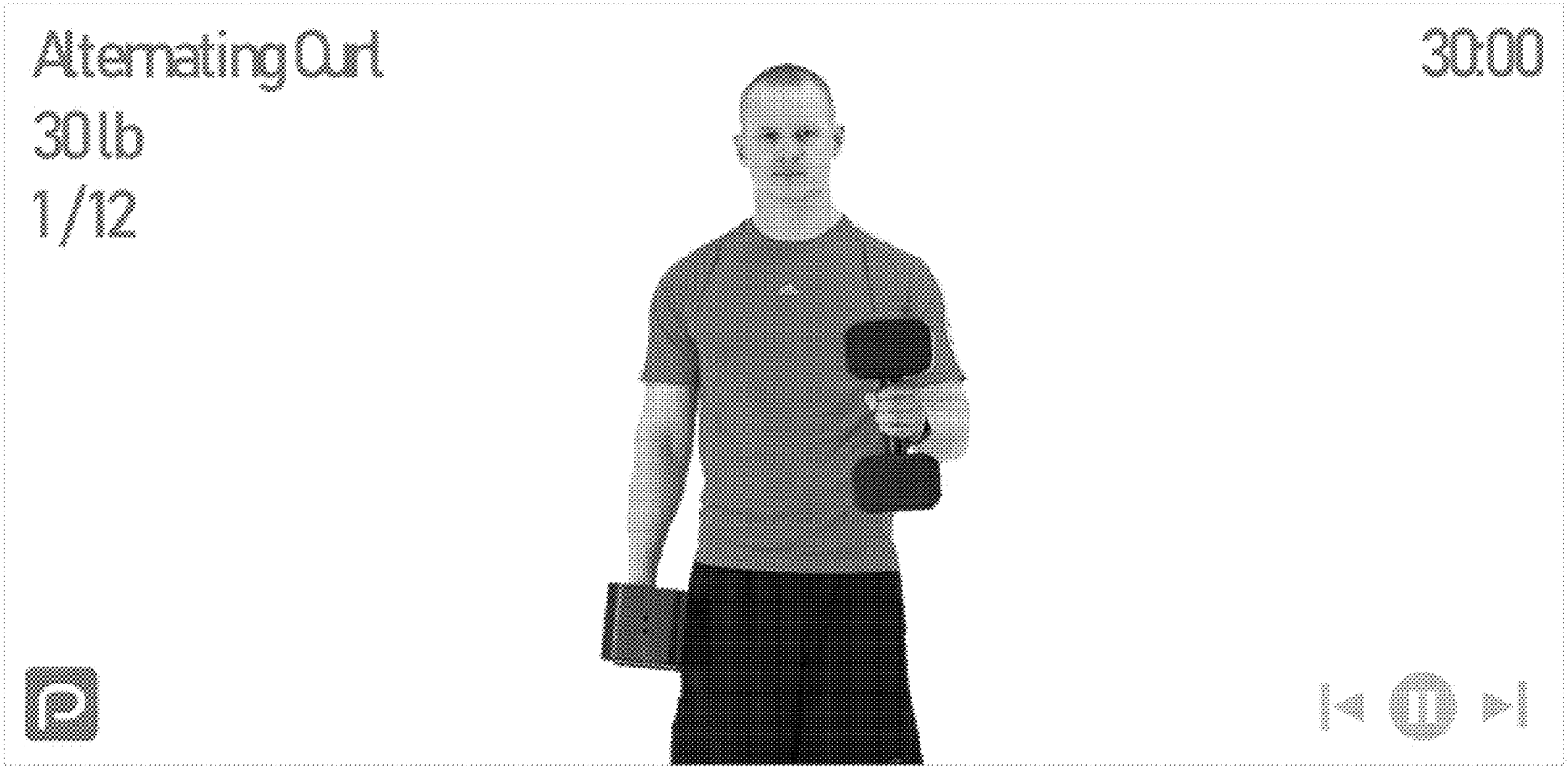
FIG. 47 is a graphic representation of a screen of a software application for use with the portable electronic device used with the assembly or system described herein, showing an initial selection screen of a video segment and "workout buddy" according to one or more examples of embodiments.
Figure 48:
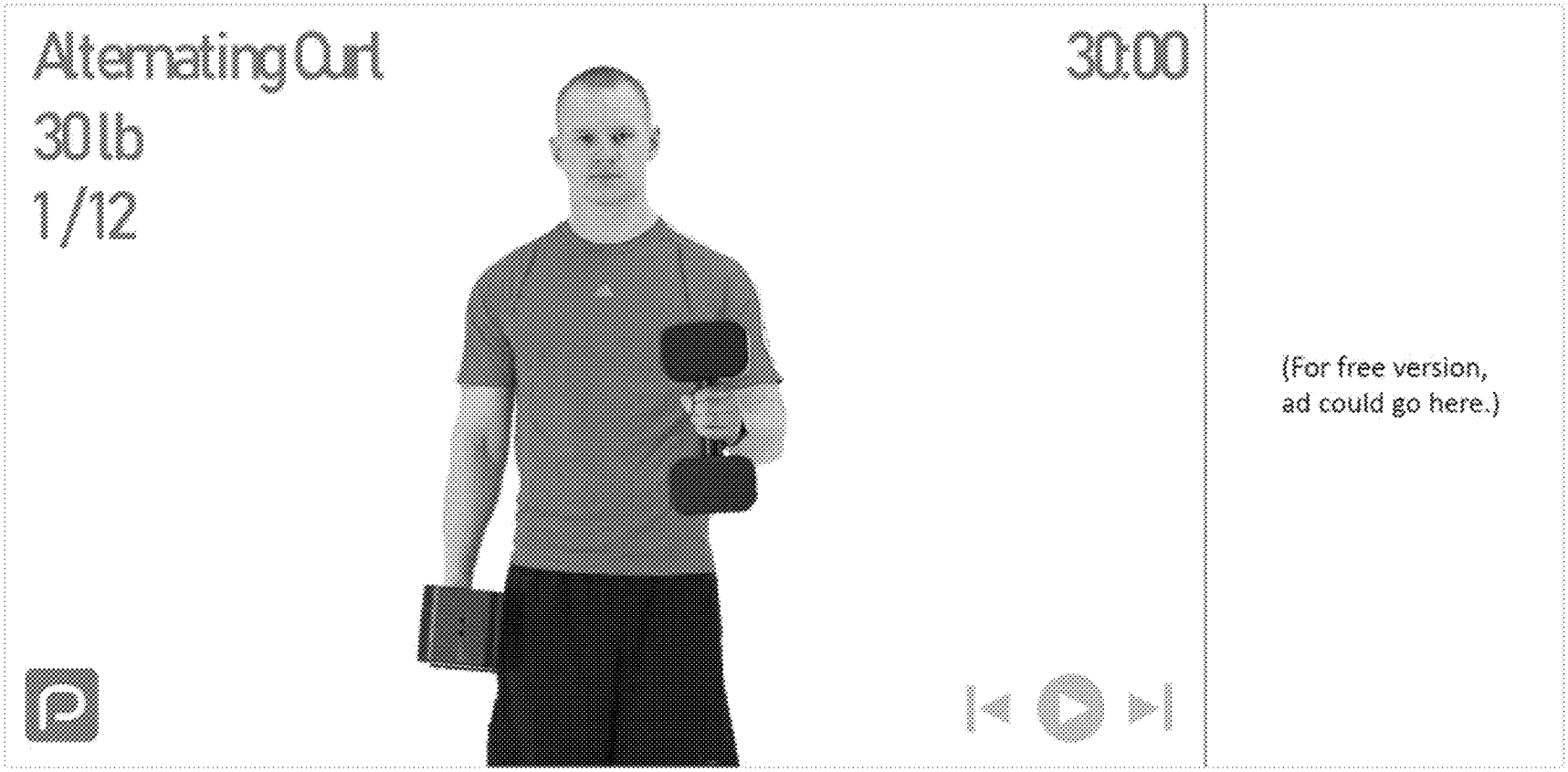
FIG. 48 is a graphic representation of a screen of a software application for use with the portable electronic device used with the assembly or system described herein, showing a video segment and "workout buddy" according to one or more examples of embodiments.
Figure 49:
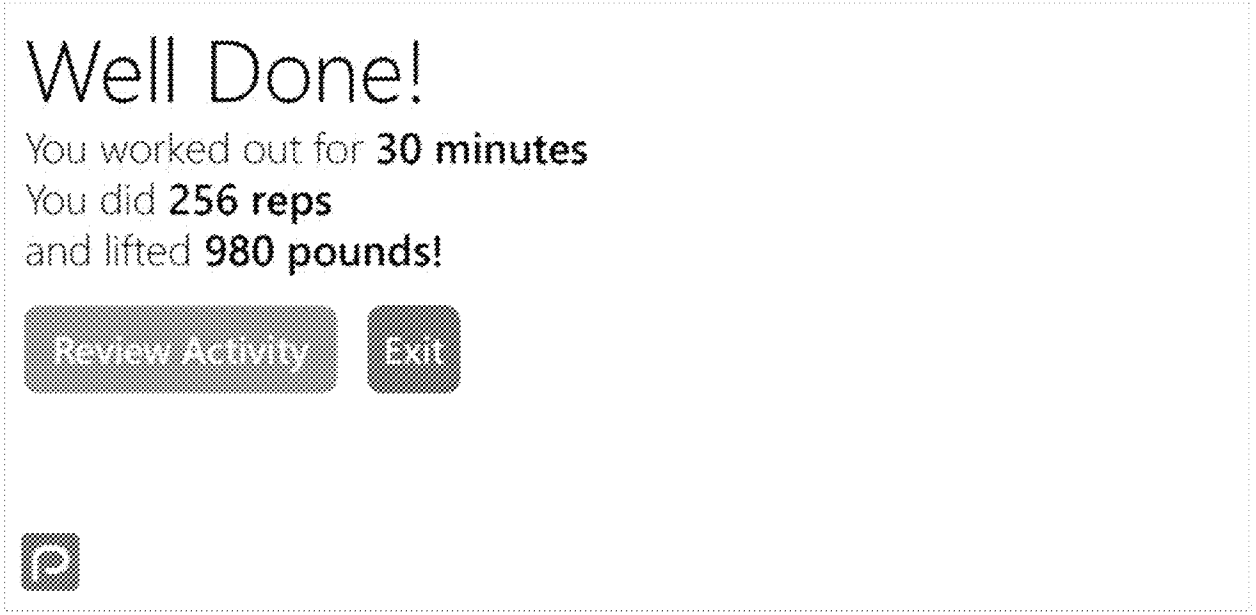
FIG. 49 is a graphic representation of a screen of a software application for use with the portable electronic device used with the assembly or system described herein, showing a workout completion screen and data display according to one or more examples of embodiments.
Figure 50:
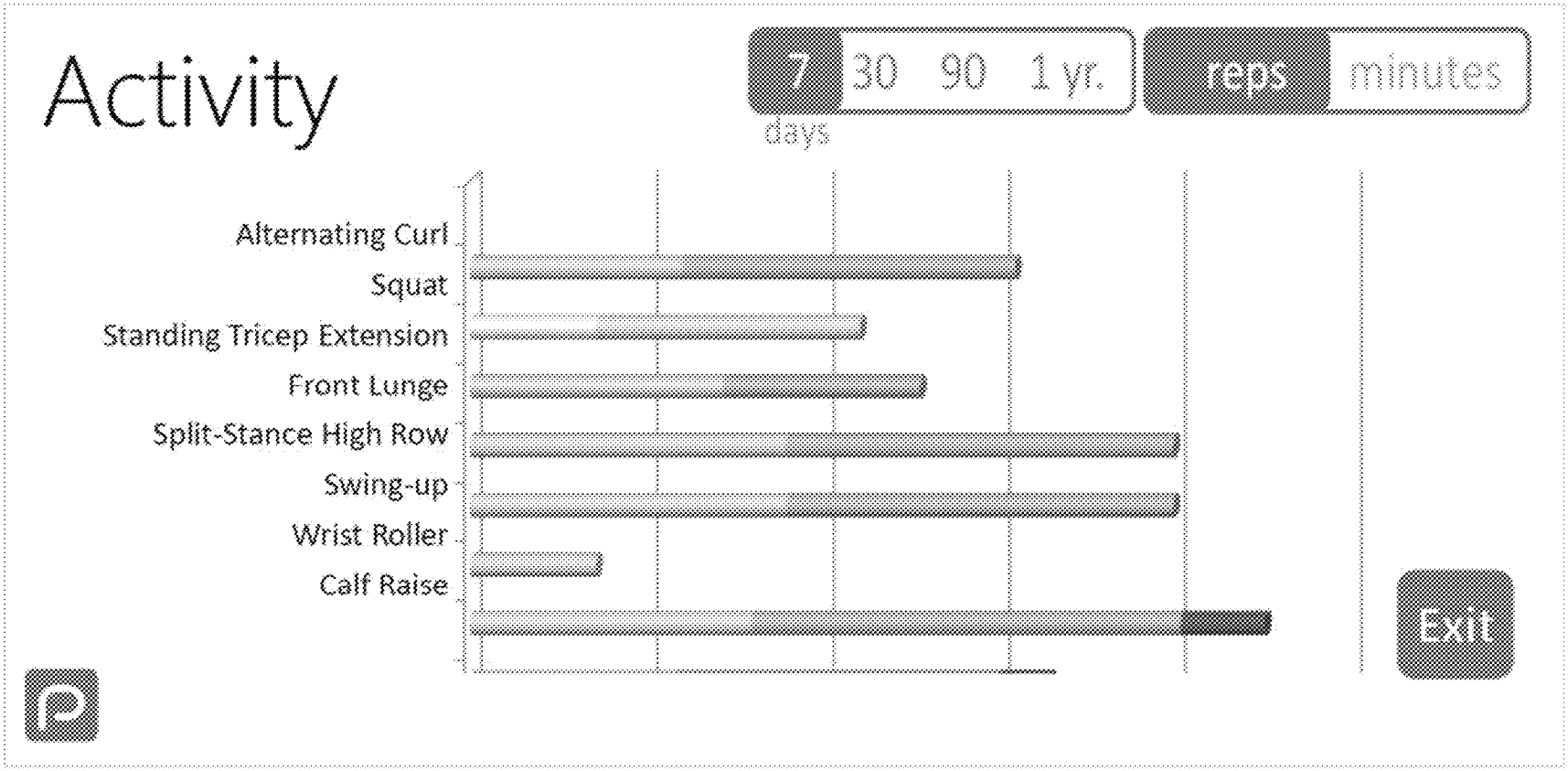
FIG. 50 is a graphic representation of a screen of a software application for use with the portable electronic device used with the assembly or system described herein, showing a data display according to one or more examples of embodiments.

The weight can be adjusted such as shown in FIG. 45; and data on the workout is also collected and communicated to the user as shown in FIGS. 49-50. In one example such as shown in FIGS. 46-48, the app also will show a "workout buddy" on the screen of the portable electronic device in which the user can follow along with the number and pace of each rep, as well as the order of each exercise and the recommended amount of rest.

Alternatively, the user can override any of these components of a workout. For instance, if an arm curl exercise has a default of 20 lb, the user could manually increase the weight to 24 lb by selecting a button on the screen (see FIG. 45). Similarly, the user could manually modify the number of reps, number of sets, or the rest time in the workout with the touch of a button on the screen of the portable electronic device 104. At the end of the workout, the user could proportionally increase or decrease the difficulty for next time with the touch of a button (meaning the weight, number of reps, number of sets and rest time could all be proportionally increased or decreased).

During use of the system described herein, a variety of data may be collected and stored. Examples include, but are not limited to, the type of workout or activity, the amount of weight, the amount of reps, the amount of time, and so forth. The data can also be collected over a period of time (e.g., days, months, years). As shown in FIG. 48-49, data may also be displayed or communicated to a user. While specific examples are provided, it is understood that any number of variables or data points may be used, collected, stored, and/or communicated by the system in a variety of ways.

While an app based system is described, it is also contemplated that weight selection buttons, keys, or any other selection mechanism, including but not limited to an integrated screen, may be provided on the platform 102 for the user to select a desired weight of dumbbell. Likewise, a workout program of the type described herein may be used independent of the weight device 100 and system described herein (e.g., may be used with more traditional weights or weight machines or other weight or exercise systems).

As indicated, the system and methods described herein may be implemented in or by software or a software application (for example, to build the workout program and control the selection of weight rods). To this end, the methods may be implemented in a general-purpose software package or a specific purpose software package. Likewise, the system and methods described herein could include performing data analysis manually. The system may comprise a sensor, voltage source, and other systems for analyzing data.

As described herein, in one or more examples of embodiments, the system, method, and devices described, or method embodied by software, may be implemented by a computer system or in combination with a computer system. The computer system may be or include a processor. The computers for use with the methods and various components described herein may be programmable computers which may be special purpose computers or general purpose computers that execute the system according to the relevant instructions. The computer system can be an embedded system, a personal computer, notebook computer, tablet computer, server computer, mainframe, networked computer, handheld computer, personal digital assistant, workstation, and the like. Other computer system configurations may also be acceptable including, cell phones, mobile devices, multiprocessor systems, microprocessor-based or programmable electronics, network PC's, minicomputers, and the like. Preferably, the computing system chosen includes a processor suitable in size to efficiently operate one or more of the various systems or functions.

The computer can also include a display, provision for data input and output, etc. These devices include a graphical user interface (GUI) or a communication means by which commands may be entered and content may be displayed or communicated. For example, the computer may include a user interface that allows navigation of objects. The computer may implement or include a software application that enables a user to display and interact with text, images, videos, data, and other information and content.

Furthermore, the computer or computers may be operatively or functionally connected to one or more mass storage devices, such as, but not limited to, a database. The memory storage can be volatile or non-volatile and can include removable storage media. The system may also include computer-readable media which may include any computer readable media or medium that may be used to carry or store desired program code that may be accessed by a computer. The invention can also be embodied as computer readable code on a computer readable medium. To this end, the computer readable medium may be any data storage device that can store data which can be thereafter read by a computer system.

The systems and devices described may include physical hardware and firmware configurations, along with hardware, firmware, and software programming that is capable of carrying out the currently described operations and methods.

The system or portions thereof may also be linked to a distributed computing environment, where tasks are performed by remote processing devices that are linked through a communications network. To this end, the system may be configured or linked to multiple computers in a network, including, but not limited to a local area network, a wide area network, a wireless network, and the Internet. Therefore information and data may be transferred within the network or system by wireless means, by hardwire connection or combinations thereof. For example, in certain embodiments a wireless connection may allow for communication between a trainer and a client or a physical therapist and a client, so that the trainer or therapist may receive actual data of what the client did.

Aspects of the method described herein can be implemented on software running on a computer system. The system or method herein, therefore, may be operated by computer-executable instructions, such as but not limited to program modules, executable on a computer. Examples of program modules include, but are not limited to, routines, programs, objects, components, data structures and the like which perform particular tasks or implement particular instructions. The software system may also be operable for supporting the transfer of information within a network.

Accordingly, as detailed herein-above, an auto-adjustable weight device 100 is disclosed that comprises a weight retainer 106 comprising one or more receptors 110; one or more weight rods 108 sized to be received in the one or more receptors 110; and a selector mechanism configured to select one or more weight rods 108 and secure the weight rods 108 in the weight retainer 106. The selector mechanism may be composed of one or more of the rotating disks 116, rotating tabs 122, motor 120, and/or software executing instructions to drive activation and rotation.

An auto-adjustable weight system is also disclosed. The auto-adjustable weight system includes a weight device 100 having a weight retainer 106 which receives one or more weight rods 108, the weight rods 108 being selectively and removably retained within the weight retainer 106. A platform 102 receives the weight device 100 and carries one or more weight rods 108 not selected and retained within the weight retainer 106. A software application in communication with the platform 102 or weight device 100 is configured to select the number of weight rods 108 to be retained within the weight retainer 106.

A physical training system is also disclosed. The system includes a weight device 100 having a weight retainer 106 which receives one or more weight rods 108. The weight rods 108 are selectively and removably retained within the weight retainer 106. A platform 102 receives the weight device 100 and carries one or more weight rods 108 not selected and retained within the weight retainer 106. A software application is provided in communication with the platform 102 or weight device 100 and configured to drive selection of the number of weight rods 108 to be retained within the weight retainer 106. A database of selectable workout segments is also provided, wherein the application selects and executes a selectable workout segment from the database of selectable workout segments simultaneously with the selection of one or more weight rods 108 which are retained by the weight device 100.

Accordingly, a weight device, system, and method are disclosed that leverage the functionality or take advantage of the potential and versatility of the weight device during exercise or physical fitness routine and further let the user focus on exercise rather than changing weight. As disclosed, an auto-adjustable weight device is provided that is combined with a software application executed by a portable electronic device. In addition unlike existing "selectorized" dumbbells or functional trainers, there are no knobs to turn or pins to adjust on the novel weight device disclosed herein. The weight adjustment may happen through the integrated app, and mechanism discussed. Strength training of any type requires a higher degree of understanding than cardio workouts. For strength training, many if not most users don't understand which movements are helpful vs. which can lead to injury. Also, knowing how hard to push and how to arrange the different exercises is not clear to many users. In contrast, the weight system disclosed herein can figure everything out for the user: pace, difficulty, weight, length, type of workout. This can make the workout more engaging. The app also allows people to connect from home; either with an instructor at the gym, or a group of users, all connected from their homes, or with a physical trainer or physical therapist. By making the fitness experience easier to figure out, and more connected to a fitness community, the user is more likely to stay engaged. These and other features and advantages of devices, systems, and methods according to this invention may be described in, or are apparent from, the foregoing description.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

Moreover, some portions of the detailed descriptions herein are presented in terms of procedures, steps, logic blocks, processing, and other symbolic representations of operations on data bits that can be performed on computer memory. These descriptions and representations are the means used by those skilled in the data processing arts to most effectively convey the substance of their work to others skilled in the art. A procedure, computer executed step, logic block, process, etc., is here, and generally, conceived to be a self-consistent sequence of steps or instructions leading to a desired result. The steps are those requiring physical manipulations of physical quantities. Usually, though not necessarily, these quantities take the form of electrical or magnetic signals capable of being stored, transferred, combined, compared, and otherwise manipulated in a computer system. It should be borne in mind, however, that all of these and similar terms are to be associated with the appropriate physical quantities and are merely convenient labels applied to these quantities. Unless specifically stated otherwise as apparent from the discussions herein, it is appreciated that throughout the present invention, discussions utilizing terms such as "receiving," "sending," "generating," "reading," "invoking," "selecting," and the like, refer to the action and processes of a computer system, or similar electronic computing device, including an embedded system, that manipulates and transforms data represented as physical (electronic) quantities within the computer system.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The technical effects and technical problems in the specification are exemplary and are not limiting. It should be noted that the embodiments described in the specification may have other technical effects and can solve other technical problems.

The invention claimed is:

1. An auto-adjustable weight device comprising:

a weight retainer comprising a plurality of weight receptors;

a plurality of weight rods sized to be received in the plurality of weight receptors, wherein said plurality of weight rods comprises at least two rods having the same or different weight;

a selector mechanism configured to select one or more weight rods from the plurality of weight rods and secure the one or more weight rods in the weight retainer receptors in response to an instruction executed by a software application provided on a processor, wherein the selector mechanism comprises: a rotating disk, a rotating tab that mates with the rotating disk, and said instruction executed by said software application to drive activation and rotation of either the rotating disk or rotating tab, wherein a motor drives rotation of the rotating disk or rotating tab and in communication with the software application;

wherein the weight retainer comprises a housing and the one or more weight rods secured in the weight retainer are captured entirely within the weight receptor such that the housing is provided around the weight rod; and a platform which carries the one or more weight rods when not in use, wherein the platform contains a portion of the selector mechanism.

2. The auto-adjustable weight device of claim 1, wherein the software application drives selection and retention of a number of weight rods of said plurality of weight rods to be retained within the weight retainer receptors.

3. The auto-adjustable weight device of claim 1, wherein the weight device is a dumbbell.

4. The auto-adjustable weight device of claim 1, wherein the weight device is a functional trainer.

5. An auto-adjustable weight system comprising:

a weight device comprising a housing having a weight retainer therein which receives a plurality of weight rods, the weight rods being individually selectively and removably retained entirely within the weight retainer, such that the housing surrounds the retained weight rods, wherein said plurality of weight rods comprises at least two rods having the same or different weight;

a platform which receives the weight device and carries one or more weight rods from said plurality of weight rods which are not selected and retained within the weight retainer;

a selector mechanism comprising a rotating disk and a rotating tab that mates with the rotating disk, wherein the platform contains a portion of the selector mechanism and a motor driving rotation of the rotating disk or rotating tab; and a processor having a software application in communication with the platform or weight device and in communication with the motor and configured to drive selection and retention of one or more weight rods of said plurality of weight rods retained within the weight retainer, and wherein tire software application executes instructions to drive activation and rotation of either the rotating disk or rotating tab.

6. The auto-adjustable weight system of claim 5, wherein the weight device is a dumbbell.

7. The auto-adjustable weight system of claim 5, wherein the weight device is a functional trainer.

8. A physical training system comprising:

a weight device having a weight retainer which receives and surrounds a plurality of weight rods, the plurality of weight rods being individually selectively and removably retained within the weight retainer, wherein said plurality of weight rods comprise at least two rods having the same or different weight;

a selector mechanism comprising a rotating disk, a rotating tab that mates with the rotating disk, and a motor driving rotation of the rotating disk or rotating tab;

a platform which receives the weight device and carries one or more weight rods from said plurality of weight rods which are not selected and retained within the weight retainer, wherein the platform contains a portion of the selector mechanism;

a processor having a software application in communication with the platform or weight device and the motor and configured to drive selection and retention of the number of weight rods retained within the weight retainer, wherein the software application executes instructions to drive activation and rotation of either the rotating disk or rotating tab; and a database of selectable workout segments in communication with the processor, wherein the software application selects and compiles a collection of selectable workout segments, and executes said compilation of selectable workout segments from the database of selectable workout segments and executes the selection of one or more weight rods of said plurality of weight rods which are retained by the weight device to correspond with the selectable workout segments.

9. The physical training system of claim 8, wherein the weight device is a dumbbell.

10. The physical training system of claim 8, wherein the weight device is a functional trainer.

* * * * *